US006172688B1

(12) United States Patent
Iwasaki et al.

(10) Patent No.: US 6,172,688 B1
(45) **Date of Patent: *Jan. 9, 2001**

(54) PRINTER AND PRINTING METHOD

(75) Inventors: Shinichi Iwasaki, Kawasaki; Yuichi Watanabe, Machida; Tsutomu Harada, Tokyo; Tatsuya Fukushima, Kawasaki; Yuzo Wada, Yokohama; Katsumi Sugiyama; Kazunari Nishimoto, both of Kawasaki; Shigeru Inose, Ibaraki-ken; Kohei Ishikawa, Kawasaki, all of (JP)

(73) Assignee: Canon Aptex Inc., Mitsukaido (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/986,732

(22) Filed: Dec. 8, 1997

Related U.S. Application Data

(63) Continuation of application No. 08/287,302, filed on Aug. 8, 1994, now abandoned.

(30) Foreign Application Priority Data

| | | |
|---|---|---|
| Aug. 6, 1993 | (JP) | 5-196196 |
| Aug. 6, 1993 | (JP) | 5-196211 |
| Aug. 6, 1993 | (JP) | 5-196437 |
| Aug. 6, 1993 | (JP) | 5-196438 |
| Aug. 6, 1993 | (JP) | 5-196443 |

(51) Int. Cl.[7] ..... B41J 3/00
(52) U.S. Cl. ..... 347/2
(58) Field of Search ..... 347/42, 85, 89

(56) References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,429,320 | 1/1984 | Hattori et al. . | |
| 4,459,600 | 7/1984 | Sato et al. . | |
| 4,463,359 | 7/1984 | Ayata et al. | 347/56 |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,875,174 | 10/1989 | Olodort et al. | 364/519 |
| 4,926,196 | 5/1990 | Mizoguchi et al. | 347/23 |
| 5,023,728 | 6/1991 | Nimura et al. | 347/3 X |
| 5,136,307 | 8/1992 | Uchida et al. | 347/104 X |
| 5,285,220 | 2/1994 | Suzuki et al. | 347/19 |
| 5,322,380 | 6/1994 | Crocker | 347/104 X |
| 5,471,322 | 11/1995 | Murata | 347/3 X |
| 5,619,239 * | 4/1997 | Kotaki et al. | 347/86 |
| 5,666,146 * | 9/1997 | Mochizuki et al. | 347/86 |

FOREIGN PATENT DOCUMENTS

| | | | |
|---|---|---|---|
| 54-56847 | 5/1979 | (JP) | B41M/5/26 |
| 58-194584 | 11/1983 | (JP) | B41J/13/26 |
| 59-123670 | 7/1984 | (JP) | B41J/3/04 |
| 59-138461 | 8/1984 | (JP) | B41J/3/04 |
| 60-71260 | 4/1985 | (JP) | B41J/3/04 |
| 61-104872 | 5/1986 | (JP) | B41J/3/20 |

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

A label printer performs recording on a roll label comprising a number of label sheets bonded in succession on a release sheet. The printer utilizes an ink jet method to attain a smaller size and to print information accurately. The printer comprises a conveyance section for conveying the label roll to an ink jet print head, an ink supply section for supplying ink to the head, and a recovery unit for making the head performance stable. A conveyance surface of the label roll is made substantially horizontal, with the ink jet print head and the recovery unit disposed above the surface and the ink supply section disposed underneath the surface.

20 Claims, 58 Drawing Sheets

| |
|---|
| FIG. 35A |
| FIG. 35B |

FIG. 42A

| |
|---|
| EXCLUSIBLE COMMAND 1 |
| EXCLUSIBLE COMMAND 2 |
| EXCLUSIBLE COMMAND 3 |
| EXCLUSIBLE COMMAND 4 |
| EXCLUSIBLE COMMAND 5 |
| EXCLUSIBLE COMMAND 6 |
| ..... |
| EXCLUSIBLE COMMAND n |

FIG. 42B

| |
|---|
| EXCLUSIVE COMMAND 1 |
| EXCLUSIVE COMMAND 2 |
| EXCLUSIVE COMMAND 3 |
| EXCLUSIVE COMMAND 4 |
| EXCLUSIVE COMMAND 5 |
| EXCLUSIVE COMMAND 6 |
| ..... |
| EXCLUSIVE COMMAND n' |

FIG. 42C

EXCLUSIBLE AREA

| | | | |
|---|---|---|---|
| UPPER LIMIT 1 | LOWER LIMIT 1 | LEFT LIMIT 1 | RIGHT LIMIT 1 |
| UPPER LIMIT 2 | LOWER LIMIT 2 | LEFT LIMIT 2 | RIGHT LIMIT 2 |
| UPPER LIMIT 3 | LOWER LIMIT 3 | LEFT LIMIT 3 | RIGHT LIMIT 3 |
| UPPER LIMIT 4 | LOWER LIMIT 4 | LEFT LIMIT 4 | RIGHT LIMIT 4 |
| UPPER LIMIT 5 | LOWER LIMIT 5 | LEFT LIMIT 5 | RIGHT LIMIT 5 |
| UPPER LIMIT 6 | LOWER LIMIT 6 | LEFT LIMIT 6 | RIGHT LIMIT 6 |
| ... | ... | ... | ... |
| UPPER LIMIT m | LOWER LIMIT m | LEFT LIMIT m | RIGHT LIMIT m |

FIG. 45A
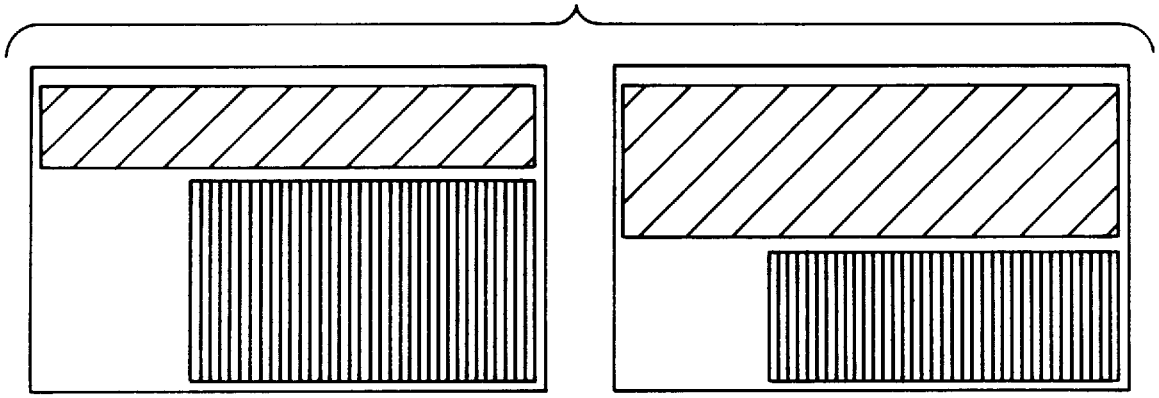
FIG. 45B
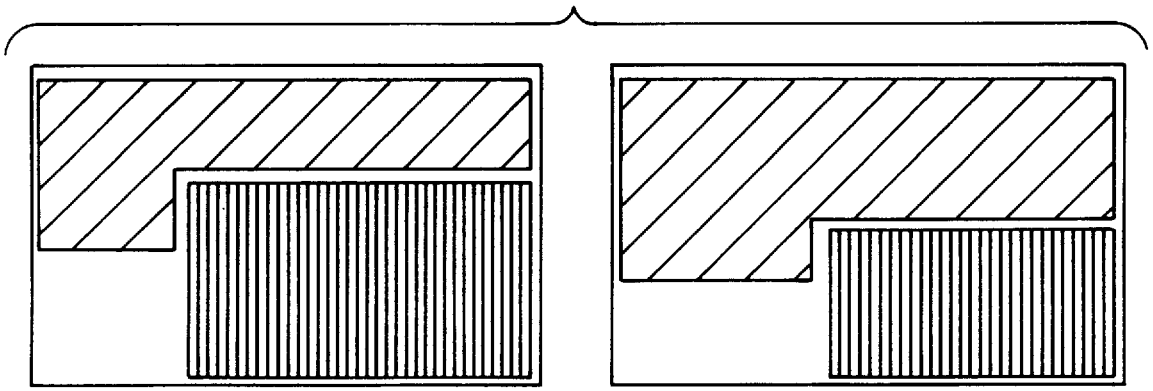
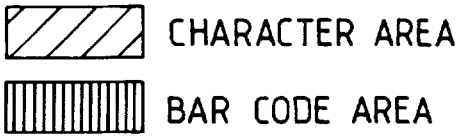

APPLIED PULSE

PRINTER AND PRINTING METHOD

This application is a continuation under 37 CFR 1.53(b) of application Ser. No. 08/287,302 filed Aug. 8, 1994, now abandoned.

BACKGROUND OF THE INVENTION

1. Field of the Invention

The present invention relates to a label printer which is widely used, especially in POS, FA, physical distribution, etc., and more particularly to a label printer utilizing an ink jet print system.

2. Related Background Art

Hitherto, none of the label printers using the ink jet printing method have been put to practical use. The advantages of the typical ink jet recording may include excellent quietness owing to out-of-contact with the print medium, high printing rate, printing with high density, easy color constitution, and small size. On the other hand, most label printers take the form of conveying a so-called label sheet having a number of labels bonded in succession on a length of the release sheet referred to as a separator and formed into a roll, in which in applying the ink jet system to the label printer, some measures must be taken to suppress the floating or skew running of the sheet in the printer head portion.

In recent years, the bar code is liable to be insufficient, the color constitution is examined, and from this regard, the adoption of the ink jet system is effective, but if an the printing speed of the label printer is attempted in designing the color label printer, the frequency of the print signal to be given to the print head of each color is increased, which requires the capacity of drive power source to be increased, resulting in larger size of the power source and causing the increase of the cost.

Further, in the case of the ink jet system, to prevent the unstable discharge of the ink because of being left unused for the long term, it is effective to use a so-called recovery system to circulate the ink around the print head. This recovery operation is typically performed with a recovery unit referred to as a recovery system placed in direct contact with the print head which is printing means. However, as the label printer typically utilizes the label sheet wound like a roll, the sheet never disappears at the print position. Accordingly, the disposition of the recovery system and the design of the recovery sequence are very difficult, as compared with those intended for the cut sheet such as the normal office printer.

Along with these, it is very difficult to make compact the print head, the recovery system unit, the ink supply system, and the printing medium conveyance system.

Several normal label printers have been put to practical use, which adopt a thermal transfer recording method of transferring the ink onto the recording medium via the ink ribbon using the heat generating elements, or a thermal recording method of coloring the thermosensible recording sheet by heating.

At present, among the ink jet recording systems using the heat generating elements, there is a bubble jet system (thermal ink jet system) discharging the ink by producing bubbles in the liquid ink due to the heat energy generated by the heat generating elements, and using the pressure generated upon the growth of the bubbles, which is applied to the output devices (printers) in many fields.

The durability of the print head using the above heat generating elements may be governed by the disconnection of a resistor useful as the heat generator, the failure of a switching element such as a transistor for controlling the conduction to each heat generator, and so on. Further, it may be also governed by the damage of the head due to the friction caused by its contact with the paper or ink ribbon in the print heads of contact type, particularly, for the thermal recording or thermal transfer recording, or the clogging with the ink or contamination in the ink flow passage near the heat generating circuit in the ink jet recording system.

When part of the heat generating elements of the print head, in other words, the print segment, is broken by above factors, the information to be printed may be partially lacked, or the printed information may be recognized incorrectly, whereupon the replacement of the print head is required. However, the print head is an expensive element, while the labor for the replacement and the inoperative loss time required for the replacement may occur, thereby giving rise to the increase in the print cost.

To cover the above drawbacks, a proposal has been made as disclosed in Japanese Laid-Open Patent Application No. 61-104872, in which the electric current too small to effect printing is passed through the heat generating circuit of the print head to detect the disconnected portion, determining whether or not print data is present at the print position corresponding to its disconnected portion, in which if not present, the printing is directly made, or otherwise, the location without print data is searched in its neighborhood, and if such a location is present, the printing is made at that location. Or a method of representing the life of the thermal head as the recordable length, with an indication "THE DURABILITY OF THIS THERMAL HEAD IS ROUGHLY 50KM" has been taken to indicate the replacement time.

On the other hand, in conventional printers, because if the printing is performed irrespective of the amount of the serpentine or skew running of the print medium to be printed, the print quality may be degraded or the color aberration may occur in the color printer, the amount of serpentine or skew running is detected, and in excess of the set amount of serpentine or skew running, the operation is stopped as an abnormal conveyance, with an error indication on the screen to prompt the operator to reset or reinsert of the sheet.

However, regarding the life of the head, owing to the ruled line or frame contained in the print context, the number of conductions to a specific heat generating circuit within the print head increases, upon printing a number of sheets, so that the life of the heat generating circuit will determine the life of the whole of the print head, or even if the printing is performed by shifting the disconnected portion, the number of conductions to the specific heat generating circuit also increases, possibly resulting in a risk of causing a disconnection of the line.

Also, regarding the skew or serpentine running of the printing medium, the operation is stopped if the amount of skew or serpentine running is in excess of a certain value, and in the constitution of having the error indication, the set value for satisfying the print quality is smaller as the print context is more highly defined, resulting in a problem that if there occurs even a slight amount of skew or serpentine running, the printing is stopped due to the error detection, frequently necessitating the error release operation, or causing the useless consumption of the print medium.

The present invention has paid attention to specific problems with the label printer for performing the printing on the labels bonded on the release paper.

In the printer with the labels bonded in succession on the release paper as the printing medium, the labels of various shapes are selected in accordance with the print format or the quantity of information to be printed, and mounted on the printer. If the shape of the labels mounted does not accord with the print format, the printing may occur out of the label portion, resulting in the problem of contaminating the conveyance system, degrading the print quality, or shortening the life of the printer. Therefore, it is preferable to judge the shape of the labels inside the printer. A device for judging the shape of such labels has been described in, for example, Japanese Laid-Open Patent Application No. 58-194584. That is, the length of label in a lateral direction regulates one side of each of successive labels, in which a required number of detectors are disposed along a width direction near the other side to determine the length in the lateral direction in accordance with the signals from such detectors. The length of label in a longitudinal direction can be determined by a method of providing apertures indicating the print start in the labels to obtain the distance from the first aperture to the next aperture by counting the number of pulses for a sheet feed motor, calculating the length of label from the counted value, and judging whether or not the label length accords with the print format.

However, the above conventional technique is effective if the shape of the label is rectangular, but when the label of other shape is mounted, no consideration is taken and the following problems were encountered.

(1) The rectangular shape of label can be only judged, and when the shape of label is changed, for example, when the label of circular, elliptic, or lozenged shape is mounted on the printer, it can not be judged. As the label is mostly used for the appeal of the product, a variety of shapes are used. Therefore, the judgment only for the rectangle is insufficient.

(2) It is difficult to judge whether or not the context printed on the label coincides with the information to be printed. Particularly when the bar code is printed, the judgment can not be made if the bar is not printed due to some cause, or the print density is lower. If the bar code data is not printed correctly, the system will process false information, and it is quite important to secure correct printing in the printer.

Also, in the conventional printers, in printing on the continuous paper like a roll such as the label sheet, the print process is constituted of a developing process of data for one page and a printing process for one page which is started after development, and when printing data exceeding the length of used label over a plurality of labels, the printing may occur on the mount between labels, resulting in a problem that the regularity of data can not be held by a combination of labels which are then pasted.

Similarly, in printing the printed matter formed of a group of multiple pages onto the continuous paper, the page designation is cumbersome when the printing is retried due to jam, and is quite inconvenient to the operation. Also, the disposition or reprint of page units is required to secure the validity of the printed matter, presenting a significant problem on the management.

Further, in the conventional printers, print data is developed in the area of one page by designating the relative or absolute position, whereas when print data is developed by designating the relative position, the positional deviation of other print data may occur owing to redundant print data such as character information, or when print data is developed by designating the absolute position, print data areas may overlap each other in designation, which was quite inconvenient on the design of document and the creation of print data.

The peculiar problems with the label printer may include:

Insufficient detecting ability concerning various label shapes

Inability of confirming whether or not the bar code has been correctly formed

Difficulty in forming data over multiple labels by dividing it

Difficulty in reprinting data upon divided formation

Inconvenience in making the format of print data

In performing the image output for the information desired by the operator using the printer, it is desired in some cases to add some information, besides that information concerned. For example, in the applications of printing product information including the bar code to the labels, using a plurality of label printers, and pasting them to the products, it is quite convenient that printer information is additionally provided, besides the product information, because the printer which has printed can be immediately discriminated, if a print failure happens, thereby enabling the rapid measure such as a maintenance to be taken.

Also, such labels are bonded in succession on the release paper and formed into a roll in most cases, wherein a number of labels are printed successively beforehand with this roll mounted on the printer, and pasted on the product separately. And when there are a plurality of different types of products, a plurality of different types of labels correspondingly are printed beforehand, whereas if it can be seen at a glance where the print context is changed in pasting the label onto the product as the product information has similar format, no false pasting will occur, and no burden is imposed on the operator.

In the conventional printers, in adding the specific information, it is obliged to add the specific information to the information to be originally printed, which was cumbersome. Also, as above described, where the change of print context occurs in printing the labels in succession, a constitution has been disclosed in Japanese Laid-Open Patent Application No. 62-10852, in which on one label between a group of labels printed previously and a group of labels to be printed later, the character information indicating the previously printed context or the later printed context is only printed, although the character information itself must be created by the operator himself, and the label having that information printed is not subjected to other uses than clarifying that the change has occurred, and wastefully used.

Also, in recent years, as the method of coding the information to be used, various types of bar codes have been put to practical use. Since the bar code is used for the physical distribution or management, read by an equipment referred to as a reader, and easily converted into data which can be processed on the computer, the symbols are standardized for each application, and employed in many fields. More recently, even in the system of the printer of personal use or host apparatus, it can be output. Also, in the label printer, the bar code may be often used to record the information of the object to paste the label sheet.

However, the bar code is required to print the information quite correctly, owing to its features, and be presented for particular purposes in reliable manner.

The bar code symbol in accordance with various standards such as JAN, UPC, EAN, etc., can represent each number of 0 to 9 (character) by a combination of the black bar and the white bar satisfying the breadth of a certain standard.

For example, in Japan, JAN (Japanese Article Number) code has been established as the unique bar code symbol of Japan. JAN code is one in which the character is represented by a combination of two black bars and two white bars. This is defined in more detail in JISX0501, wherein the strict accuracy is required, such that when the magnification is one, the module dimension is 0.33 mm, with the bar width tolerance being ±0.101 mm, and when the magnification is 0.8 at minimum, the module dimension is 0.264 mm, with the bar width tolerance being ±0.035 mm.

The apparatus for printing such bar code was conventionally an apparatus having the thermal head in most uses, but it is considerably difficult to make the adjustment of dot system (or width) because of its constitution of controlling the heating value of the heat generator by changing the applied voltage or application time.

Particularly, in recording the bar code using the thermal heat, the heat accumulation in the specific heat generating elements is problematical because specific heat generating elements are driven consecutively when printing the bar extending in a direction (sheet conveying direction) orthogonal to the line head. In particular, because the upper portion of the bar to be printed later in a direction of the bar height, is formed thicker than the lower portion due to accumulated heat in the heat generating element, there is the necessity for controlling the energy to be applied to the heat generating element.

On the other hand, in printing in the direction other than the conveyance direction, such as the direction of line head, a number of heat generating elements disposed in succession in the direction of the array of heat generating elements of the full-multi head are driven at a time, and due to the accumulated heat, the elements not relating to printing may be heated, producing streaks in the tailing state to affect the image quality. Particularly, in the bar code with higher printing accuracy, the bar interval having no printing may be disordered, adversely effecting the detection accuracy of the bar code to great extent.

Also, if recording in the low temperature state of the heat generating elements (after succession of unprinted lines), the coloration is not fully made, and there is a risk that the fine line may be recorded at lower density, so that it can not be correctly detected by a bar code scanner.

Therefore, the control is required to effect full coloration at the next recording in the elements not involving recording, or to prevent excessive temperature elevation of the heat generating elements in the elements involving successive recording.

Thus, the apparatus constitution having the head with the ink jet system is effective to adopt. However, the ink jet head effects the printing on the printing medium by discharging the ink through discharge ports, in which there may occur a deviation (hereinafter referred to as "offset") between the ideal impinging position of the discharged ink and the actual impinging position of the ink, but in the constitution where the distance between the head and the platen in printing is fixed, the line width due to the offset becomes unstable, when the distance (head gap) between the discharge port and the printing medium is changed by the thickness of the printing medium to be conveyed on the platen, or when the fine bar is printed, resulting in a risk that a required bar accuracy can not be retained.

Regarding all printers of the type of effecting the image formation of dots, such as a thermal printer, the black bar may be broadened at both ends because of the area of formed dot, in which there is a risk that the black bar is thicker than the regular width. Along with this, the white bar provided between black bars may be thinner.

SUMMARY OF THE INVENTION

The present invention has been achieved in the light of aforementioned problems.

It is an object of the present invention to provide a recording apparatus which adopts an ink jet recording system and takes the form of a label printer making the use of its advantages.

Also, it is another object of the present invention to provide a small label printer making the full use of the advantages of the ink jet recording system.

To accomplish the above objects, the present invention provides a printer which performs the printing by using continuous paper in the form of a plurality of labels bonded in succession on a release paper, as well as using a print head having a plurality of ink discharge ports arranged, with said labels as the printing medium, characterized by comprising control means for controlling said print head, storage means for storing print data to be printed by said head control means, means for creating said print data or changing or correcting at least a part of print data precreated, conveying means for conveying said continuous paper relative to said print head, ink supply means for supplying the ink to said print head, head recovery means for making stable the print performance with said print head, and communication means for communicating data including said print data with the external equipment.

Herein, said conveying means has means for effecting conveyance of said continuous paper at the print position with said print head via a conveyance belt relying on the use of electrostatic absorption or attraction, wherein upstream of said print position in a conveyance direction, there are provided means for correcting the curl of said continuous paper which is formed into a roll, and means for giving an adequate flexure in conveying said continuous paper, and wherein said conveyance belt is composed of an NBR layer inside the conveyance belt and a silicone type insulating layer provided outside and facing said continuous paper, prior to adsorption of said continuous paper, minus electric charges being applied to said silicone type insulating layer by a first electrification means, and plus electric charges being applied to the neighborhood of the contact point between said continuous paper and said conveyance belt by a second electrification means provided in the form of carrying the recording sheet between it and said conveyance belt.

In the above constitution, the conveyance surface of said continuous paper with said conveying means is situated between the side on which said print head and said head recovery means are located and the side on which said ink supply means is located, and further, the conveyance surface of said continuous paper at the print position with said print head is substantially parallel to the level surface, said print head and said head recovery means being disposed upward of said conveyance surface and said ink supply means being disposed downward of said conveyance surface.

Further, in the above constitution, there are provided first to third memory access means for having access to said storage means, and control means for determining one of said three memory access means on the basis of predetermined priority level by a first bus decision means for deciding the priority level of memory access, said three memory access means further including a plurality of data transfer means, and a second bus decision means for transferring memory data sequentially to said plurality of data transfer request means within a permitted period for said three memory access means.

Also, there is further provided means for effecting print interruption and restart during the printing operation, wherein said print interruption or restart can be effected at every predetermined period, or by a command instruction, or through the key or switch operation, and further the recovery operation can be effected by said head recovery means during said print interruption. And said recovery means can be operated by ink discharge in accordance with predetermined pattern data, and said recovery operation can be effected by the circulation of the ink through said print head, said ink supply means and said head recovery means.

Also, the present invention is a printer which performs the printing on the print medium by using a print head having a plurality of ink discharge ports arranged, said printer comprising conveying means for conveying said print medium relative to said print head, ink supply means for supplying the ink to said print head, and head recovery means for making stable the printing performance with said print head, characterized in that the conveyance surface of said print medium with said conveying means is positioned between the side on which said head recovery means is located and the side on which said ink supply means is located.

Herein, the conveyance surface of said print medium at the print position with said print head is substantially parallel to the level surface, said print head and said head recovery means being disposed upward of said conveyance surface, and said ink supply means being disposed downward of said conveyance surface.

Further, in the above constitution, said head recovery means has a pump for accepting and withdrawing the ink discharged from said print head, and said ink supply means has a pump for supplying the ink in a direction toward said print head, in which these two pumps can be driven by a single driving source.

In addition, in the above constitution, a plurality of print heads can be mounted corresponding to the inks of different color tones, and further said plurality of print heads can be disposed in the order of lower ink lightness from upstream in the conveyance direction of said print medium.

Further in addition, said print head has elements for generating the heat energy used to discharge the ink, and temperature sensor attached to said print head, thereby effecting the interruption of the print operation, or the reduction of the printing speed, or the circulation of the ink through said print head by sensing the rise in temperature of said print head by said sensor.

With the above constitution, a label printer adopting the ink jet system and making effective use of its advantages can be realized, and constructed in reduced size.

Another object of the present invention is to improve the life of the head, and enhance the print quality by appropriately selecting the printing elements involving printing in accordance with the print context or the attitude in conveying the printing medium.

To this end, the present invention is a printer which performs the printing, using a print head having a plurality of printing elements arranged, on the printing medium to be conveyed relatively thereto in a direction different from said arranged direction, characterized by comprising at least one of means for judging the print context relating to said printing, and means for judging the attitude of said print medium to be conveyed relative to said print head, and means for selecting the printing elements involving printing in accordance with said judgment.

Herein, said print context judging means detects how many printing elements are not involved in said printing from the end of said plurality of arranged printing elements in accordance with the print context relating to said judgment, and said selection means shifts the printing elements to be used for every predetermined number of said printing sheets to be printed consecutively for the same context corresponding to the number of detected elements.

Also, said attitude judging means detects the inclination of said printing medium, and said selection means can select the printing elements to be used corresponding to said detected inclination.

With the above constitution, since the printing elements involving printing are appropriately selected in accordance with the printing context or the attitude in conveying the printing medium, the reduced head life is suppressed by restraining the bias in the use frequency of elements, and the print quality can be retained without respect to the attitude of the printing medium.

Also, the present invention has paid attention to the specific applications as the label printer.

As described above, the conventional problems may include:

Insufficient detecting ability concerning various label shapes

Inability of confirming whether or not the bar code has been correctly formed

Difficulty in forming said over. multiple labels by dividing it

Difficulty in reprinting data upon divided formation

Inconvenience in making the format of print data

The present invention aims at resolving at least one of those problems.

To this end, the present invention is a printer which performs the printing on a plurality of labels bonded in succession on a release paper, with said label as the printing medium, using printing means for printing print data fitted to the shape of said label, characterized by comprising a sensor for scanning the whole surface of said release paper on a conveyance passageway of said label, label shape detecting means for detecting the shape of said label with said detected information, label shape judging means for judging whether said detected label shape data is fitted to said print data, and control means for controlling the printing operation based on said judgment.

Herein, said sensor is disposed downstream of said printing means disposed on said label conveyance passageway in the conveyance direction, and there are further provided detecting means for detecting the context printed on said label, using said sensor, judging means for judging whether said detected content accords with said print data, and control means for controlling the printing operation in accordance with said judging circuit.

Also, the present invention is a printer which performs the printing on a plurality of labels bonded in succession on a release paper, with said label as the printing medium, using printing means for printing print data fitted to the shape of said label, characterized by comprising detecting means for detecting the presence or absence of said label, conveying means for conveying the release paper having said labels bonded relative to the print position with said printing means, means for effecting printing of print data with said plurality of labels as one unit, and control means for effecting the printing with said printing means and the conveyance with said conveying means, upon detecting the label, in accordance with the detected result of the presence or absence with said detecting means, and effecting only the conveyance with said conveying means, upon not detecting the label.

Also, the present invention is characterized by comprising means for restarting the printing from the top label of said one unit when restarting after abnormal interruption during the printing of the printed matter to be printed with multiple pages as one unit.

Herein, in restarting after the abnormal interruption, the printing is performed by adding specific data to, or fixing the print color for the pages from the top page of said one unit to a page in reprinting corresponding to that where abnormal interruption occurs or a page before said page, or the pages other than a page in reprinting corresponding to that where said abnormal interruption occurs.

Also, the present invention is characterized by comprising means for developing said data exclusively into a print buffer in accordance with an exclusive command indicating that the variable magnification of data is impermissible, and means for developing said data excludable into the print buffer in accordance with an excludable command indicating that the variable magnification is permissible.

Further, the present invention is characterized by comprising classification means for classifying the received command into an exclusive command indicating that the variable magnification of data is impermissible and an excludable command indicating that the variable magnification of data is permissible, storage means for storing individual developed area values of said excludable command, altering means for altering the developed area values to be stored in said storage means when executing the development for said excludable command, and developing means for developing data in accordance with the developed area values to be stored in said storage means when executing the development for said excludable command.

Herein, said altering means can be altering means for altering only the upper and lower limit values of developed area values to be stored in said storage means when executing the development for said exclusive command.

Also, said developing means can be means for compressing and developing data in accordance with the comparison between regular developed area value for said excludable command and developed area value to be stored in said storage means.

According to the present invention, in the printer for printing a variety of kinds of labels, when the shape of label is changed, for example, when the label of circular, elliptic or lozenged shape is mounted on the printer, the printing can be effected only when it is fitted to the print format by making judgment within the printer.

Also, it is possible to provide a highly reliable printer capable of judging whether the context printed on the label accords with the information to be printed. Particularly, when the bar code is printed, it is possible to detect that the bar code is not printed for some cause, or the density is low.

Also, according to the present invention, in printing the data exceeding the length of used label over multiple labels, the regularity of data can be held by a combination of labels bonded without printing data on the mount between labels.

Similarly, in printing the printed matter formed of a group of multiple pages onto the continuous paper, the page designation method is simply made upon reprinting due to jam.

In addition, according to the present invention, there are provided storage means for classifying the received command into an exclusive command indicating that the variable magnification is impermissible and an excludable command indicating that it is permissible to some extent and storing individual developed area values for the excludable command, altering means for altering developed area values to be stored in said storage means when executing the development for said exclusive command, and developing means for developing data in accordance with developed area values to be stored in said storage means when executing the development for the excludable command, whereby for the data having some allowable variable magnification in the magnification or height such as the bar code data, the magnification or height of bar code data can be changed in accordance with the competitive condition with other print data to resolve troubles in designing the document or creating the print data.

Also, it is a further object of the present invention to provide a printer which allows for the designation of the printer or the recognition of changed position in the intrinsic information to be easily made without imposing burden on the operator by adding the information not interfering with the discrimination of the information (intrinsic information) to be subjected to the essential uses such as the display of product information in printing.

To this end, the present invention is characterized by comprising specific information adding means for adding specific information to be formed on the printing medium within the scope of not interfering with the discrimination of intrinsic information relating to the printer.

Herein, said specific information adding means can print said specific information in a quieter color than said intrinsic information, comprising a plurality of print heads corresponding to the printing agents having different color tones.

Also, said specific information may be information for designating the printer which has printed.

Further, in the present invention, there is provided means for printing said intrinsic information consecutively onto a group of labels bonded in succession on a release paper as the print medium, said specific information adding means changes and prints the context of intrinsic information printed previously or intrinsic information to be printed later on the label at said change position within the scope of not interfering with its discrimination, when the change of said intrinsic information occurs in the process of consecutive printing.

Herein, there are provided a plurality of printing heads corresponding to the printing agents having different color tones, said specific information adding means being able to change the context of said intrinsic information by varying the color tone of said information partly or totally.

With the above constitution, the specific information not interfering the discrimination of information (intrinsic information) to be subjected to the essential uses such as the display of product information is automatically added, and the designation of the printer or the recognition of changed position for the intrinsic information can be easily made without imposing burden on the operator.

The present invention aims at achieving the printing with high accuracy in printing the information with strict print accuracy required such as the bar code, as previously described.

To this end, the present invention is a printer which performs the printing on the printing medium using a print head in the form of ink jet head having a plurality of discharge ports arranged, characterized by comprising means for adjusting the distance of said print head to said printing medium in accordance with the line width of the information to be formed on said printing medium and/or the thickness of said printing medium.

Further, the present invention in another form is a printer which performs the printing on the printing medium using a print head having a plurality of recording elements arranged, characterized in that as the information to be formed on said printing medium has a higher reflectance portion and a lower reflectance portion mixed, there is provided means for reducing the quantity of driving energy to be applied to recording elements involving formation of both ends of said lower reflectance portion upon forming said portion.

Further, the present invention in a further form is a printer which performs the printing on the printing medium using a print head having a plurality of recording elements arranged, characterized in that as the information to be formed on said printing medium has a lower reflectance portion and a higher reflectance portion mixed, there is provided means for adjusting data so that a predetermined amount of said higher reflectance portion is further formed at the end of said higher reflectance portion upon forming said portion.

According to the present invention, as the head gap is adjusted in accordance with the line width of the bar code and/or the thickness of the printing medium, the effect of the offset can be reduced. Also, the expansion in the width of lower reflectance portion (black bar of the bar code) caused by the broadening of dot can be suppressed, and according to a further form of the present invention, the reduction in the width of higher reflectance bar (white bar) caused by the expansion of the width of black bar can be suppressed, so that the information can be correctly printed.

BRIEF DESCRIPTION OF THE DRAWINGS

FIGS. 42A to 42C are explanatory views showing the areas provided in a RAM for development control based on the data content.

FIGS. 45A and 45B are explanatory views for explaining the effects produced by the processes of FIGS. 43 and 44, respectively.

DETAILED DESCRIPTION OF THE PREFERRED EMBODIMENTS

The preferred embodiments of the present invention will be described below with reference to the drawings.

Figure 1:
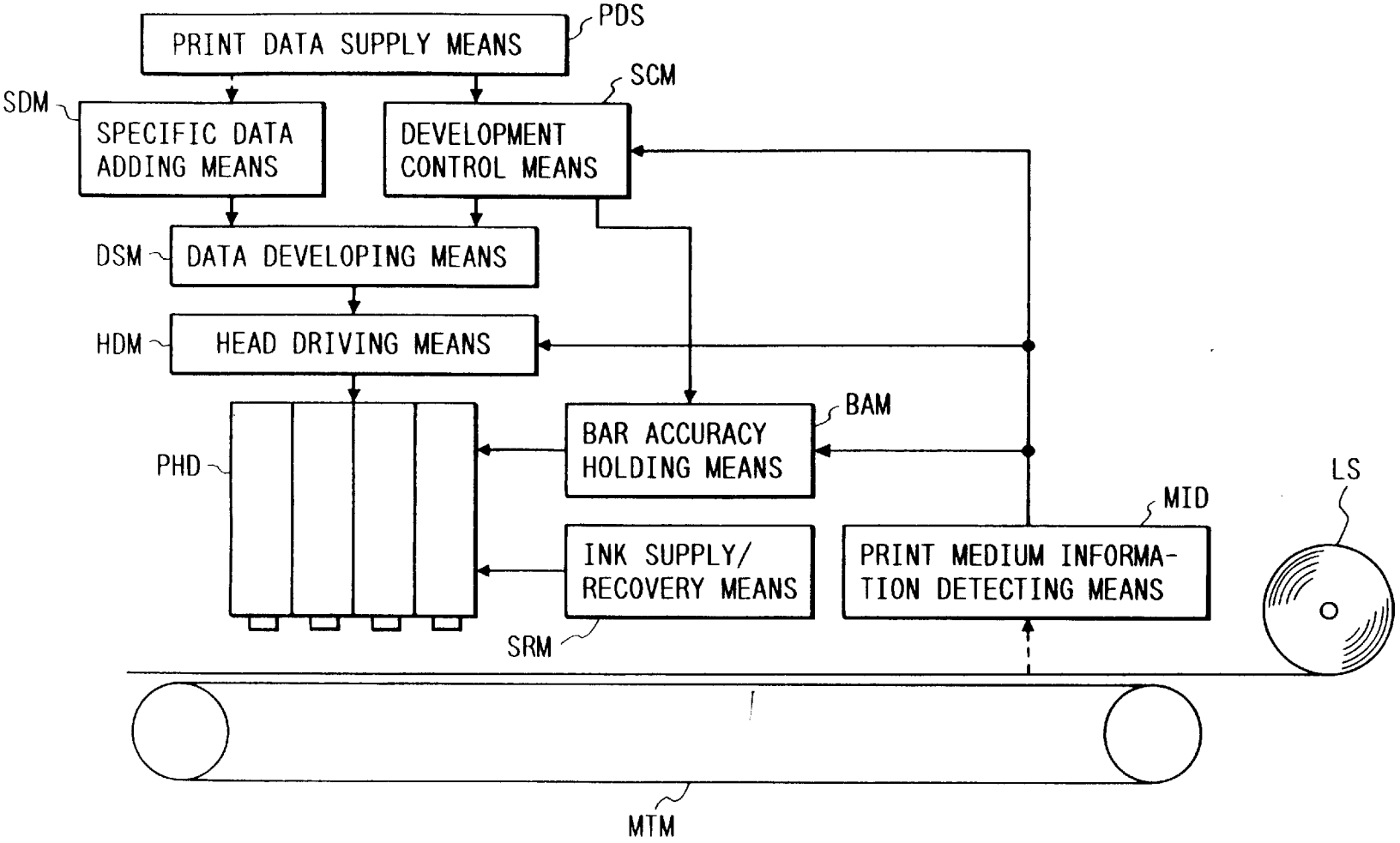
FIG. 1 is a block diagram showing an overall configurational example of a label printer according to one embodiment of the present invention.

(1) Overview (FIG. 1)

(2) Mechanical construction of apparatus (FIGS. 2 to 29)

- (2.1) Whole apparatus (FIGS. 2 to 9)
- (2.2) Head lifting mechanism (FIGS. 10 to 11B)
- (2.3) Ink system (FIGS. 12 to 18)
- (2.4) Head unit (FIGS. 19 and 20)
- (2.5) Recovery unit (FIGS. 21 to 23D)
- (2.6) Sensor system (FIGS. 24A to 29)

(3) Configuration of control system (FIGS. 30 to 41)

- (3.1) Overall configuration (FIG. 30)
- (3.2) Control panel (FIG. 31)
- (3.3) Head control system (FIGS. 32 to 35B)
- (3.4) Control procedure (FIGS. 36 to 41)

(4) Development control based on the data content (FIGS. 42A to 45B)

Figure 46:
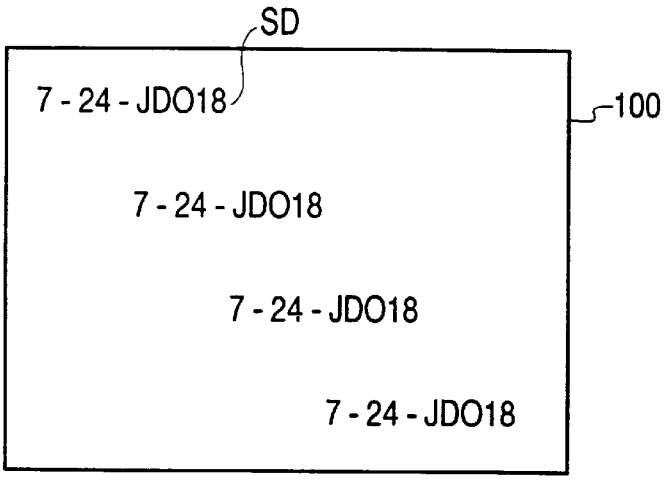
FIG. 46 is an explanatory view showing a format example of printer specific data.
Figure 47:
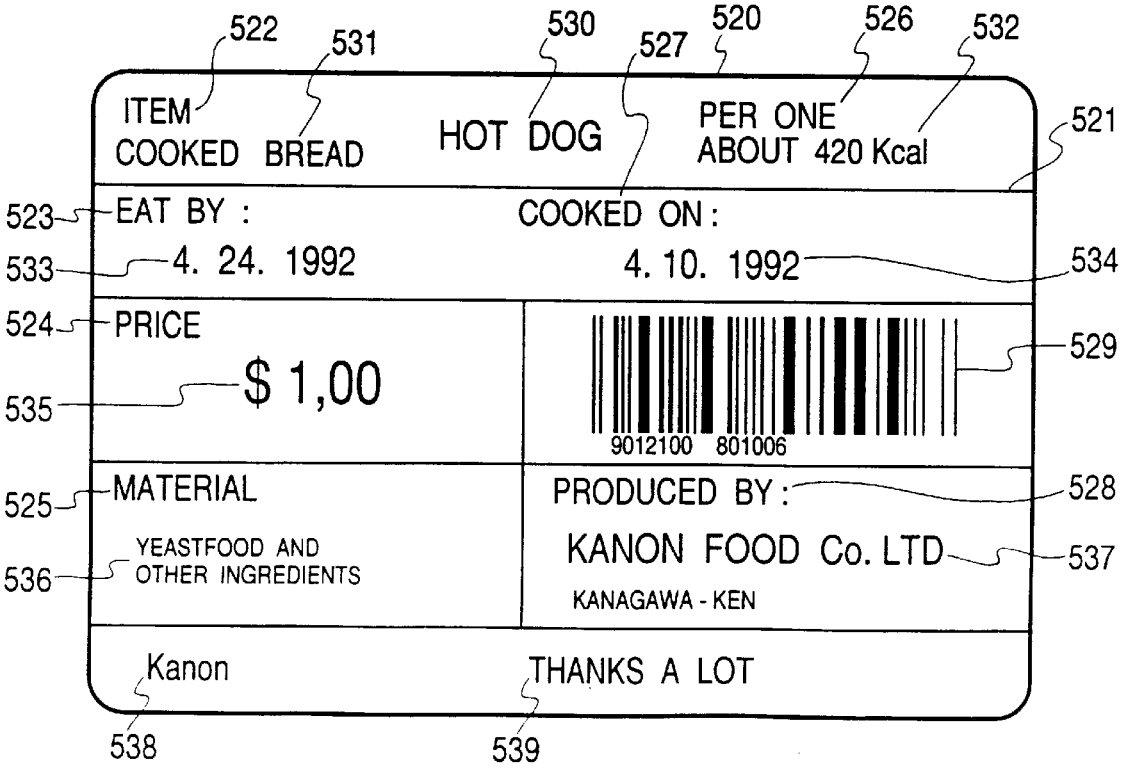
FIG. 47 is an explanatory view showing an example of the print context onto a label.
Figure 48:
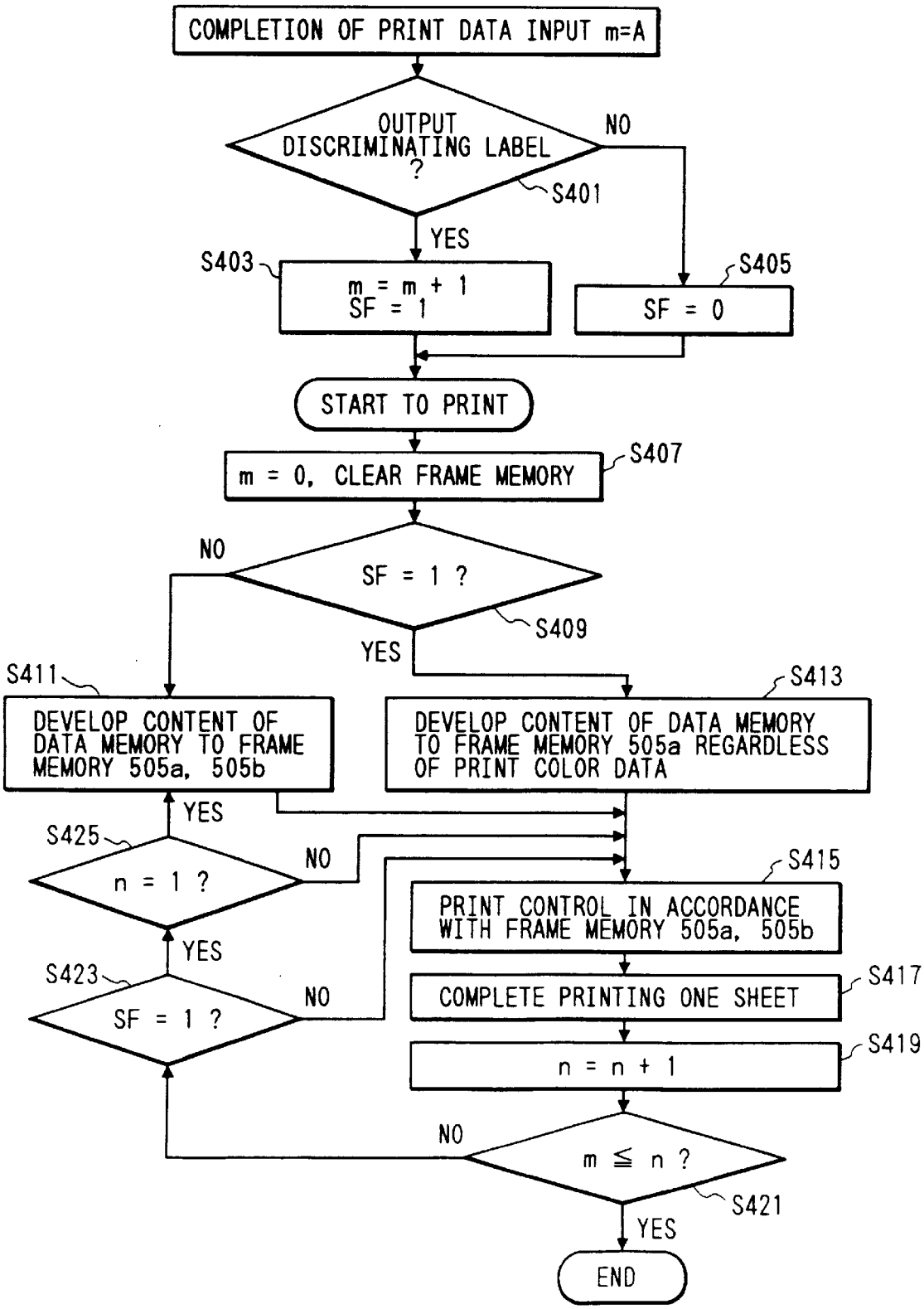
FIG. 48 is a flowchart showing an example of a label specific print control procedure.

(5) Addition of special data (FIGS. 46 to 48)

- (5.1) Addition of printer specific data (FIG. 46)
- (5.2) Data change for label group specification (FIGS. 47 and 48)

(6.) Label judgment (FIGS. 49 to 52)

(7) Printing of data over a plurality of labels (FIGS. 53 to 58C)

Figure 59:
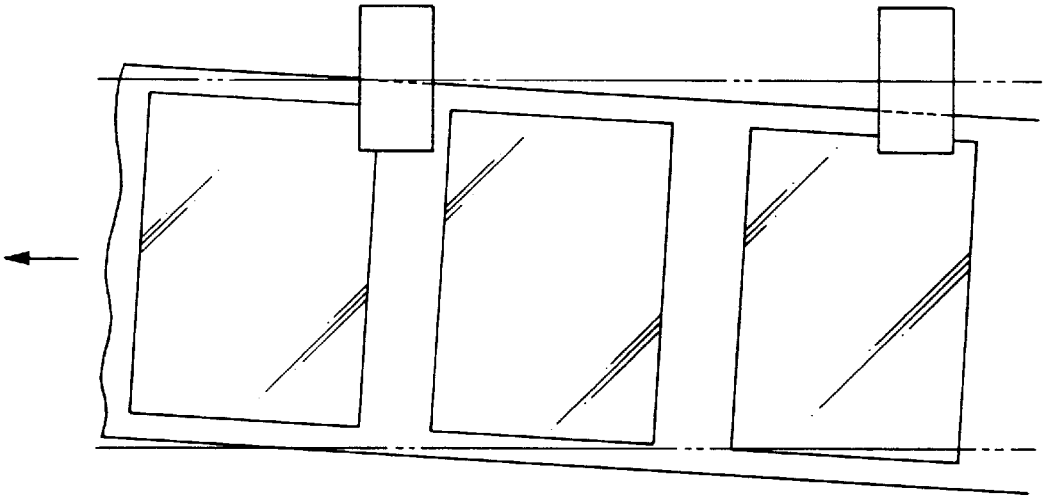
FIG. 59 is an explanatory view showing the obliquely conveying state of the label sheet.
Figure 60A:
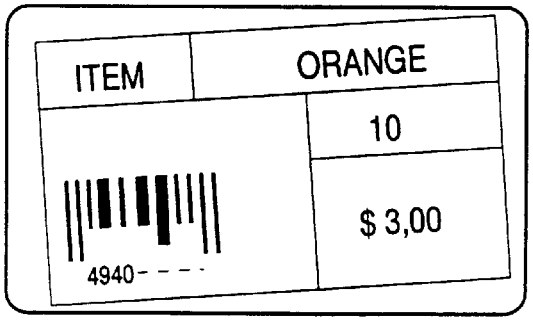
FIGS. 60A and 60B are explanatory views showing the printing conditions when conveying obliquely and conveying deviated from the normal position, respectively.
Figure 60B:
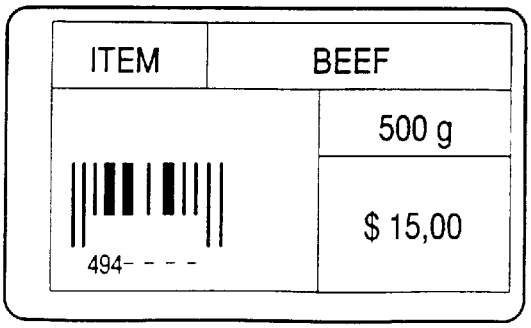
Figure 61:
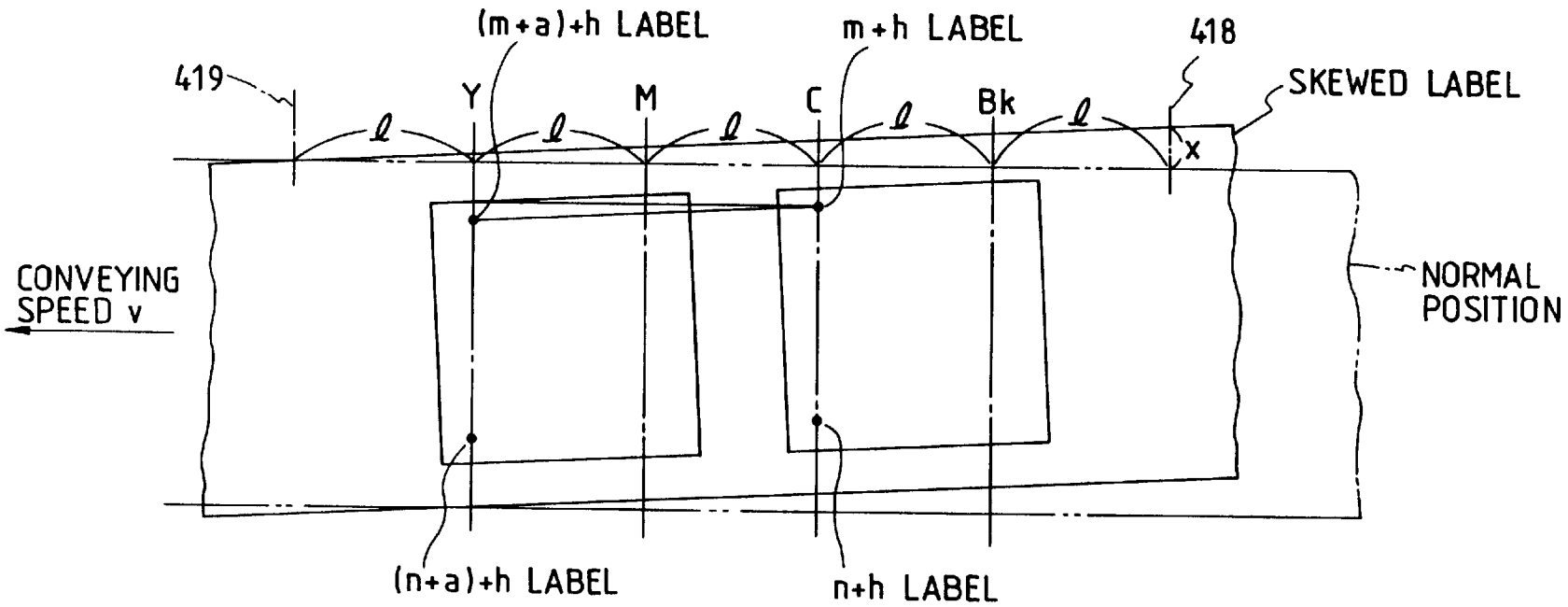
FIG. 61 is an explanatory view for explaining the control for printing correctly the label obliquely conveyed.

(8) Print control corresponding to label attitude (FIGS. 59 to 61)

(9) Shift print (FIGS. 62 to 65)

(10) Bar accuracy holding (FIGS. 66 to 71)

Figure 70:
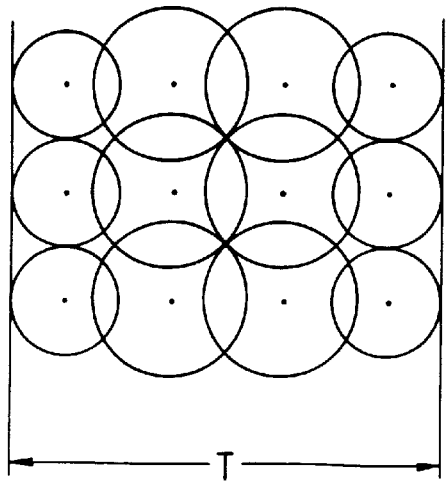
FIG. 70 is an explanatory view for retaining the bar accuracy with the control of discharge amount.
Figure 71:
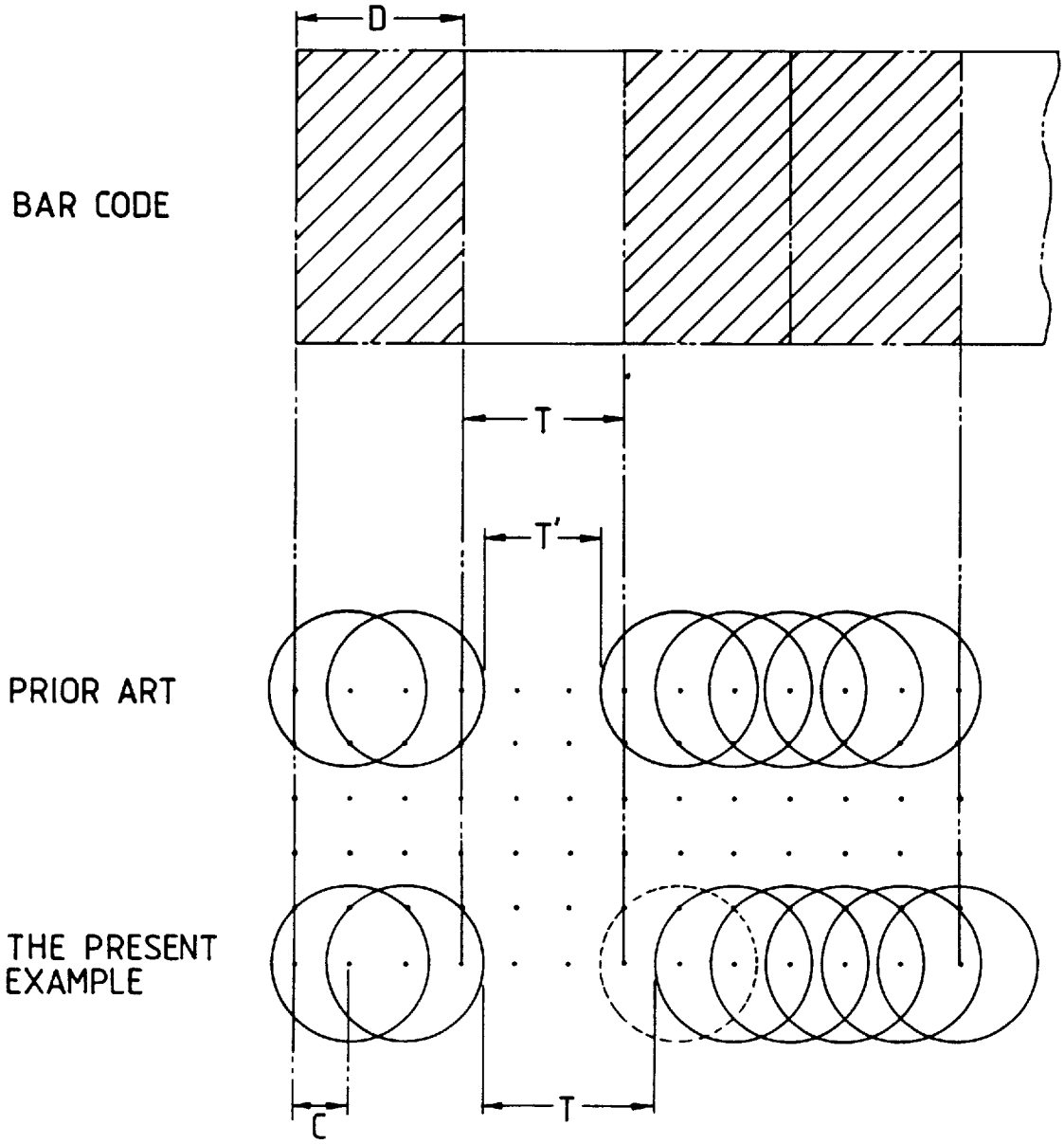
FIG. 71 is an explanatory view for retaining the bar accuracy with the control of white data addition.

- (10.1) Bar accuracy holding with head lifting (FIGS. 66 and 67C)
- (10.2) Bar accuracy holding with discharge amount control (FIGS. 68 to 70)
- (10.3) Bar accuracy holding with data addition (FIG. 71)

(11) Others

It should be noted that the terms "recording", "printing" and "print" are commonly used in the present invention, but widely referred to attaching the recording agent on the recording medium.

In the following embodiment, the recording medium takes the form of a roll paper having labels arranged in succession on a release paper, but the form, kind and material may be arbitrary. For example, the cut sheet may be used as the recording medium, and the material of the recording medium may be a film, a cloth or the like.

Further, the present invention is described with a label printer to which the invention is applied, but it will be appreciated that the printer of the present invention may used in various forms of those using the printing medium, such as the continuous paper with scored cutting line or the business card, or the card, or in the form of ticketing machine.

(1) Overview

FIG. 1 is a view for explaining the overview of an apparatus according to this embodiment, in which this embodiment involves an apparatus for printing predetermined information such as the bar code (hereinafter referred to as a label printer) on the label sheet LS.

In the figure, PDS is print data supply means which is a supply source of data to be printed, and can take any of various forms of an information processing apparatus such as a host computer, and a data storage device such as a magnetic disk or a memory card, etc.

SCM is development control means for developing print data to be supplied from the print data supply means PDS suitably aligned on data development means DSM in accordance with the form of a print head PHD or the form of printing operation, and further in accordance with the shape of label sheet LS which is detected by print medium information detecting means MID or the layout of print data, and will be detailed later in FIGS. 42A to 45B.

SDM is specific data adding means which adds specific information other than intrinsic data to be printed on the label sheet, for example, apparatus identifying data indicating the apparatus which prints the label, or context identifying data indicating at a glance the changed label when the print context is changed in the group of labels to be printed successively, for the development on data developing means DSM. Data addition may be in the form of generating data other than intrinsic print data, or processing a part or a whole of intrinsic print data, and in either case, the content of intrinsic print data must not be impaired. This specific data addition means will be described later in FIGS. 46 to 48.

HDM is head driving means for driving a group of recording elements for a print head PHD in accordance with print data developed in data developing means DSM. Also, in driving them, the recording elements to be used are appropriately shifted upon printing, to reduce the distribution in the use frequency of the recording elements, or to obtain the desirable print condition irrespective of the attitude of label sheet which print medium information detecting means MID detects. This head driving means will be described later in FIGS. 61 to 65.

BAM is bar accuracy holding means for effecting the control to secure the accuracy of bar code to be formed on the label sheet in accordance with print data. This bar accuracy holding means BAM will be described later in FIGS. 10 to 11B and FIGS. 66 to 71.

The print head PHD employs the ink as the recording agent in this embodiment, and is an ink jet head having, as recording elements, heat generating elements for applying the heat energy causing film boiling in the ink as the energy useful to discharge the ink, that is, a print head of the bubble jet system as proposed by Canon Inc. Also, a plurality of (e.g., four stages) print heads PHD are provided corresponding to the inks having different color tones, and replaceable to correspond to the color desired for printing. The replacement and arrangement of this print head PHD will be described later in FIGS. 19 and 20.

SRM is ink supply/recovery means for circulating and withdrawing the ink in supplying the ink to the print head PHD, or a process (recovery process) for maintaining the ink discharge property, and will be described later in FIGS. 12 to 18, and FIGS. 21 to 23D.

Print medium information detecting means MID is composed of various kinds of sensor groups to be used for the detection of the end of label sheet, the detection of abnormal conveyance, or the detection of the shape of label sheet. Also, MTM is conveying means for conveying the label sheet LS with respect to the recording position with the print head PHD.

(2) Mechanical construction of apparatus (2.1) Whole apparatus

Figure 2:
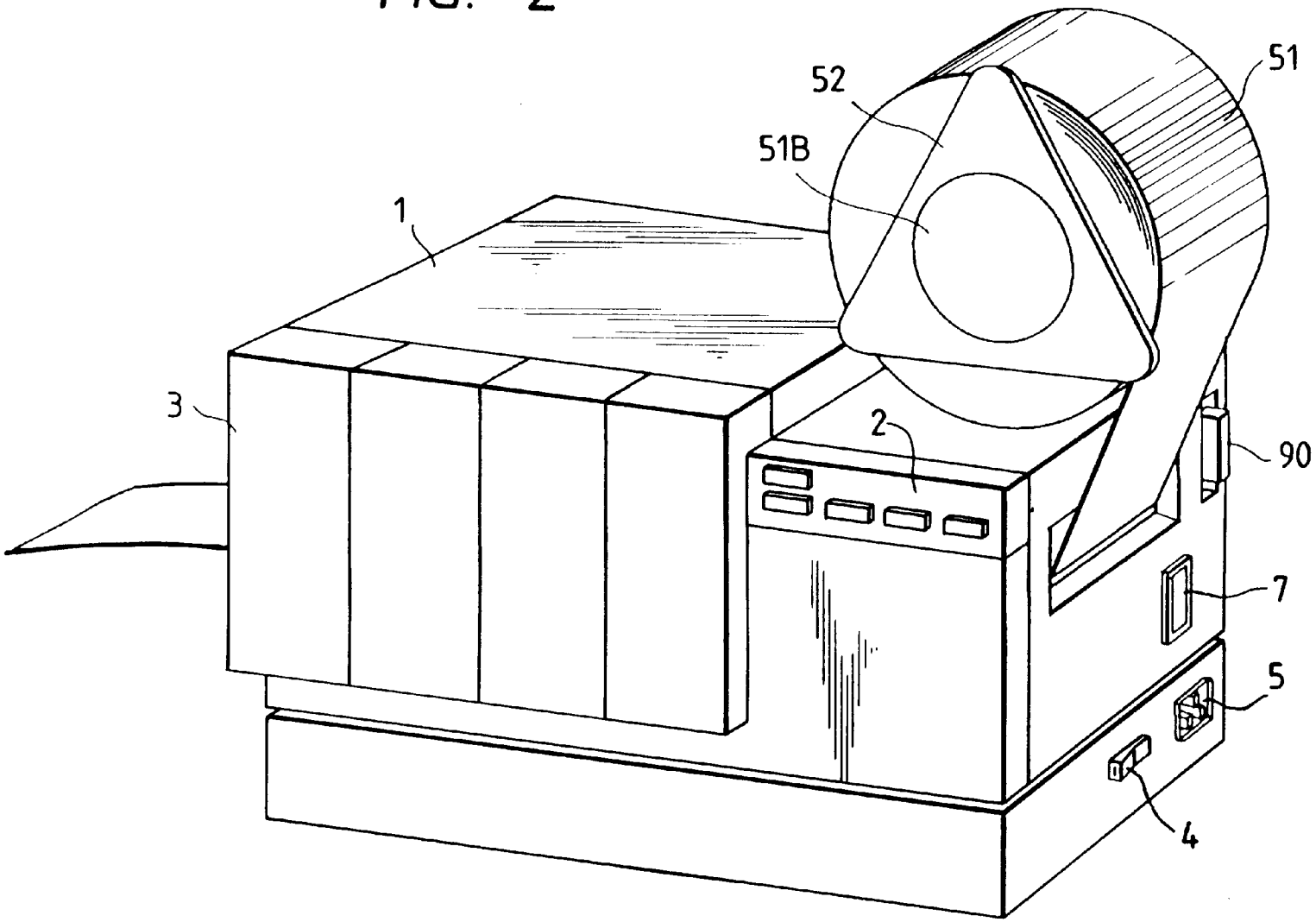
FIG. 2 is an external perspective view of the label printer according to the embodiment.
Figure 3:
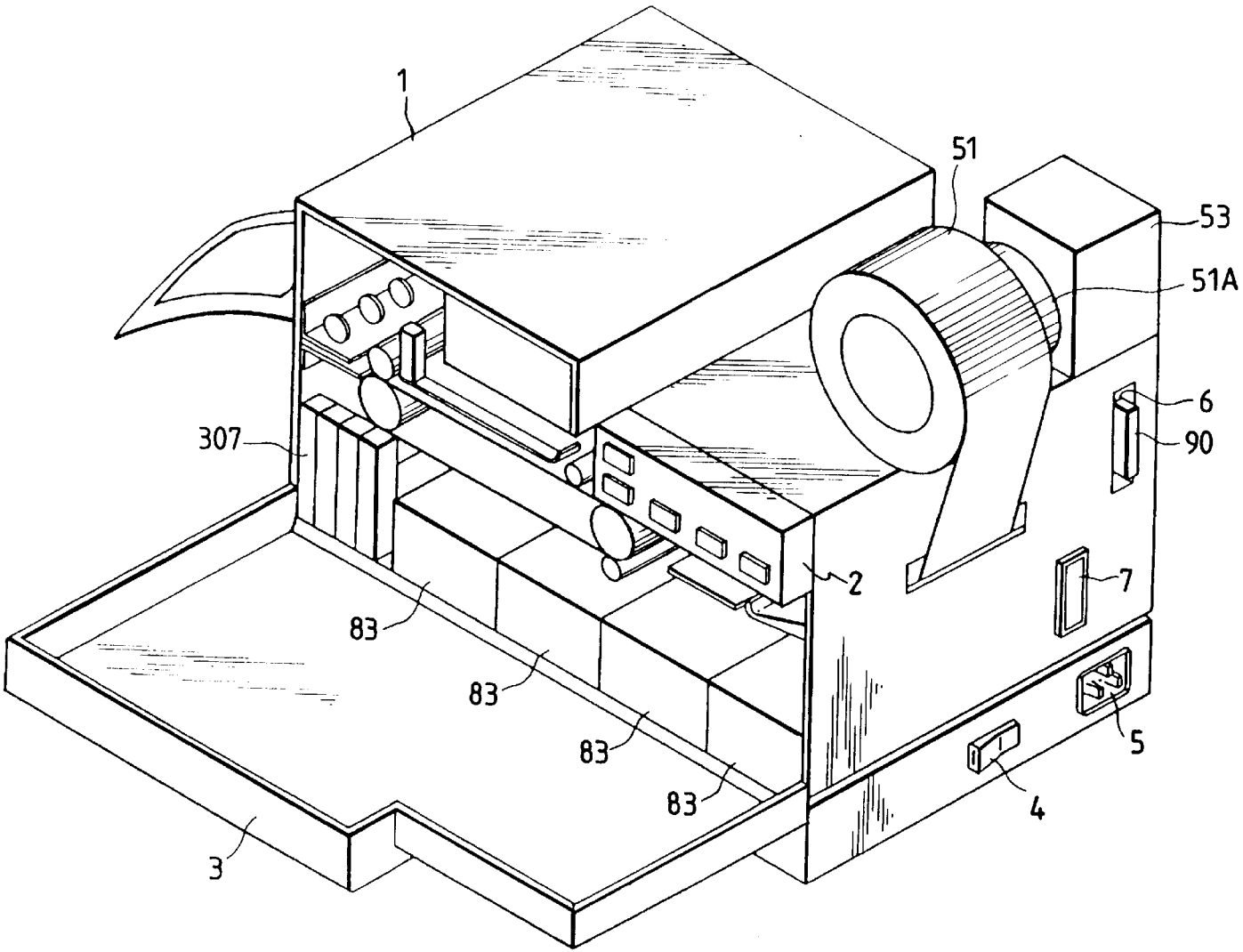
FIG. 3 is an external perspective view showing the state in which a lid portion of the label printer according to the embodiment is opened.

FIG. 2 is an external perspective view of a label printer in this embodiment, and FIG. 3 is an external perspective view showing the state where its lid portion is opened.

Herein, 1 is an apparatus main body, 51 is a roll of label sheet wound like a roll, 51A is a roll support shaft, 52 is a roll guide for delivering the label sheet obliquely while regulating it in a width direction at the roll end face and preventing the falling of the roll 51 off the support shaft 51A, and 53 is a strut of the support shaft 51A. 2 is an operation panel having various switches and a display lamp, which is described later in FIG. 9. 3 is a lid portion of the apparatus, wherein by opening this as shown in FIG. 3, desired operations such as the replacement of the ink supply unit or the removal of jamming in the conveyance system are enabled. Also, 4 is a main power switch, 5 is a connector for connecting a power supply cord, 6 is a slot for attaching a memory card 90 thereinto, and 7 is a connector of interface cable for connecting the label printer to a host computer.

Figure 4:
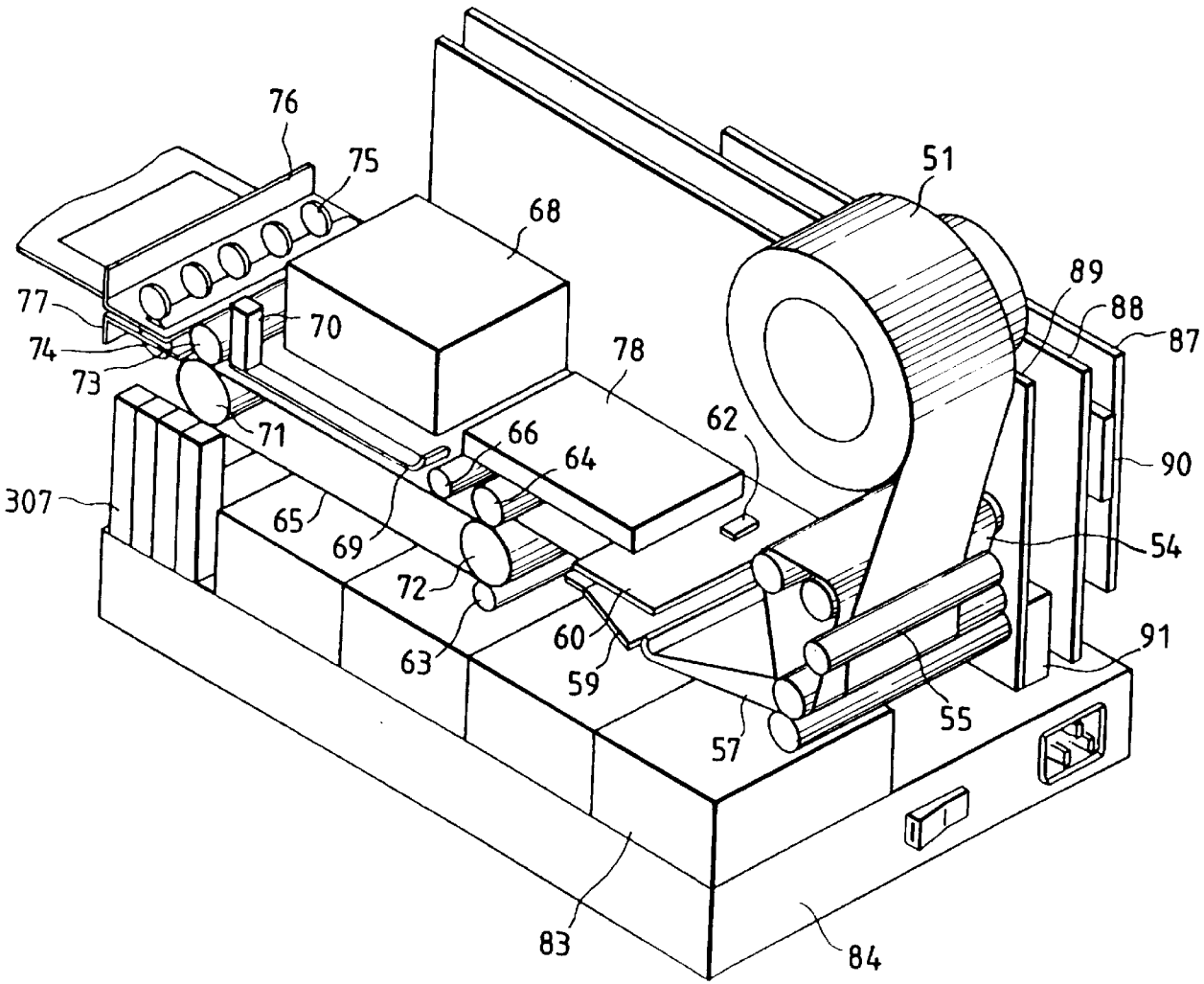
FIG. 4 is an external perspective view showing the state in which an outer packaging cover of an apparatus according to the embodiment is removed.
Figure 5:
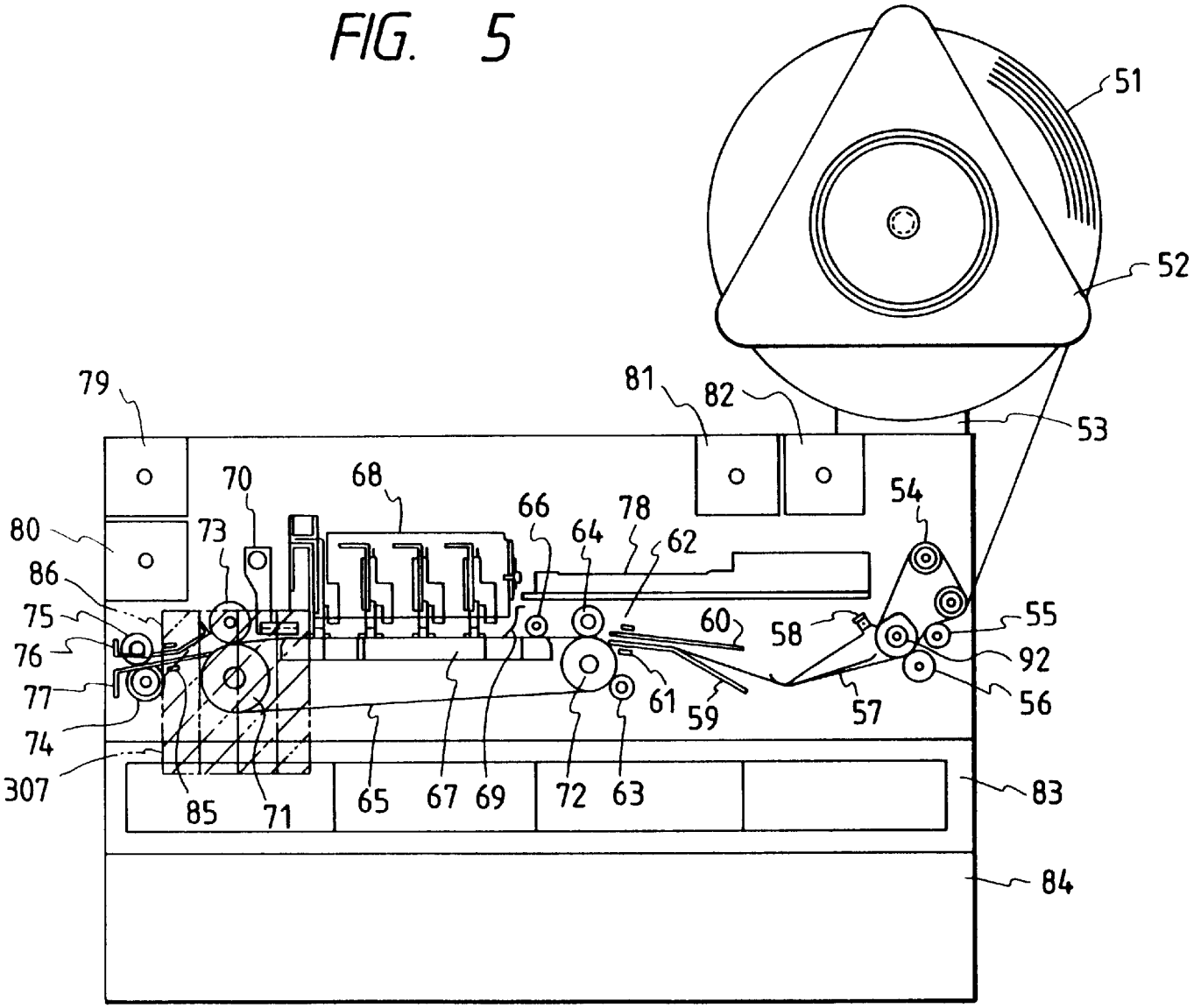
FIG. 5 is a front view showing the internal construction of the apparatus according to the embodiment.
Figure 6:
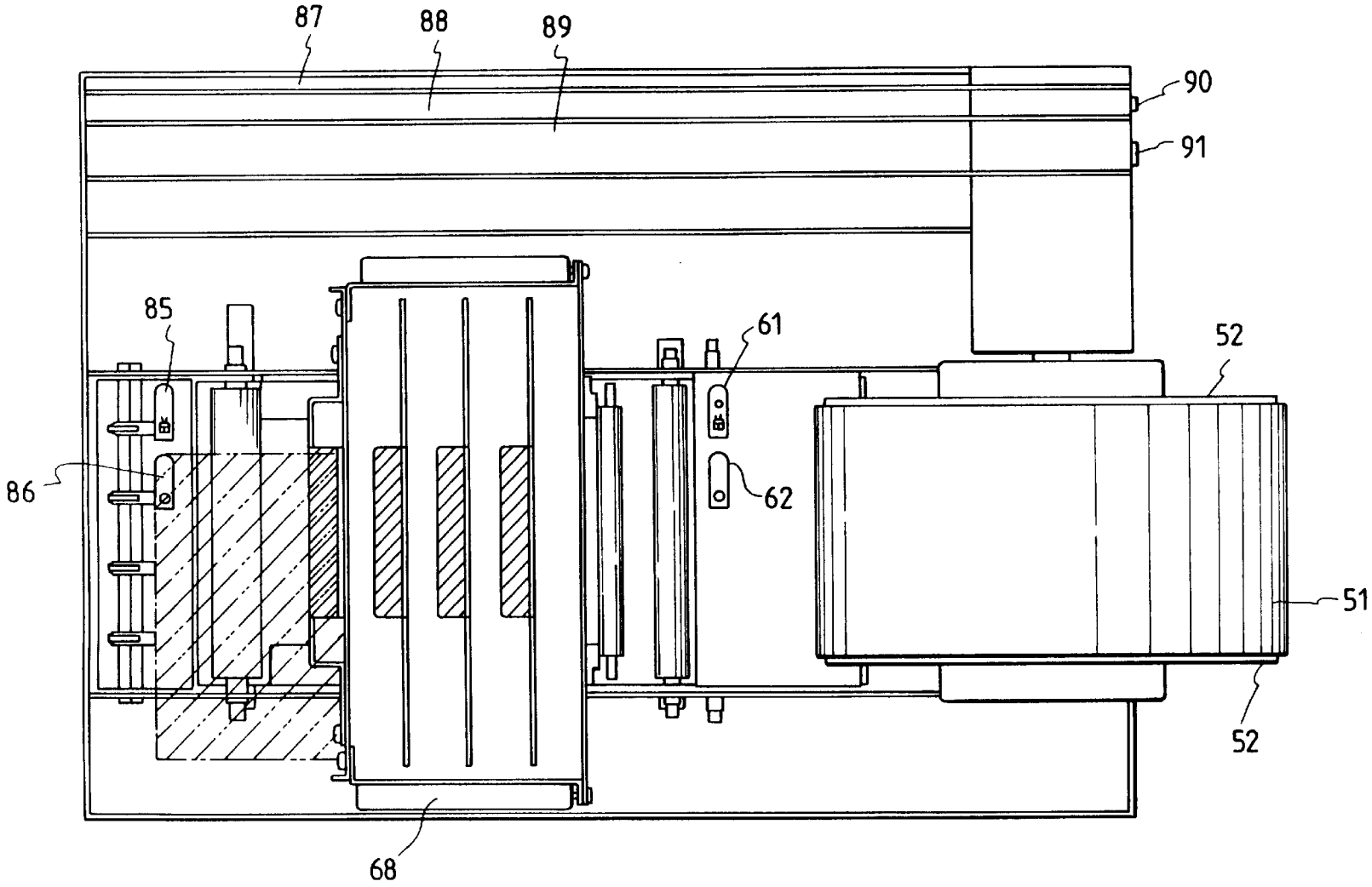
FIG. 6 is a plan view showing the internal construction of the apparatus according to the embodiment.

FIG. 4 is an external perspective view showing the state in which an outer packaging cover of FIG. 2 is removed, FIG. 5 is a front view showing the internal construction of the apparatus of this. embodiment, and FIG. 6 is a plan view of the same apparatus.

In these figures, 54 is a curl correction unit for correcting the winding tendency (curl) of the paper roll 51, cooperating with a curl correction roller 55 to correct the curl by giving a reverse curl to the label sheet (hereinafter simply referred to as the sheet). 92 is a loop roller for making the control to give an adequate flexure (loop) to the sheet, 56 is a pinch roller for the loop roller 92, 57 is a loop plate which is displaced with the loop amount for giving an adequate loop to the sheet, 59 is a lower guide plate of the sheet, and 60 is an upper guide plate of the sheet.

61 is a TOF (Top of Form) sensor which is a reflection type sensor for detecting the position of the sheet, 62 is also a TOF sensor which is a transmission type sensor for detecting the position of the sheet, 63 is an electrifying roller for electrifying the belt to adsorb the label sheet, 64 is a static eliminating roller for eliminating the potential on the surface of the sheet, 65 is an electrifying belt for adsorbing and conveying the sheet by being electrified owing to the potential given by the electrifying roller 63, 66 is a paper pressing roller for pressing the sheet adsorbed and conveyed by the electrifying belt 65 securely against the electrifying belt 65, and 67 is a platen for stabilizing the flatness of the sheet in printing. Herein, the belt 65 is composed of an NBR layer disposed inside the belt and a silicone insulating layer provided outside and facing the sheet, prior to adsorption of the sheet, minus electric charges being applied to the silicone insulating layer by the electrifying roller 63 which is first electrifying means, and plus electric charges being applied to the neighborhood of contact point between the sheet and the belt 65 by the static eliminating roller 64 which is second electrifying means provided with the sheet carried between it and the belt 65.

68 is a head block having disposed print heads (hereinafter referred to by the symbols of 301Bk, 301Y, 301M and 301C) for printing predetermined information on the sheet conveyed thereto, 69 is a paper pressing plate for preventing the floating of the sheet with both end portions of the sheet conveyed pressed, 70 is a movement block for moving the paper pressing plate 69 in accordance with the paper width of the sheet, 71 is a main roller for driving the electrifying belt 65 for the sheet conveyance, 72 is a driven roller which is driven via the electrifying belt 65 by the driving of the main roller 71, 73 is a pinch roller of the main roller 71, 74 is a sheet exhausting roller for exhausting the printed sheet out of the apparatus, 75 is a sheet exhausting roller which is a pinch roller for the sheet exhausting roller 74, and 76, 77 are guides for the sheet to be exhausted.

78 is a recovery unit for cleaning the thickened ink residing inwardly of discharge ports of each print head, or the ink adhering to the discharge port formation face, 79 is a head movement motor for moving and setting the head block 68 to an appropriate position in recording or recovery operation, 80 is a sheet conveyance motor for supplying a driving force to the main roller 71 for the sheet conveyance, and 81 is a recovery unit movement motor for moving the recovery unit 78 to a position opposed to the discharge face of the head block 68. 82 is a loop motor for detecting the displacement of the loop plate 57 by means of the loop sensor 58 to secure an adequate loop amount and controlling the speed of the loop roller 92 based on its value.

83 is an ink supply unit for supplying the ink to each head of the head block 68, 84 is a power source for supplying the electric power to this apparatus, 85 is a TOF sensor of reflection type for detecting whether or not the conveyance of the sheet is normally performed, 86 is similarly a TOF sensor of transmission type, 87 is a sub-substrate having disposed thereon switches for effecting partial operation or adjustment of this apparatus, 88 is a main substrate having a controller of this apparatus disposed, and 89 is a terminal substrate for connecting various types of actuators to the main substrate 88.

The sheet roller used in the label printer of this embodiment will be described below.

Figure 7:
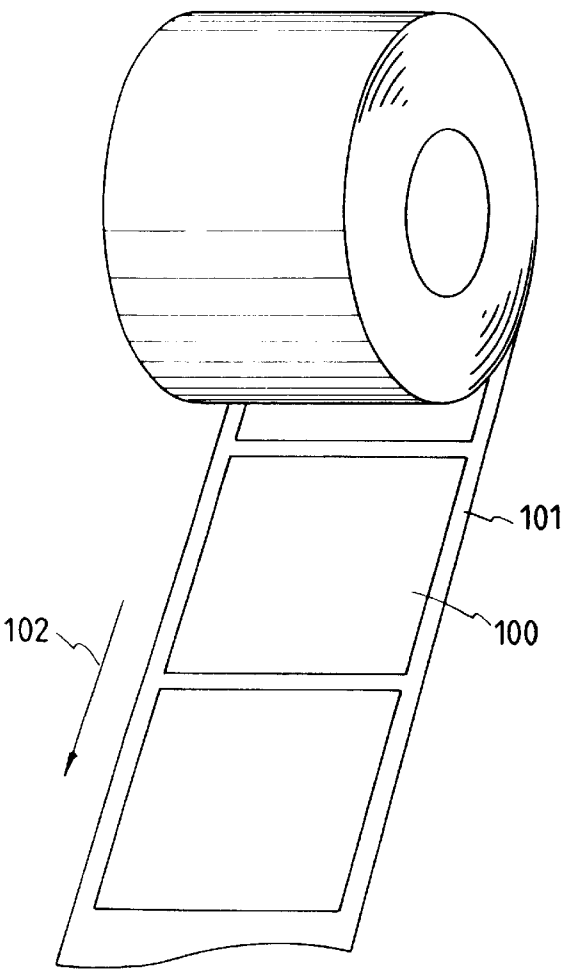
FIG. 7 is a perspective view showing a configurational example of the paper to be subjected to the recording.

FIG. 7 is an explanatory view of the sheet roll 51. Herein, 100 is a recording medium for this printer, which is normally called the label. Although various sizes may be used depending on the uses, the label is 4 inches wide at maximum in the printer of this embodiment, corresponding to a discharge port array range of each head. Labels 100 are bonded in succession on a mount called as a release paper or a separator indicated by numeral 101 by tack adhesive, not shown, to constitute the recording sheet 51 like a roll. Note that the arrow 102 points to the sheet conveying direction in printing.

Figure 8:
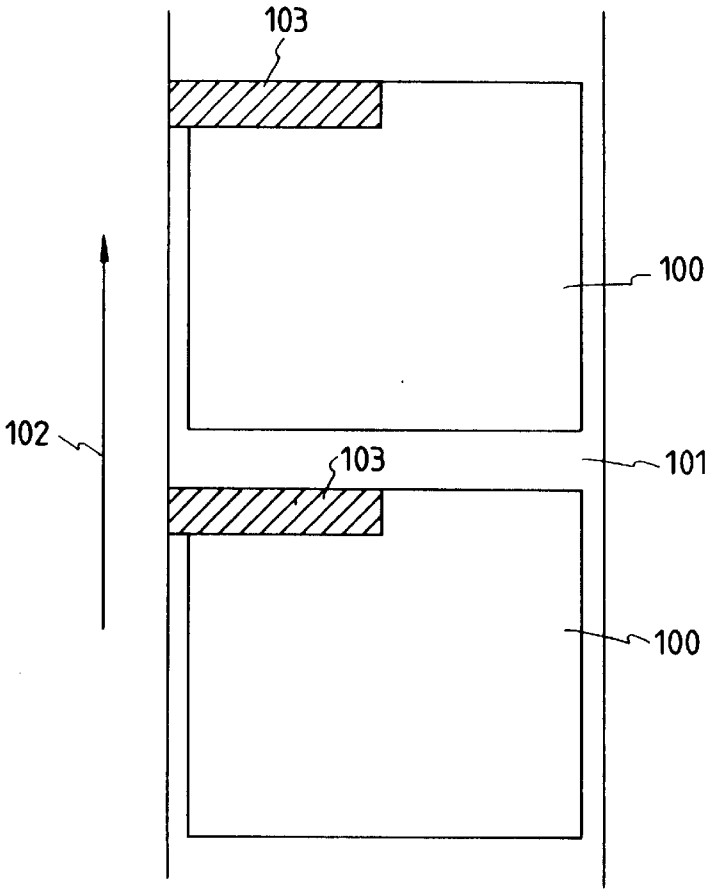
FIG. 8 is an explanatory view of TOF mark on the paper.

Also, in the label printer of this embodiment, the leading end of the label is detected as the trigger to start the print, and for this purpose, a TOF (Top of Form) mark 103 as shown in FIG. 8 is printed on the opposite side to the bonded face of label 100 on the separator 101.

That is, a leading edge signal for the sheet can be obtained by the TOF sensor detecting this TOF mark 103. Also, the size of label can be detected from the interval between TOF marks by making constant the clearance between labels on the separator 101, and further the printable range can be detected.

Note that the TOF mark can be detected by the TOF sensor 61 of reflection type in this embodiment, or a separator having high light transmission is used and the TOF sensor 62 which is a transmission type sensor is used to detect the print start-position, or the size of label.

Figure 9:
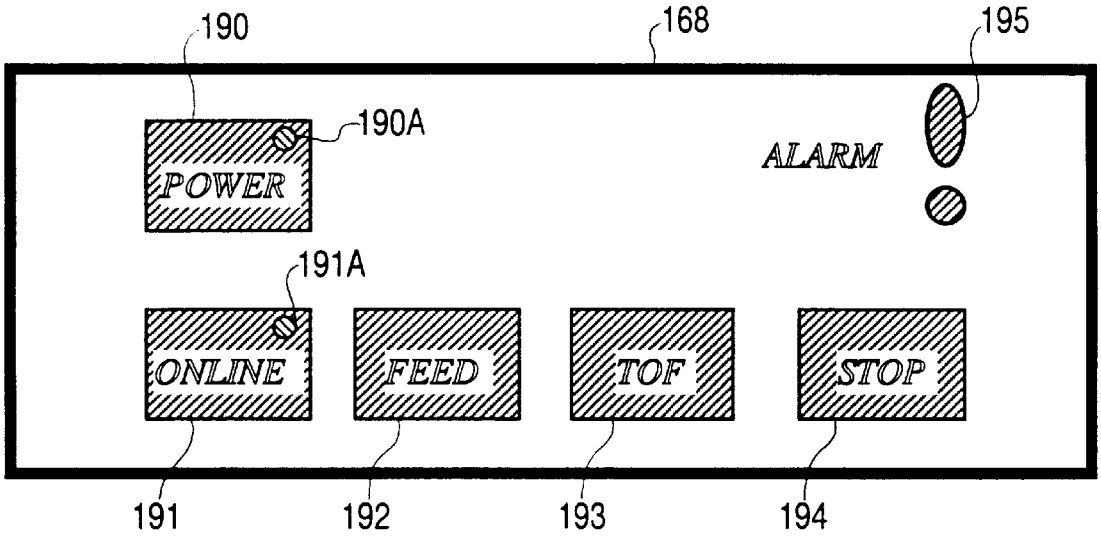
FIG. 9 is a front view showing a configurational view of an operation panel on the apparatus according to the embodiment.

FIG. 9 shows a configurational example of an operation panel 2. The operation panel of this embodiment has a power on/off switch 190, an on-line switch 191 to the host computer, a sheet feed switch 192 which is manipulated in feeding the sheet in the manual mode, a switch 193 for the alignment of the sheet at the leading end, a switch 194 for the compulsory stop of the print, and a lamp 195 for informing the operator of abnormal condition which may possibly occur, as shown in the same figure. Note that 190A and 191A are lamps which are lighted during the power on and during the on-line, respectively.

In this embodiment, the movable portion (operable by moving such as a head block having heads or a recovery system unit) and the fixed portion (including an ink supply unit and a power supply) are provided separately in the upper and lower portions, between which the sheet is conveyed. That is, the movable portion in which the apparatus construction is complex and the fixed portion comprising the ink tank requiring the replacement and the power supply unit having relatively great weight are separately provided, and can be an effective construction because of the following reason.

That is, the label which has been printed is exhausted with the printed face directed upward, without reversing the sheet by directing the head downward, but the user can more easily confirm the printed label. Also, because it has been found that more excellent results can be obtained by discharging downward in the ink jet system, the above construction is preferable.

Also, by disposing the supply system beneath the head, an appropriate negative pressure can be obtained in supplying the ink. If the supply system is disposed above the head, liquid pressure will be applied to the ink supply side (head side) by its weight, causing ink leakage from the discharge port face of the head, and if this leakage is attempted to avoid, a mechanism for applying a predetermined pressure (negative pressure) must be provided, resulting in more complex structure of the supply system, with increased cost.

Further, where the ink supply system is above the head, the ink will overflow, contaminating the inside of the apparatus including the conveyance system or the sheet, if there occurs a failure of an ink remaining sensor, a failure of a pump for circulating the ink, or a tube defect, and the above construction is effective from the above respect.

Also, in this embodiment, the circuit substrate has the conveyance system and the supply system separately arranged on the back surface thereof. This is a preferable construction for preventing the radiation effect and the contamination with the ink.

(2.2) Head lifting mechanism

A head lifting mechanism for adjusting the gap (head gap) between the discharge face and the sheet by moving the head block 68 in accordance with the information to be formed in printing, e.g., the line width of bar code, and moving the head block 68 in the recovery operation with the recovery unit 78 will be described below.

Figure 10:
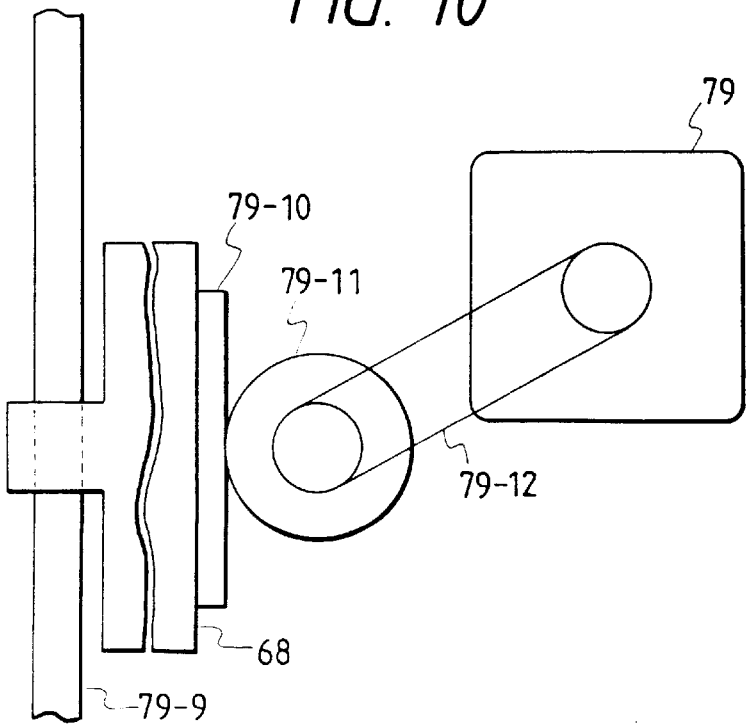
FIG. 10 is a typical view showing a constructional example of a head lifting mechanism within the apparatus according to the embodiment.

FIG. 10 is a typical view of the mechanism. Herein, 79-9 is a guide rod along which the head block 68 moves, 79-10 is a rack attached to the head block 68, 79-11 is a gear mating with the rack 9 to move the head block 68, this gear being connected via a belt-like transmission mechanism 79-12 to a head moving motor 79. It will be understood that the construction of the head lifting mechanism, i.e., a driving source, a transmission mechanism, and others, is not limited to those as shown.

With such construction, in printing or the discharge recovery operation, a controller disposed on the main substrate 88 (FIG. 6) drives the motor 79 to rotate the gear 79-11, moving the head block 68 via the rack 79-10 while guiding it along the guide 79-9. Regarding the movement amount of the head block 68 in printing, the controller determines an appropriate amount in accordance with the content of an instruction for the line width for printing. Also, in the discharge recovery operation and after completion of printing, the head block 76 is retracted to an up position, directly under which position the recovery unit 78 is positioned for effecting recovery processing such as ink suction, predischarge, wiping, and capping.

Note that the head lifting mechanism can be used to lift the head block 68 corresponding to the line width to hold the head gap at an appropriate value, or to determine the head gap appropriately corresponding to the thick paper such as cardboard or tag paper, and to avoid the collision between the shift and the head. To detect the paper thickness, the sheet with the TOF mark at a predetermined site is used in accordance with the paper thickness, while a plurality of TOF sensors are placed at sites where TOF mark will reside on the apparatus side, and judged for the on/off state. Also, this information may be received from the host computer, or the operation panel may be provided with a switch for setting the paper thickness. Further, means for judging the paper thickness of set sheet may be provided.

Figure 11A:
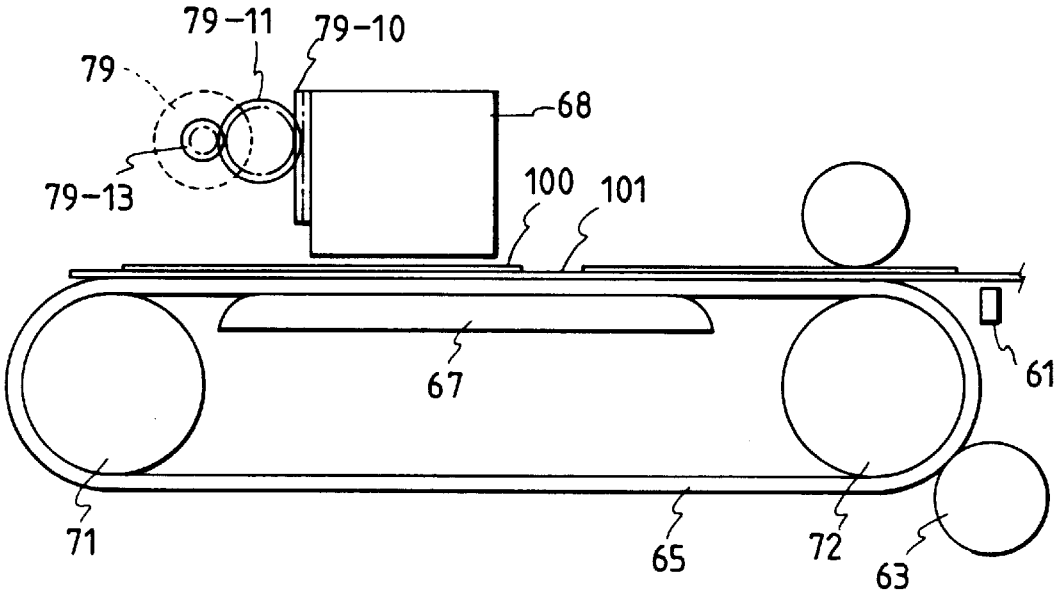
FIGS. 11A and 11B are typical views showing other constructional examples of head lifting mechanism within the apparatus according to the embodiment.
Figure 11B:
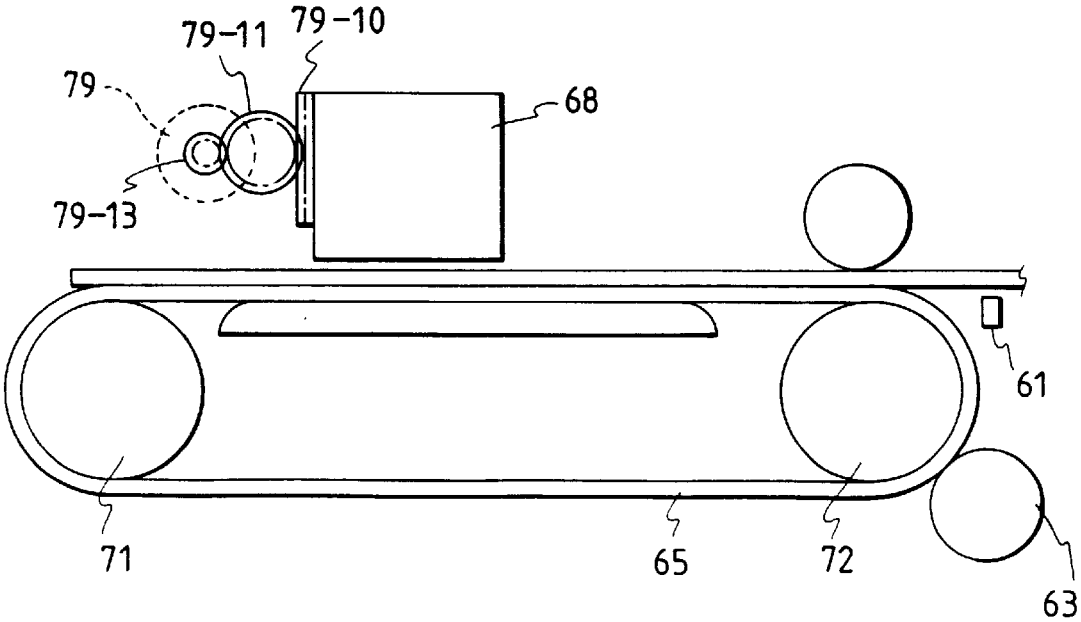

In either case of using a relatively thin label sheet as shown in FIG. 11A or using a thick tag sheet S1' as shown in FIG. 11B, the head block can be positioned at a proper position. Note that a gear 79-13 attached to the shaft of motor 79 is used as the transmission mechanism for lifting the head block in FIGS. 11A and 11B.

(2.3) Ink system

Figure 12:
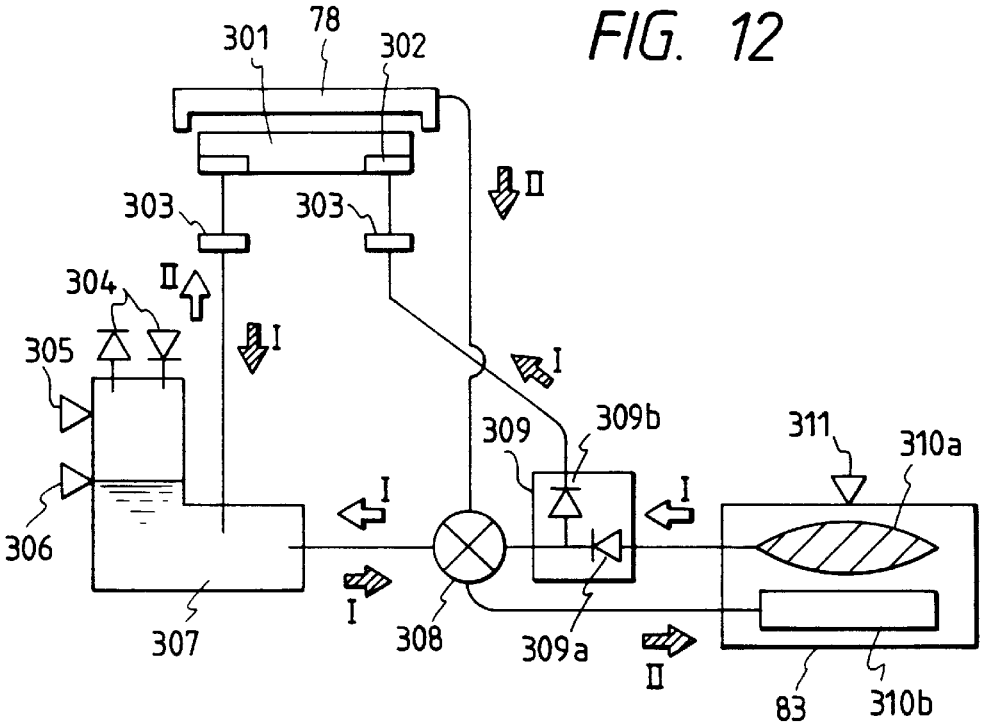
FIG. 12 is a typical view showing a constructional example of an ink system of the apparatus according to the embodiment.

FIG. 12 is a block diagram showing the whole of an ink supply system in the apparatus according to the embodiment, which will be described in accordance with the flow of ink. The ink is sucked from an ink bag 310*a* contained within an ink supply unit 83 in the form of ink cartridge, due to suction of a pump 308, and stored via one-way valve 309*a* within a valve 309 within a sub-tank 307. This is shown by the white arrow I in the figure. On the other hand, in the normal printing, the used amount of ink is supplied from the sub-tank 307 to the head 301. This is shown by the white arrow II in the figure.

Also, when the use frequency of the discharge port is dispersed due to repeated prints of the same pattern, or the head is left unused, the ink within the discharge ports of the head 301 is thickened, or bubbles are produced and collected within the head 301 or the tube, causing a trouble in printing. In such a case, the head 301 is required to undergo recovery operation, the flow of the ink being indicated by the black arrows I and II in the figure.

First, the reflux of the ink to the head 301 is Indicated by the black arrow I, by the pump 308 being rotated in opposite direction to that when supplying the ink to the sub-tank 307, the ink is circulated from the sub-tank 307 via one-way valve 309*b* within the valve 309 to the head 301 to return to the sub-tank 307. Then, the thickened ink near the discharge ports of the head 301 is discharged from the discharge ports, and bubbles within the flow passages are also discharged out of the nozzles, or withdrawn within the sub-tank 307.

Next, the black arrow II indicates the path of withdrawing the ink discharged from the head discharge ports into the recovery system unit 78. The pump 308 reflows the ink to the head 301, while at the same time having the capability of activating this ink withdraw system. And since the ink discharged within the recovery system unit 78 is withdrawn into a waste ink absorbing member 310*b* within the ink supply unit 83 by the pump 308, a new absorbing member is placed when the ink supply unit 83 is replaced.

The above description covers the whole of the ink supply system, a cartridge presence/absence detection sensor 311 which is not described above is provided in an ink cartridge receiving portion, the head 301 being connectable to the main body side by a head joint 303. Also, the sub-tank 307 is provided with an ink level sensor 306 for holding the amount of ink at or above a fixed amount, an overflow sensor 305 for stopping the apparatus when it fails for some reason, and a breather valve 304 for releasing the atmospheric pressure within the tank to the atmosphere.

Figure 13:
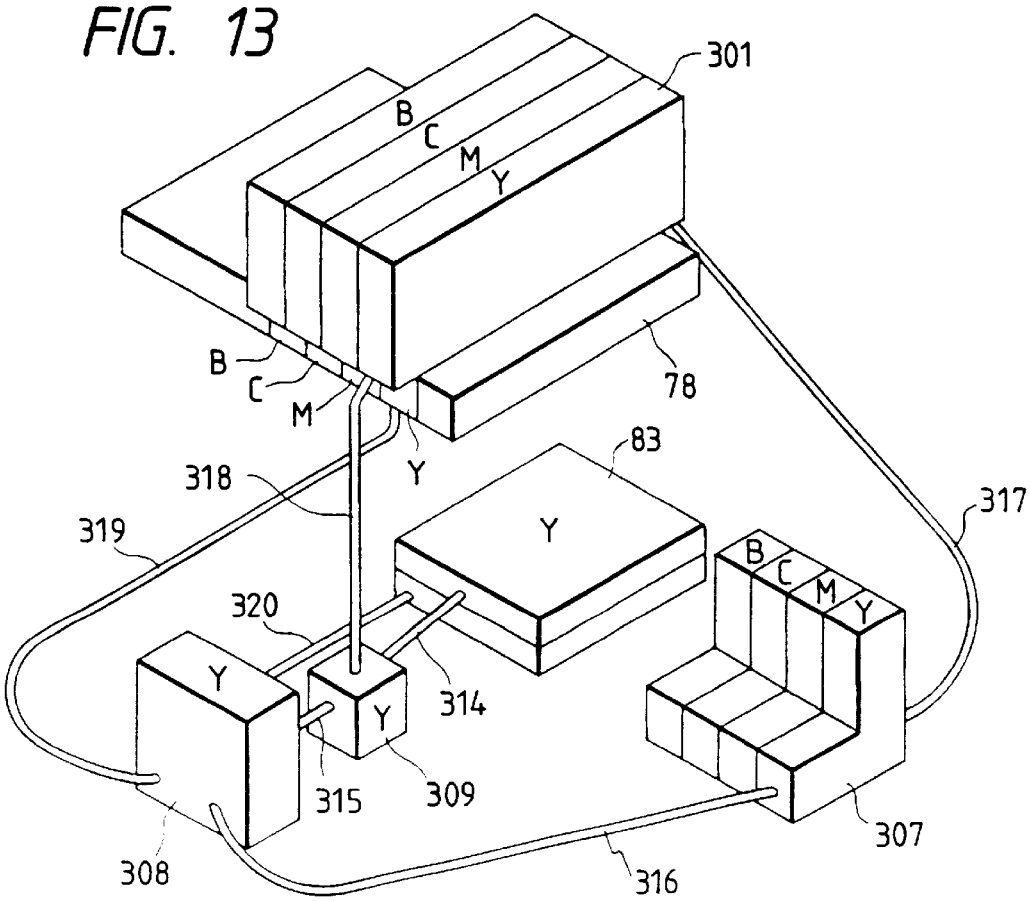
FIG. 13 is a schematic view showing a constructional example of ink system of the apparatus according to the embodiment.

FIG. 13 is a schematic view showing the construction of an actual ink system within this apparatus. Herein, other than the elements of head 301, sub-tank 307 and recovery system 78, only the portions relating to Y (yellow) are shown.

Using the construction of the ink system as shown in FIG. 13, the flow of the ink along the tube will be described below.

(1) When supplying the ink to the sub-tank 307

Ink supply unit 83→tube 314→tube 315→tube 316→sub-tank 307

(2) When printing

Sub-tank 307→tube 317→head 301

(3) When circulating the ink through the head

Sub-tank 307→tube 316→tube 315→tube 318→tube 317→sub-tank 307

(4) When withdrawing the waste ink

Recovery system unit 78→tube 319→tube 320→ink supply unit 83

Note that the sub-tank 307 has its uppermost portion positioned slightly above the sheet conveyance surface, as shown by hatching in FIG. 5. And the height of liquid surface up to which its reserves the ink is regulated by a sensor not to exceed a predetermined height.

Note that the ink system is not limited to that above described, but can take various constructions.

Figure 14:
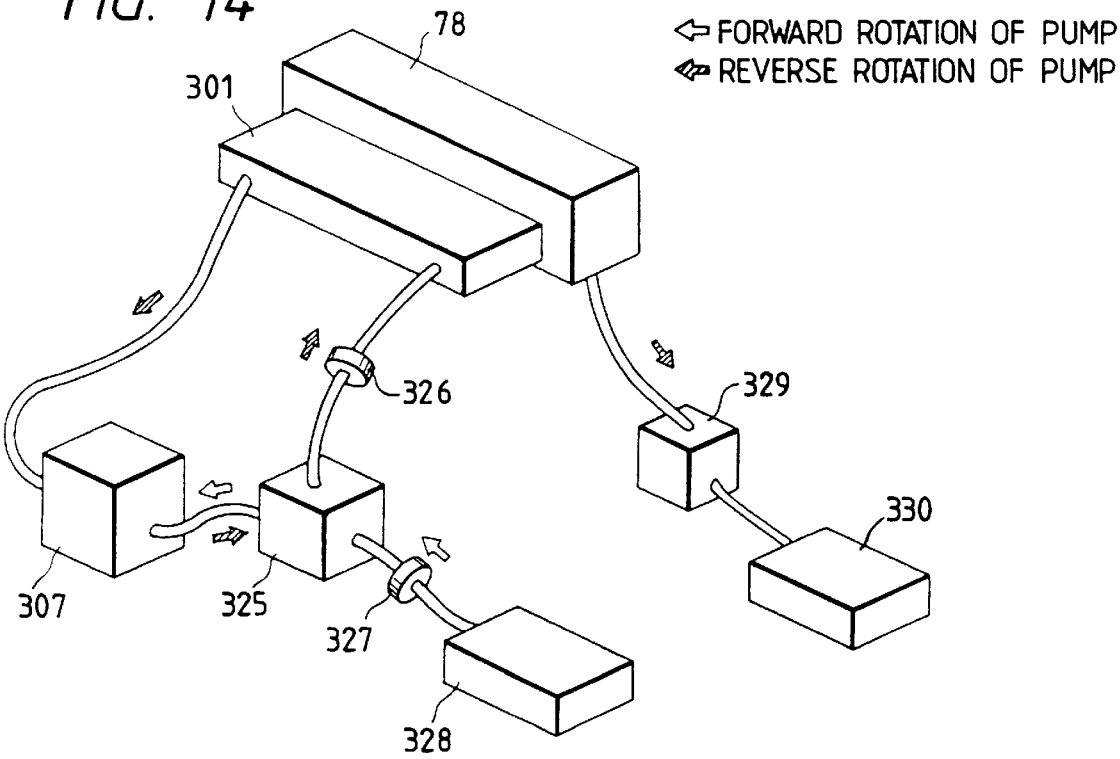
FIG. 14 is a schematic view showing another constructional example of ink system of the apparatus according to the embodiment.

FIG. 14 is a typical schematic view showing another construction of the ink system. The ink is supplied from an ink cartridge 328 via one-way valve 327 to the sub-tank 307 by a pump 325 (the positive rotation of pump in this case).

Also, when the print quality is disordered because bubbles or fine particles are mixed into the discharge port portion of the head 301, the ink is supplied from the sub-tank 307 via one-way valve 326 to the head 301 by rotating the pump reversely (pressure recovery). Then, the ink discharged from the head 301 is accepted by the recovery system unit 78, and fed directly or by a waste ink pump 329 to a waste ink cartridge 330.

On the other hand, in the construction of FIG. 14, when the waste ink pump is not provided, the withdrawal of the waste ink is insufficient, while when the waste ink pump is provided, the whole apparatus is increased in size because of the space required for the pump, and the cost is raised, wherein it is conceived that the pump for supplying the ink to the sub-tank or head and the pump for withdrawing waste ink can be operated by the same driving source (motor) by providing a one-way clutch.

Figure 15:
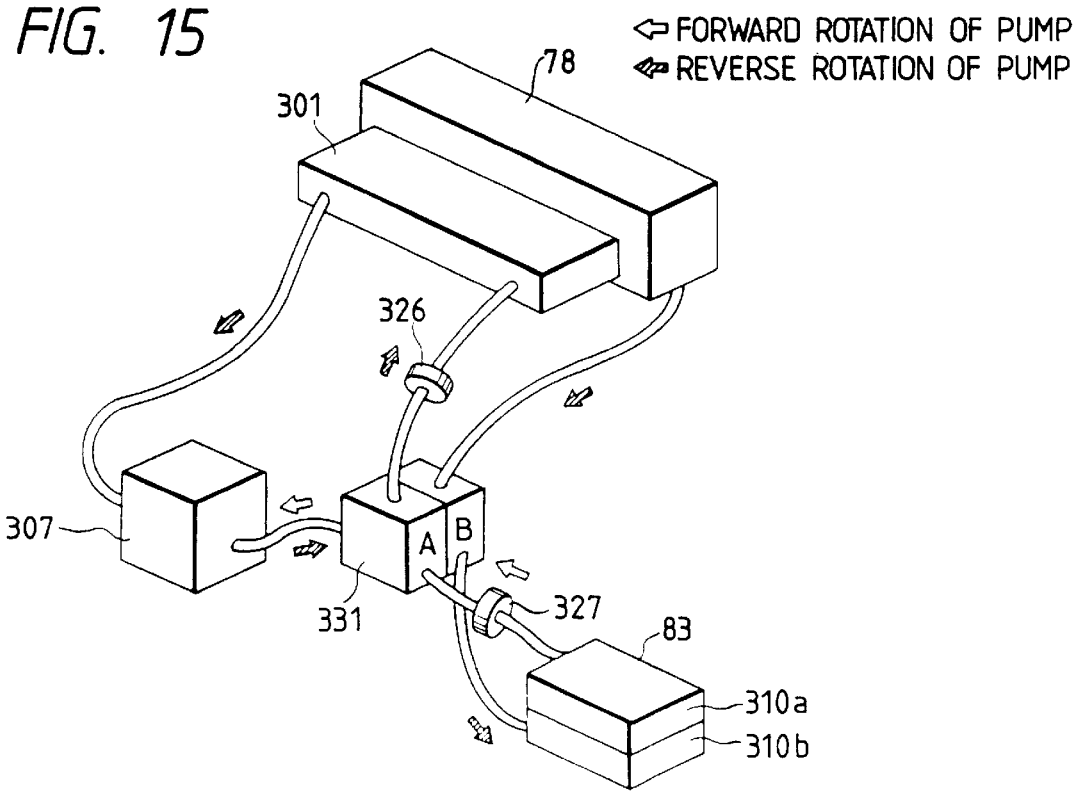
FIG. 15 is a schematic view showing a further constructional example of ink system of the apparatus according to the embodiment.
Figure 16:
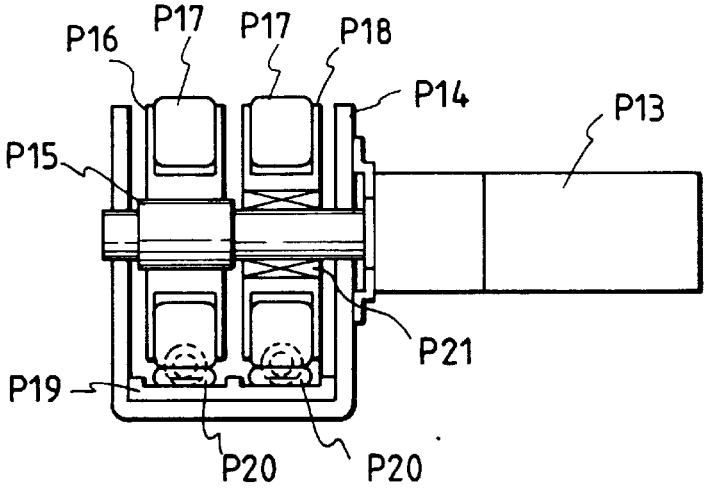
FIG. 16 is an explanatory view of a pump.

FIGS. 15 and 16 show an constructional example thereof, wherein the same numerals as in FIG. 14 are used to refer to the like parts. Herein, FIG. 15 is a schematic view of the ink system, and FIG. 16 is an explanatory view of the pump.

The basic construction is the same as that of FIG. 14, but is different from that of FIG. 14, in that when the motor P13 which is a driving source is rotated in a certain direction (positive direction), the ink is supplied from the ink bag 310*a* via one-way valve 327 to the sub-tank 307, while when rotated in reverse direction, the ink is supplied from the sub-tank 307 via one-way valve 326 to the head 301, while the waste ink within the recovery system unit 78 is withdrawn within the waste ink absorbing member 310*b*.

Referring to FIG. 16 to describe the pump 331 for effecting the above operation by one motor, a tube pump 11 is adopted as the pump in this embodiment, portions A and B of the pump 331 in FIG. 15 corresponding to the pump portions as indicated by symbols P16 and P18 in FIG. 16, respectively.

An ink supply pump portion P16 and a waste ink withdrawal pump portion P18 each have a roller P17 mounted freely rotatably, the ink supply pump P16 being secured to a pump shaft P15 directly connected the motor P13, and rotatable in both forward and backward-directions. On the other hand, the waste ink withdrawal pump P18 contains one-way clutch P21, and is rotatable only when the motor P13 is rotated reversely. Note that symbol P14 is a frame for supporting the pump shaft P15 and symbol P18 is a tube presser.

If the ink bag and the ink supply source are integral with the waste ink absorbing member, as shown in FIG. 12, FIG. 13 or FIG. 15, the space within the machine can be utilized more effectively, but it will be appreciated that they may be provided separately as shown in FIG. 14.

Figure 17:
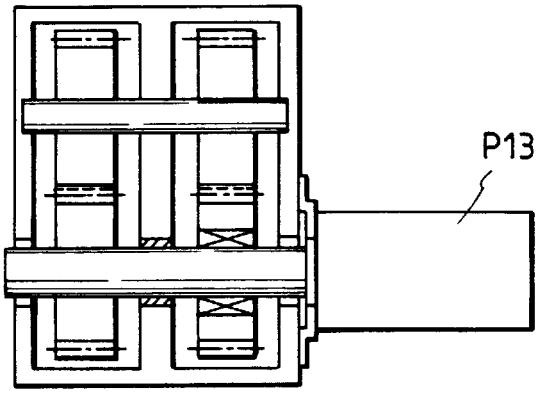
FIG. 17 is an explanatory view showing another constructional example of pump.

Also, a tube pump having two pumps integrally formed as the pump was used in FIG. 16, but it will be appreciated that the pump portion may be constituted of a gear pump as shown in FIG. 17.

Figure 18:
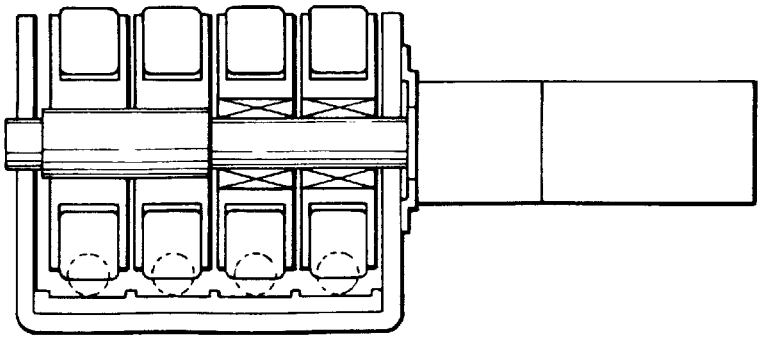
FIG. 18 is an explanatory view showing a further constructional example of pump.

Further, in the construction of FIG. 16, the pump corresponds to the supply system for one head, but it will be appreciated that a pump corresponding to a plurality of heads may be driven by one motor as shown in FIG. 18.

(2.4) Head unit

Figure 19:
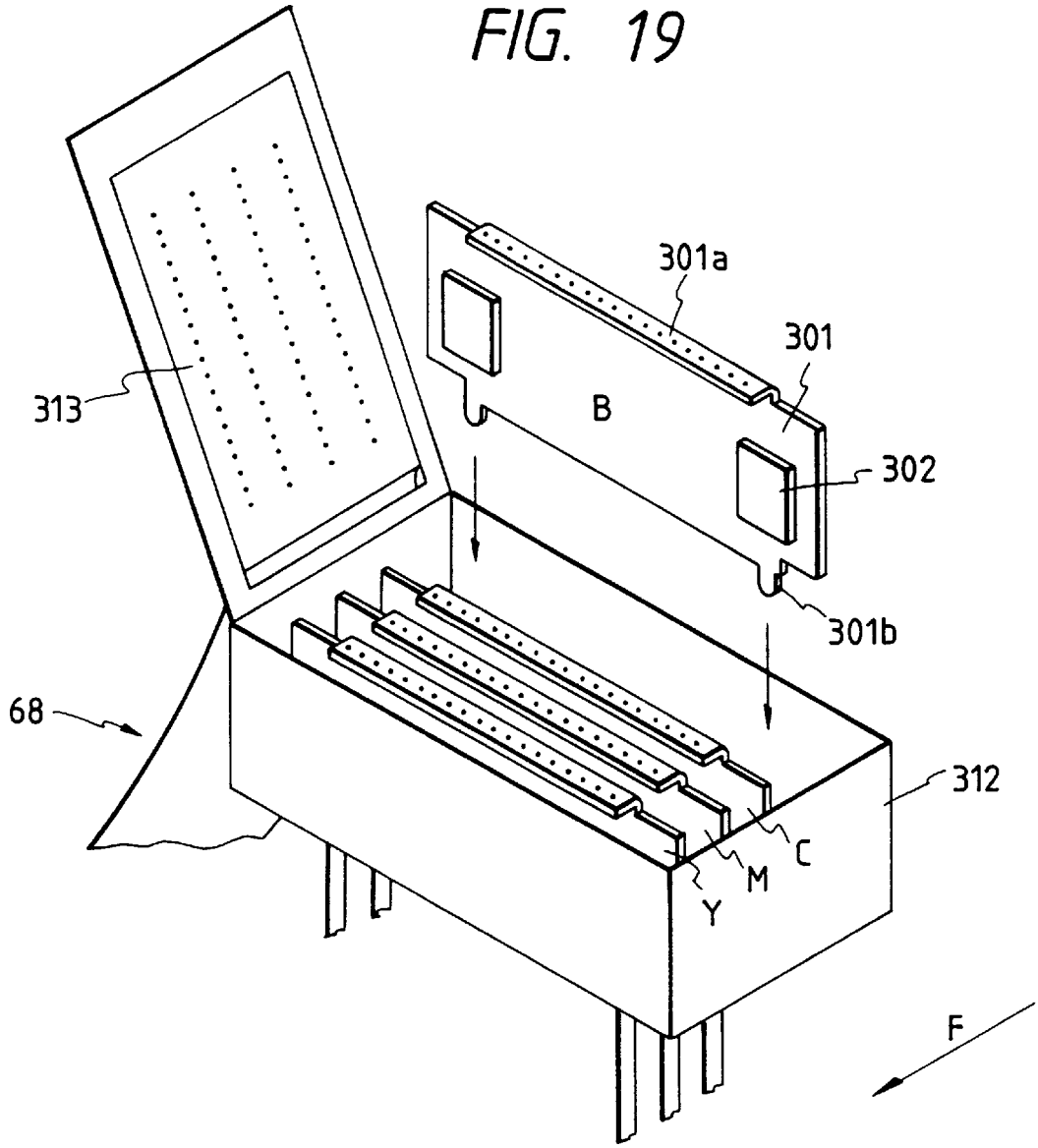
FIG. 19 is a perspective view showing a constructional example of a head mounting portion of the apparatus according to the embodiment.

FIG. 19 is a view for explaining the components of a head block 68, that is, heads 301 and a head holder 312 for joining them together on the main body side. Four heads 301 are inserted in parallel within the head holder 312, their positioning can be effected by positioning pins 301*b* on the heads 301 and joints (not shown) within the head holder 312.

Also, a head flexible wiring board A30 having contact points on the upper surface thereof above the heads 301 is connected and secured in contact with a head flexible wiring board B313 provided on a lid portion of the head holder 312 to be able to receive the electric signal from the main body side.

Note that Y, M, C and B in the figure indicate yellow, magenta, cyan and black inks, respectively. Of course, the number of heads that can be disposed within the holder 312 can be set arbitrarily.

In this way, the head holder 312 in this embodiment can mount detachably four heads, but may prepare and mount the heads of, in addition to the above four colors normally used in recording, a specifically desired color (metallic color or cobalt blue, or the color that is difficult to represent with the above four colors, hereinafter, referred to as a special color). In doing so, it is preferable to mount the heads corresponding to the inks having lower lightness in the order from the upstream side in the sheet conveying direction F. This is due to the following reason.

Figure 20:
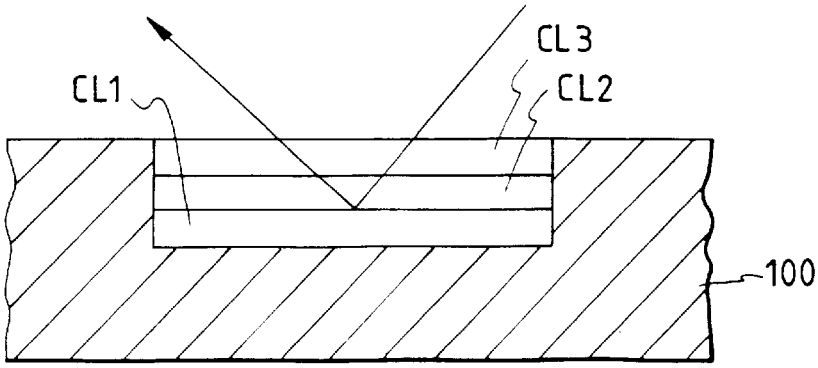
FIG. 20 is an explanatory view showing how the ink is superimposed on the recording medium.

If the recording (print) is performed on the sheet (label 100), using the inks of multiple colors (e.g., three colors), it is considered that the inks CL1, CL2 and CL3 are superposed as shown in FIG. 20. Thus, for example, by comparing the lightness of specific color used with that of C, M, Y, except for Bk (as Bk is mostly formed singly, the order may not be specifically designated), and printing the specific color and C, M, Y in the order of lower lightness, it is conceived that since the transmittance of the ink formed later is higher, the color of the ink formed previously is visible, as indicated by the arrow in FIG. 20, so that the clear print of synthesized color can be implemented. That is, in an ink jet printer in which four colors of C, M, Y and Bk, for example, are printable, if orange color is added as the special color, the lightness is in the order of C<M<orange<Y, so that the printing order may be C, M, orange, Y and Bk. In this regard, the head may be provided with means for presenting the information concerning its own color (EEPROM, switch, notch), while the apparatus may be provided with means for reading that information, means for detecting whether or not it is arranged in appropriate order upon reading, and means for suggesting the order of arranging or the change upon the detection.

(2.5) Recovery system

Figure 21:
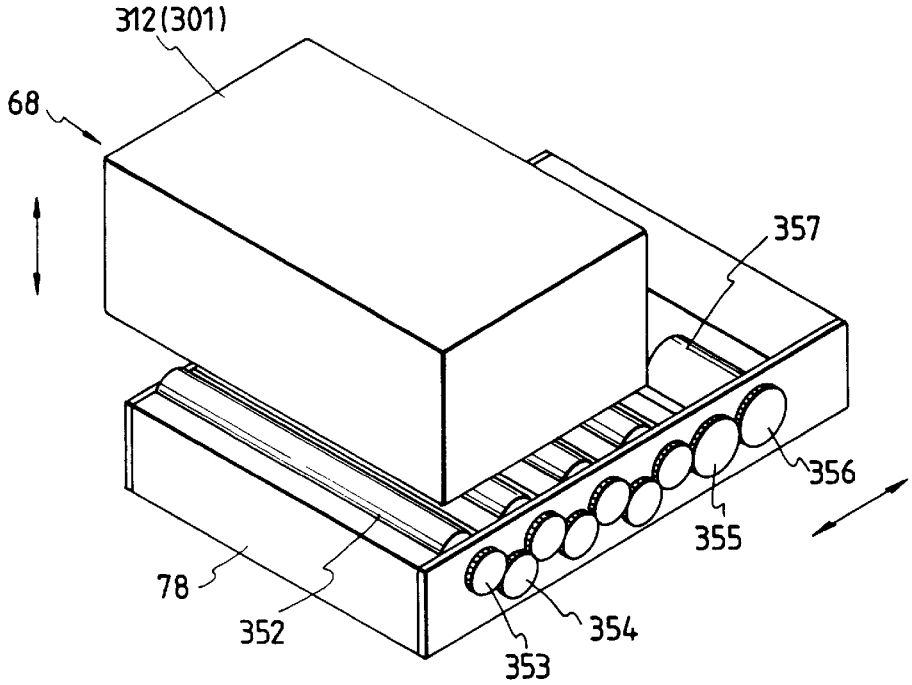
FIG. 21 is a perspective view showing the positional relation between a head and a recovery system unit in the apparatus according to the embodiment.

FIG. 21 is a perspective view showing the positional relation between the head 301 (or head holder 312),iand the recovery system unit 78. The head 301 can be moved in the vertical direction by a driving source, as shown in FIGS. 10 and 11, while the recovery system unit 78 can be moved in the horizontal direction.

Within the recovery system unit 78 is provided an absorbing member roller 352 under each head to efficiently withdraw the ink discharged through the nozzles during the recovery of the head 301. The absorbing member rollers 352 are driven for rotation via roller gears 353 incorporated axially and idler gears 354, and motor idler gears 355 by a recovery system motor 357 mounted on the recovery system unit 78.

Figure 22:
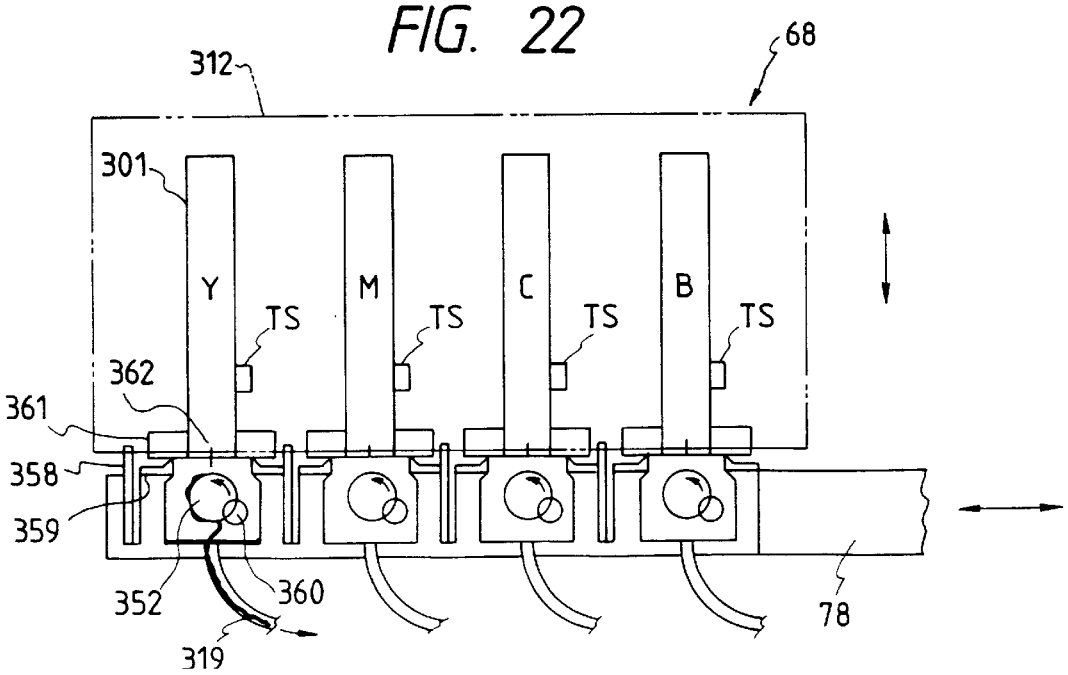
FIG. 22 is an explanatory view for explaining the operation of recovery system unit during the recovery.

FIG. 22 explains the operation within the recovery system unit 78 when recovering the head 301. Note that Ts in FIG. 22 is a temperature sensor provided at an appropriate site of each head, which will be described later. FIG. 22 shows the state (capping state, hereinafter described) in which the head 301 is placed into close contact with the recovery system unit 78, in which the ink circulation in the recovery operation of the head 301 is effected in this state.

As described in connection with FIG. 19, the absorbing member roller 352 under the head 301 is driven for rotation in a direction of the arrow by the recovery system motor 357 mounted on the recovery system unit 78, and pressed against a squeezing roller 360, so that the ink discharged through the head nozzles 362 is squeezed therein, and the ink is always in the permeable state on the upper side of the absorbing member roller 352 under the head nozzles 362. This figure shows an instance where the ink is circulated through a yellow ink head 301, whereby the ink discharged within the recovery system unit 78 is transferred by the pump 308 through the tubes 318 and 320 to the waste ink absorbing member 310*b* within the ink supply unit 83, as previously described.

FIGS. 23A to 23D explain the positions between the head 301 and the recovery system unit 78.

FIG. 23A Capping

Capping is at a position in the normal stand-by state or when the ink is circulated in the recovery operation of the head 301, wherein a front face plate 361 of the head 301 and a rubber cap 359 of the recovery system 351 are closely contacted.

FIG. 23B Wiping

Wiping is one of recovery operations for the head 301, that is, an operation of removing ink droplets remaining around the head nozzles 362 without being absorbed into the absorbing member roller 352, among the ink discharged through the head discharge ports 362 owing to the ink circulation.

Specifically, the head 301 is moved upward by a predetermined amount from the capping position, and the head nozzles 362 and their surroundings are wiped by a blade 358 provided thereon, in moving the recovery system 351 rightward by a predetermined amount.

Figure 23A:
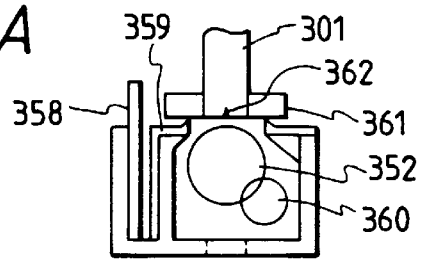
FIGS. 23A to 23D are explanatory views for explaining the positions between the head and the recovery system unit.
Figure 23B:
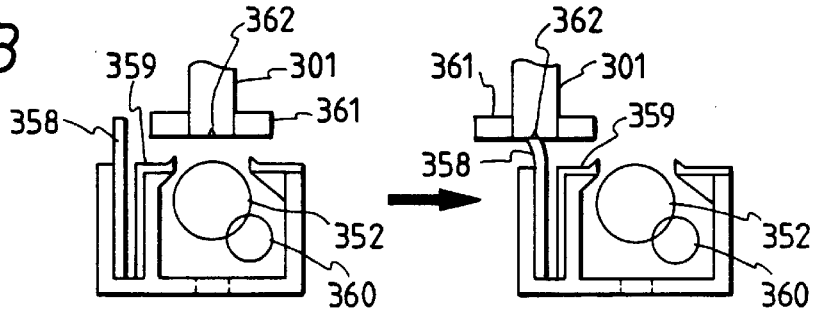
Figure 23C:
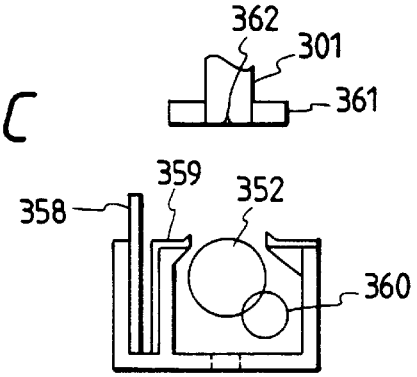

FIG. 23C Retraction

Retraction is made to place the head out of contact with the recovery system 352 into an escaped state because the recovery system 351 is greatly moved upon transferring from the capping state to the printing state, or in its opposite movement.

FIG. 23D Printing

Printing is in the state where the recovery system 351 is completely retracted rightward in the normal printing state, and the head 301 is moved downward further below a capping position, the interval from the recording sheet being held a predetermined amount.

(2.6) Sensors

In this embodiment, a temperature sensor TS is disposed on each head as shown in FIG. 22. With this, the following control is enabled. If the print instruction is consecutively output, the temperature of the head 301 starts to gradually increase, but upon detecting the temperature of the head sensed by the temperature sensor TS to exceed a predetermined reference temperature, the printing is interrupted, and then restarted after waiting for the temperature of the head 301 to decrease, whereby the occurrence of print failure can be eliminated. Or the head temperature can be decreased by lowering the print speed without interrupting the print.

Further, when the detected value of the temperature sensor TS exceeds a reference temperature, the head temperature can be decreased by circulating the ink, as described above, without interrupting the print.

Next, a sensor which performs a predetermined detection for the sheet extending along the sheet conveyance passageway will be described below. As the sensor with the sheet, the TOF sensor is provided as above described, but the following sensors may be provided to detect the shape of the sheet (label) or the attitude (inclination on the release sheet).

Figure 24A:
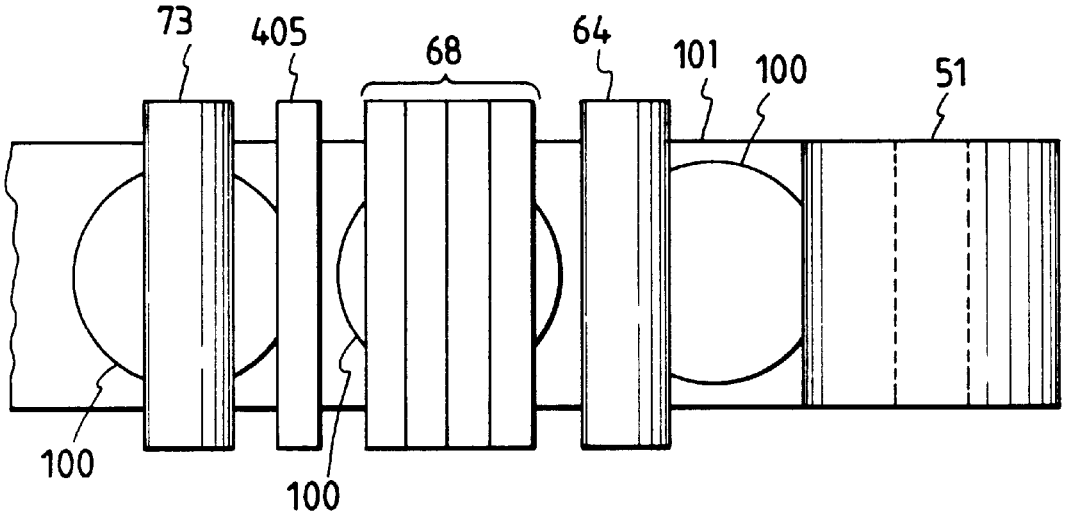
FIGS. 24A and 24B are a typical plan view and a typical side view for showing a constructional example of a sensor useful to detect the label shape, respectively.
Figure 24B:
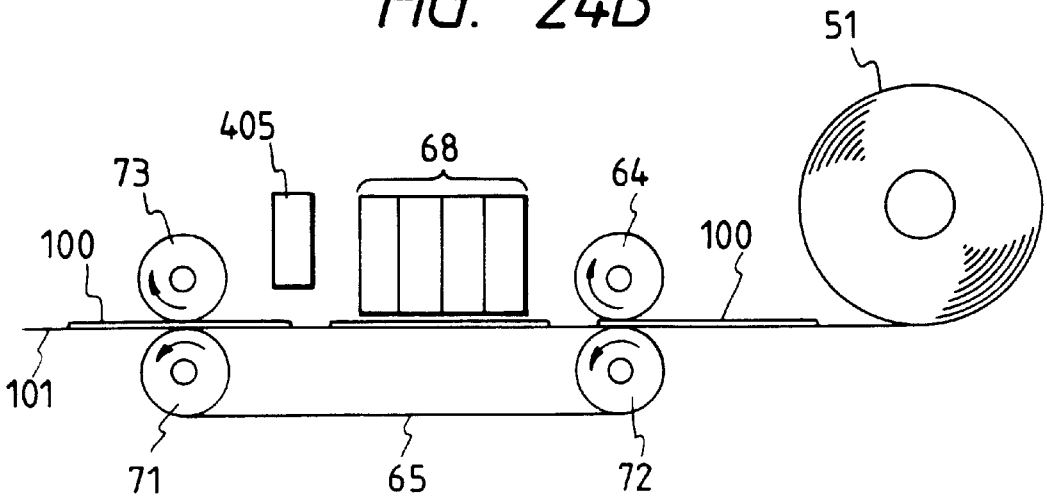

FIGS. 24A and 24B are a typical plan view and a side view for explaining such a sensor, respectively. A sensor 405 in this example is disposed downstream of a head block 68 in the sheet conveyance direction, and a line sensor extending in a direction orthogonal to the conveyance direction, whereby the shape of label 100 can be recognized by reading it at a predetermined timing while conveying the sheet. Herein, when a group of labels 100 in succession have the same shape and attitude, this example is an effective construction, wherein the fitness of the label to the layout of the printed context or the desired print on the ensuing labels in accordance with the shape can be made by recognizing the shape of leading label prior to printing. Also, the print form can be recognized.

Note that in the construction of the same figure, when the leading label is also printed, or when the label shape or attitude is different, the roll may be rewound after reading to effect the desired print.

Figure 25A:
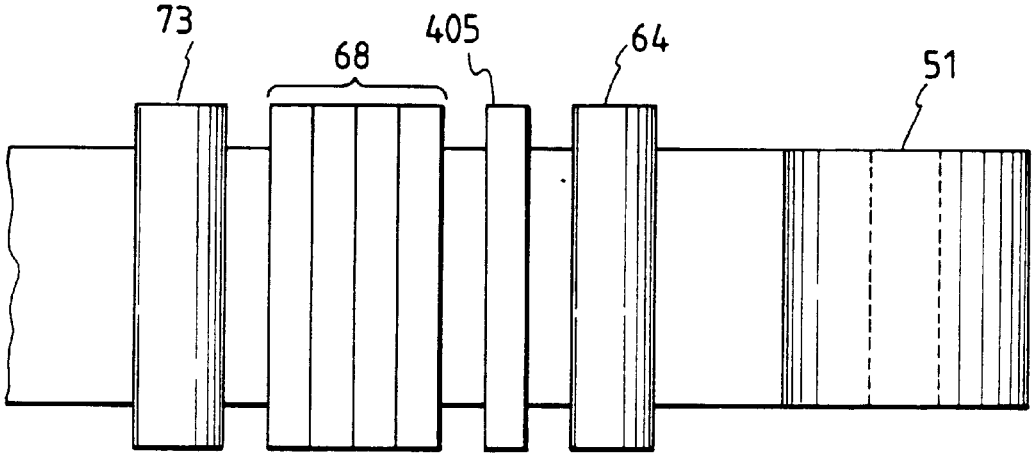
FIGS. 25A and 25B are a typical plan view and a typical side view for explaining another constructional example of sensor, respectively.
Figure 25B:
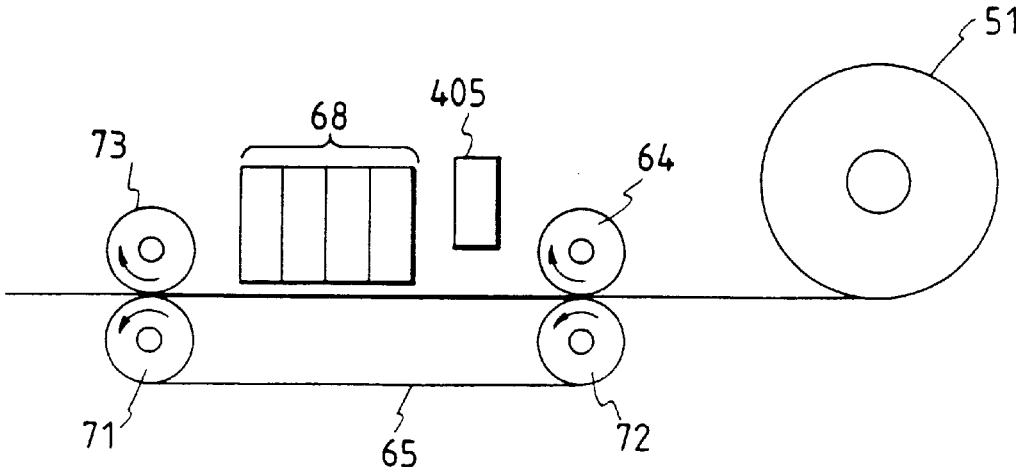

FIGS. 25A and 25B are a typical plan view and a side view for explaining another example of sensor for effecting the shape and attitude, respectively. In this example, the sensor 405 similar to that of FIGS. 242 and 24B is disposed upstream of the head block 68 in the sheet conveyance direction, wherein the efficient print is allowed because use of the leading label or rewinding as above described is not needed though the print condition can not be confirmed.

Figure 26A:
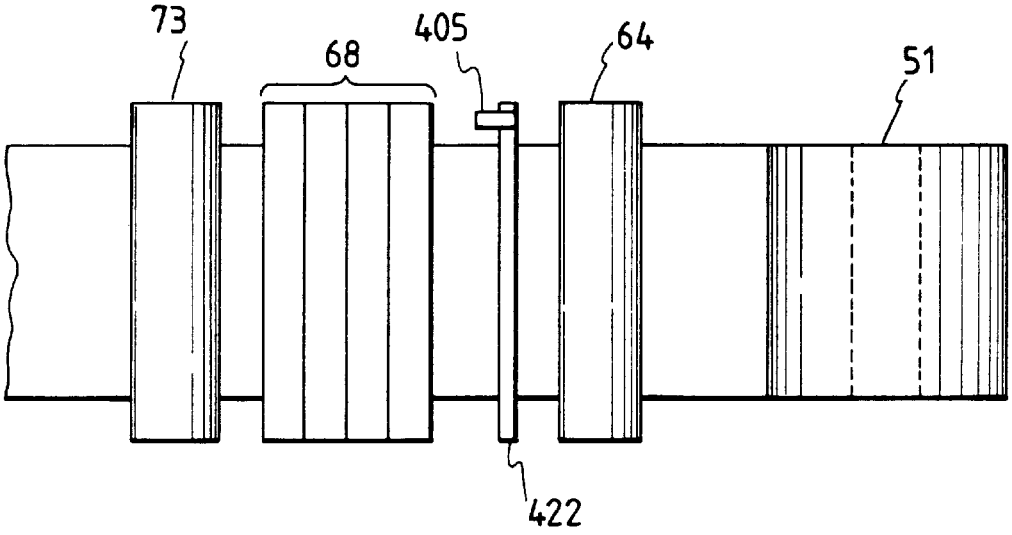
FIGS. 26A and 26B are a typical plan view and a typical side view for explaining a further constructional example of sensor, respectively.
Figure 26B:
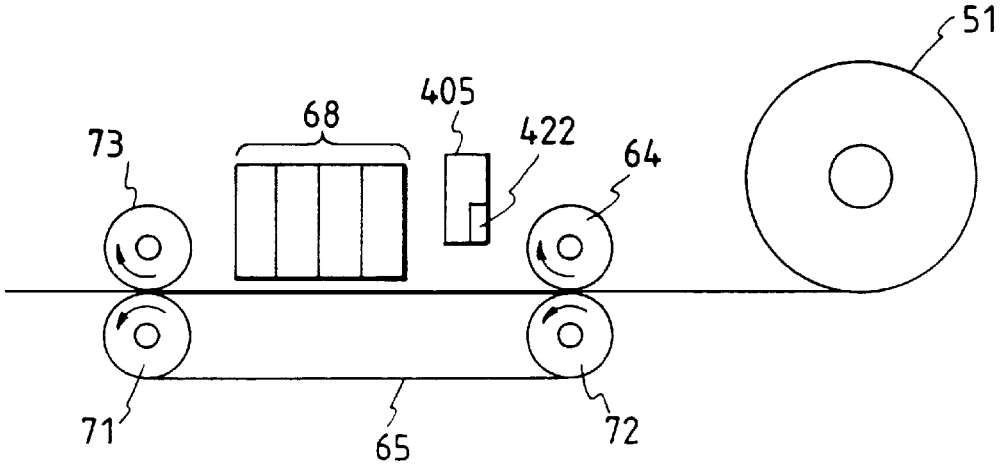

Further, such sensor may not be a line sensor as shown in FIGS. 24A through 25B. FIGS. 26A and 26B show further constructional examples of sensor, the same effects as above described can be obtained by guiding and scanning a sensor 406 for effecting detection operation for the point or small area along a guide 422 in a direction orthogonal to the conveyance direction.

In addition, the reflection type sensor is used in the above example, but the transmission type sensor may be used as far as the release sheet 101 has a required transparency.

Further in addition, if it suffices to consider only the attitude of label (inclination on the release sheet), there is no need for providing the line sensor or scanning means extending over the entire width as above described.

Figure 27:
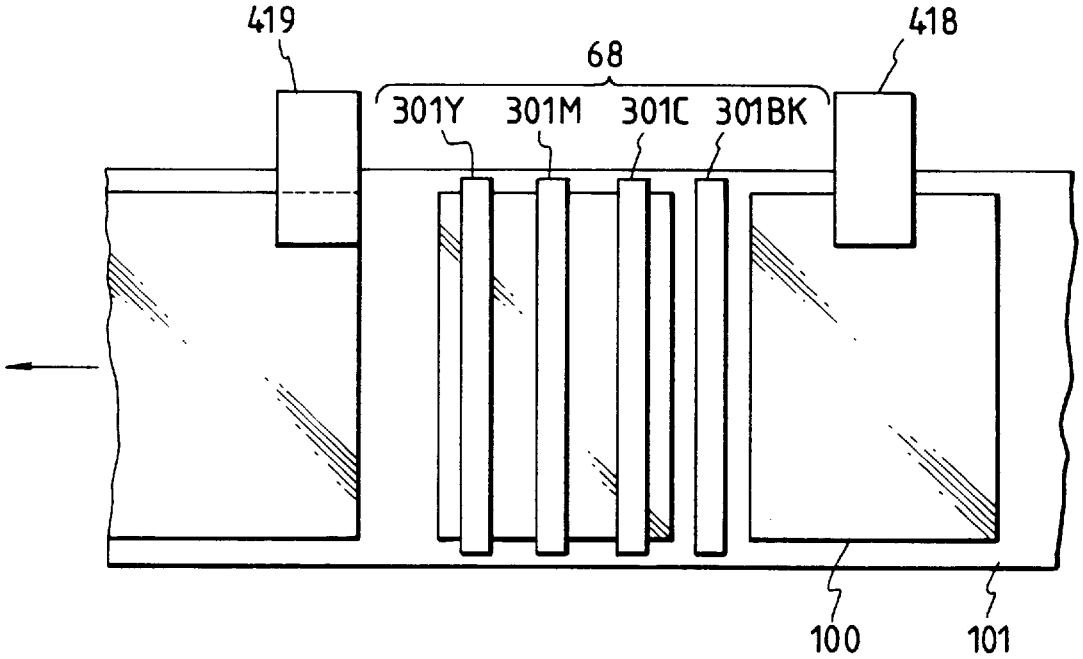
FIG. 27 is a typical plan view showing a constructional example of a sensor system for detecting the label attitude.
Figure 28:
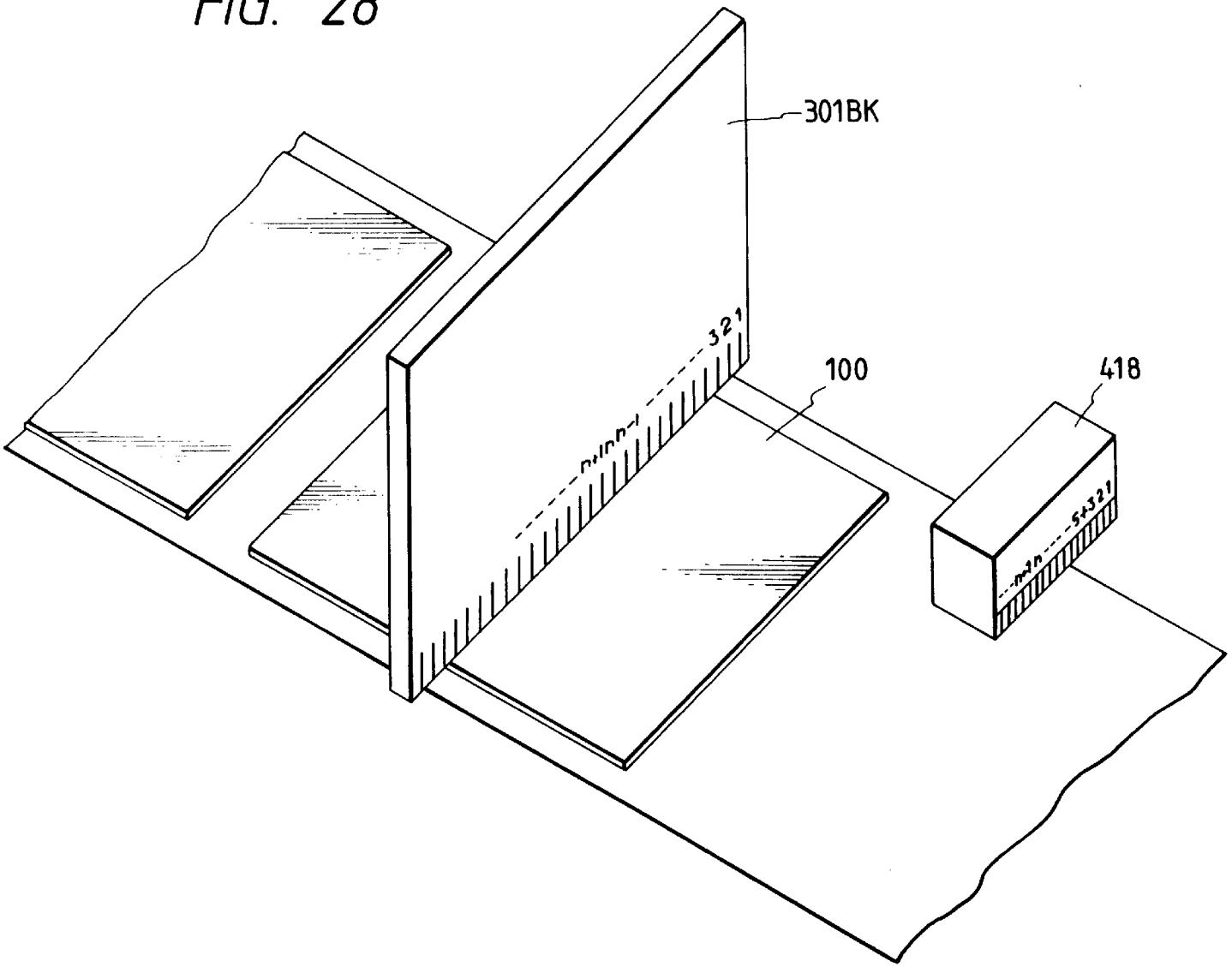
FIG. 28 is a typical perspective view showing the constructional example of sensor system for detecting the label attitude.

FIG. 27 is a typical plan view showing a constructional example of sensor system to detect the attitude of label, and FIG. 28 is a perspective view (the head is shown only for black). In this way, edge sensors 418 and 419 are disposed upstream and downstream of the head block 68 in the sheet conveyance direction, respectively, thereby allowing suitable printing in accordance with the attitude by obtaining data regarding the inclination of the edge portion and the print position by calculation.

Figure 29:
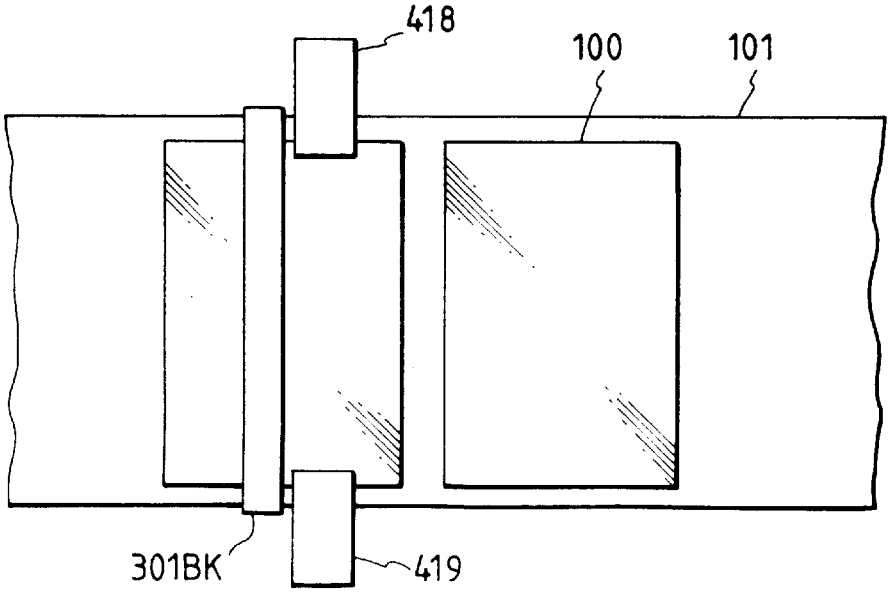
FIG. 29 is a typical plan view showing another constructional example of sensor system for detecting the label attitude.

FIG. 29 shows another constructional example of edge sensor system. In this example, paper edge position detection sensors 418 and 419 are disposed immediately before the head block and near the paper edge portion to select the nozzles involving printing based on the paper position data immediately before the head. In this case, the print position is not necessary to calculate from the amount of bias as in the previous example, allowing for the simpler control.

(3) Construction of control system (3.1) Overview

Figure 30:
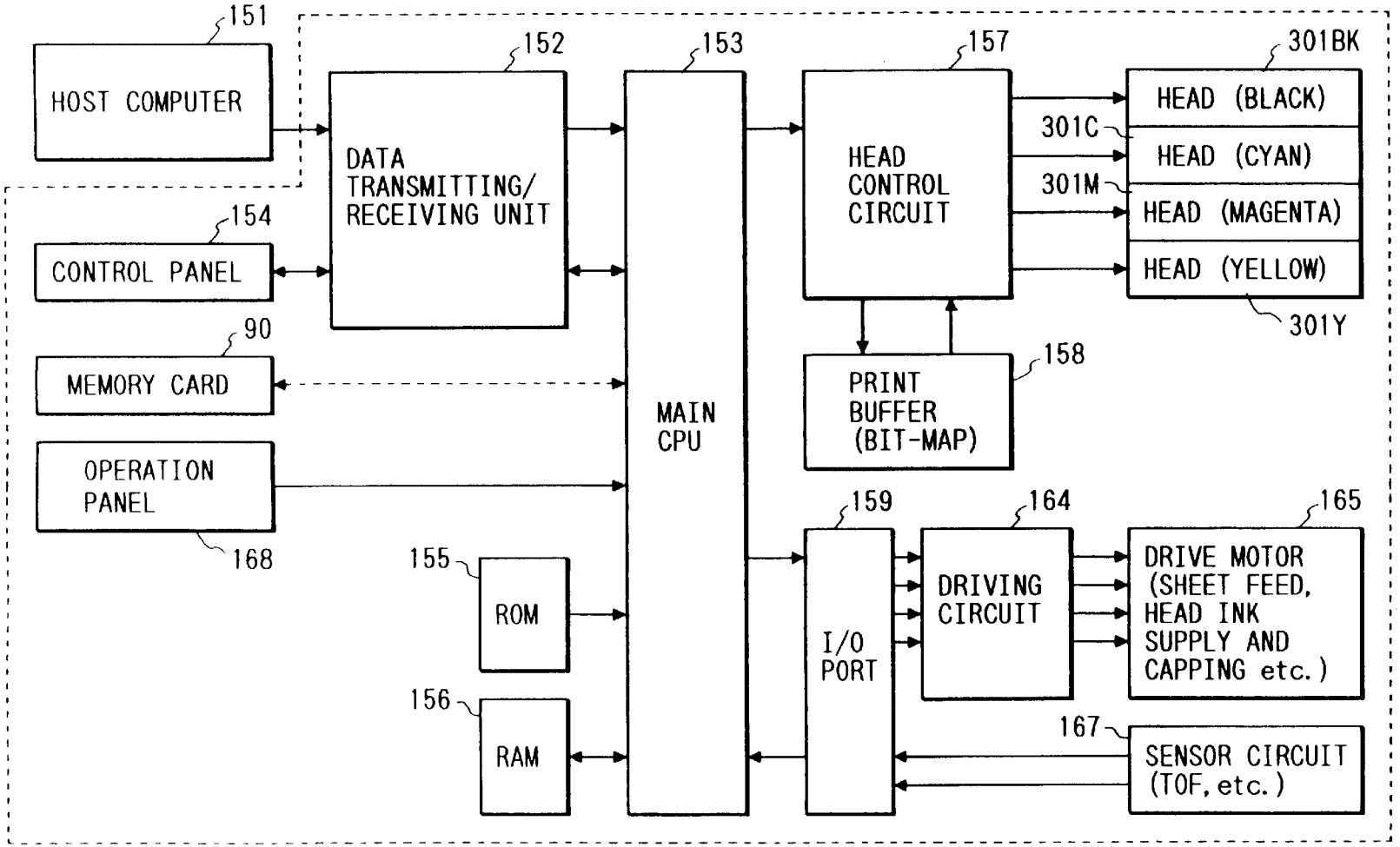
FIG. 30 is a block diagram showing an overall constructional example of a control system for the apparatus according to the embodiment.

FIG. 30 shows an overall configurational example of a control system in this embodiment. The image data printed by the label printer of this embodiment is created or edited by the host computer 151, and sent out as color image data or color character data to a data transmission/reception unit 152.

They are received as the bit map data for four colors (black, cyan, magenta and yellow, or special color as required), or received as the character code data. Whether the print data to be received is bit map data or character code data can be determined by a command received ahead. In the case of character code data, a command of print start position designation, character font, character size, or print color designation is inserted for each character data or multiple character strings, that is, each change point of print style.

Data received by the data transmission/reception unit 152 is read by a main CPU 153 and stored in succession in the work area provided in a RAM 156. Then, the character generator content of the corresponding character is read from a ROM 155 for the development into the bit map for each character, and its result is written into a print buffer 158. The print buffer 158 holds independently data for four colors of black, cyan, magenta and yellow each for one page (one label) corresponding to the heads 301Bk to 301Y. For example, in this embodiment, a line head having a print resolution of 360 dpi (dots/inch) and 1,344 discharge ports for one head arranged in the sheet width direction is employed for the printing, by using 1,328 orifices except for eight orifices at each of both ends or a total of 16 orifices. That is, the print data amounts to 1,328 dots, data of 16 blanks in total is added in transferring data to the head 301 to obtain data of 1,344 dots. And 1,344 discharge ports are divided into 21 blocks each consisting of 64 orifices, which blocks are driven by a head control circuit 157 as will be described later. The print width with 1,328 discharge ports is about 3.7 inches at maximum. If the page length-is set at four inches, the print buffer size required is $$1{,}328\times360\ [\text{dot/inch}]\times4\ [\text{inch}]=1{,}912{,}320\ [\text{bit/page}]$$

for one color. When printing consecutively different text or graphic data of multiple pages without impairing the effective print speed, a method of providing two pages of print buffer as above, i.e., a double buffer method, is effective. The print buffer size required in this case is $$1{,}912{,}320\ [\text{bit/page}]\times2\ [\text{page}]=3{,}824{,}640\ [\text{bit}]$$

for one color. If one page is used as the buffer for the current printing, and another page is dedicated for editing the next page, the high speed printing can be realized. The image data developed into the print buffer 158 is read successively from the head control circuit 157 and transferred to the heads of four colors 301Bk to 301Y. The detailed operation timings for the print buffer 158, the head control circuit 157, the heads 301Bk to 301Y, and the CPU 153 will be described later.

In ROM 155, a control program for controlling the whole of the color printer is stored together with the character generator and the bar code generator as previously described. And the main CPU 153 controls the driving of drive motor 165 via an I/O port 159 and a drive circuit 164 under the control of the control program. The drive motors 165 include a paper feed motor for conveying the sheet, a head motor for moving the head upward or downward, and a capping motor for operating the capping and cleaning mechanisms in the ink nozzle portion of the head. Note that the drive pulse of driving the paper feed motor and the print operation are synchronized completely in this embodiment.

A sensor circuit 167 comprises a TOP sensor for detecting the top position of label to be printed, a home position sensor for determining each reference position of head motor and capping motor, an ink level sensor for monitoring the remaining amount of the ink of each color, a temperature sensor as shown in FIG. 22, a label shape detection sensor as shown ill Pig. 24A, 24B, 25A, 25B, 26A or 26B, and an edge sensor as shown in FIG. 27 or 29.

The main CPU 153 may store the print data received from the host computer 151 in a memory card 90. When the print operation is made by separating the host computer 151 and the printer of this embodiment, data stored in the memory card 90 is normally in the form of character code data, but fixed print image data without necessity of the data change may be stored as the bit map data of four colors. The print command for the print operation using the memory card 90 is output from the control panel 154. The control panel 154 allows for the change of the print format for the print data within the memory card 90, in addition to the initiation and stop commands of printing. The details of the control panel 154 will be described later.

The operation panel 2 has been described in FIG. 9.

(3.2) Control panel

Figure 31:
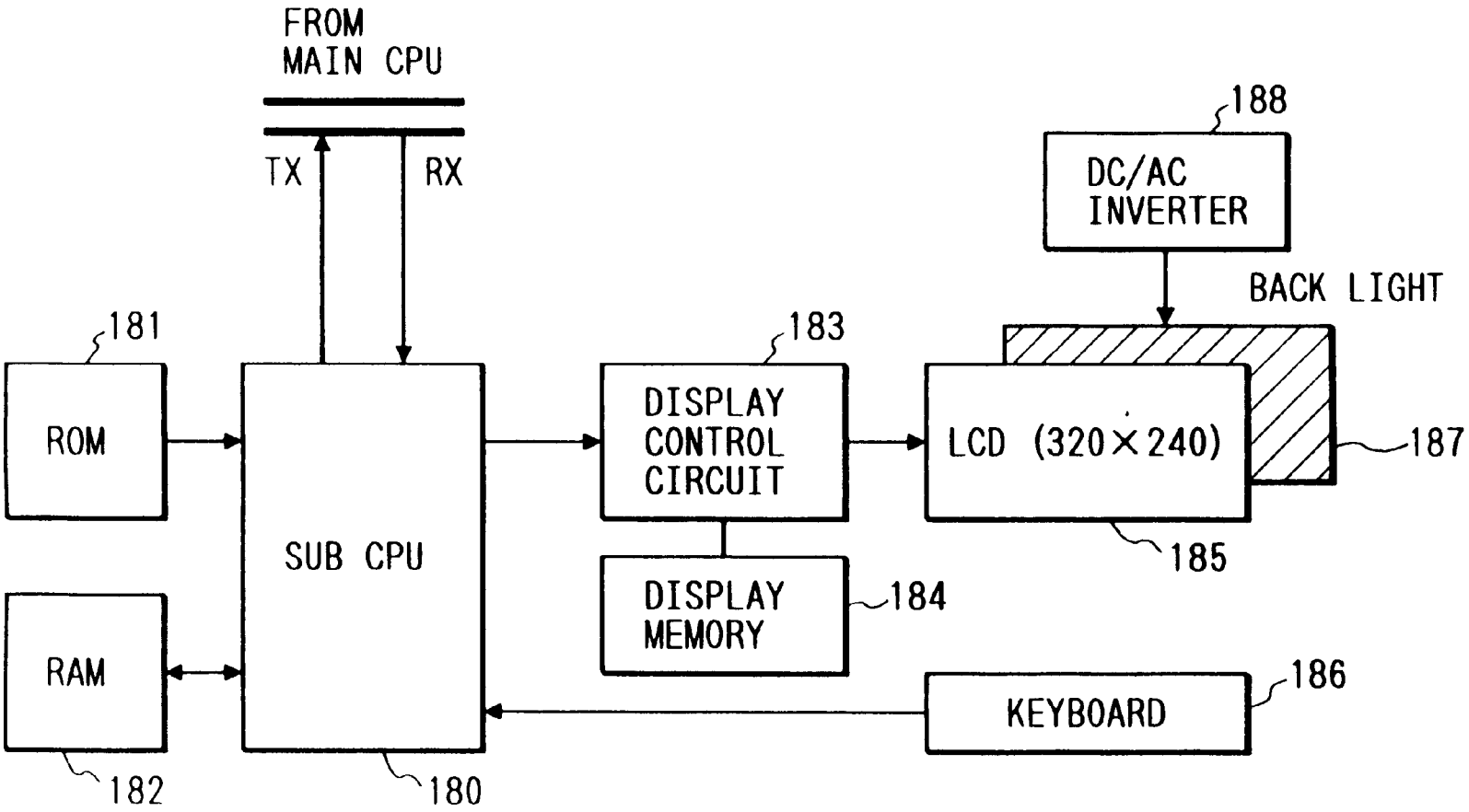
FIG. 31 is a block diagram showing a constructional example of a control panel of the apparatus according to the embodiment.

FIG. 31 is a block diagram showing a constructional example of control panel 154. The control panel 154 is used in the state where the label printer main body 1 of this embodiment and the host computer 151 are separated from each other, that is, in the off-line state, the main functions of the control panel include the display of the print image data and the change of the print format. This control panel 154 may be equipped in a housing separate from the color printer main body.

Normally, the display image data is transmitted in the format of code data from the CPU 153 to a communication port of the sub CPU 180, although it may receive and display the display image data. Herein, the case of reception in character code data will be described.

If a data reception request key on the keyboard 186 is depressed, the sub CPU 180 issues a data request command to the main CPU 153. Data transmitted from the main CPU 153 is stored in RAM 182, and in parallel, the sub CPU 180 reads successively the character generator for display corresponding to each of received character code data and writes it via the display control circuit 183 into the display memory 184 to display the received image data under the control of the control program stored in ROM 181.

The character generator for display is provided in ROM 181. The display control circuit 183 makes the control to read successively the content of the display memory 184 and then display it on a display 185. Herein, the display may be a liquid crystal display having 320×240 dots. If the weight of one dot on the display is made corresponding to a length of 1/90 inch in both the longitudinal and horizontal directions on the print medium, the area as large as 3.6×2.7 inches can be displayed.

The image data and format can be changed on the display 185, using the keyboard 186. The changed content is stored in RAM 182 in succession. When printing its results, a data reception request command is issued from the sub CPU 180 to the main CPU 153, and the updated image data is received and printed on the main CPU 153. The display 185 is provided with a back light 187 to offer higher display quality. Normally, a cold cathode ray tube is suitable, in which an inverter 188 for converting from the direct current to the alternating current is used.

(3.3) Head control system

In this embodiment, the print buffer 15*a* (bit map RAM) for developing the print data into the bit map uses a low-priced DRAM (dynamic random access memory). The functions required to manage the bit ap RAM include:

(a) Writing operation from CPU, (b) Reading operation into CPU, (c) Print data reading operation-into head, and (d) Refresh operation of DRAM.

Among them, (a), (c) and (d) or (b), (c) and (d) have the possibility of simultaneously issuing an access request to the bit map RAM, because it is necessary to create data of the next page during printing. Thus, there is provided a bus decision circuit for making decision of the access right to the bit map RAM, and the CPU can access to the bit map RAM by ignoring the timing during printing. The rewriting for each page can be made by providing two pages of bit map RAM for each color, that is, a page in which CPU creates the bit map data and a page in which CPU transfers print data to the head.

The functions of transferring data to the head include:

(a) Transfer of print data to head, (b) Transfer of pulse for adjusting the print density, and (c) Transfer of print alignment information of front and rear and left and right.

These functions can be operated independently of the CPU, no load of CPU increasing with the print speed.

Figure 32:
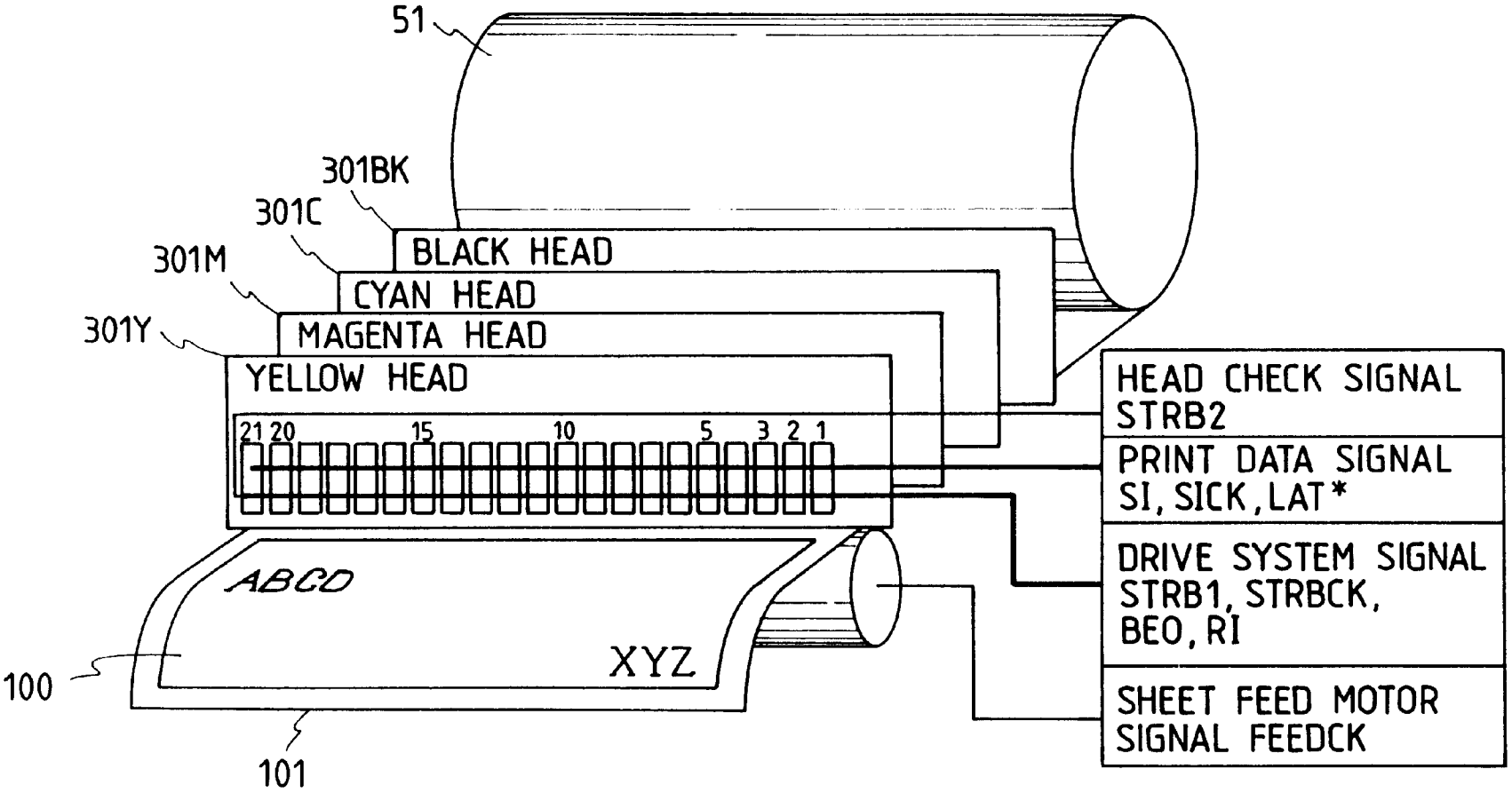
FIG. 32 is a conceptual view of a printing mechanism of the apparatus according to the embodiment.

FIG. 32 is a conceptual view of the print mechanism of the label printer in this embodiment.

Herein, a variety of methods are adopted for a black head for printing in black, a cyan head for printing in cyan, a magenta head for printing in magenta, and a yellow head for printing in yellow. For example, (a) Ink jet method of producing bubbles by the heat applied by the heaters within the nozzles and jetting the ink due to pressure generated by bubbles, (b) Ink jet method of filling the ink in the cylindrical piezo-electric elements and jetting the ink by shrinkage of piezo-electric elements, (c) Thermal transfer method of placing a heat melting film between the recording sheet and the heater and transferring the film color to the recording sheet by the heat applied by the heater, and (d) Thermal method of using thermosensible paper and coloring the recording sheet by the heat applied by the heaters.

In these methods the control method is fundamentally the same. That is, a control method of applying electric pulses to the head portion such as heater or piezo-electric element, and controlling the time of pulse and the voltage. In this embodiment, the method (a) is described below, but the same effects can be expected by other methods.

The printing is made for each one line in synchronism with the clock or FEEDCK signal, when the sheet is fed under these heads by the paper feed motor.

Figure 33:
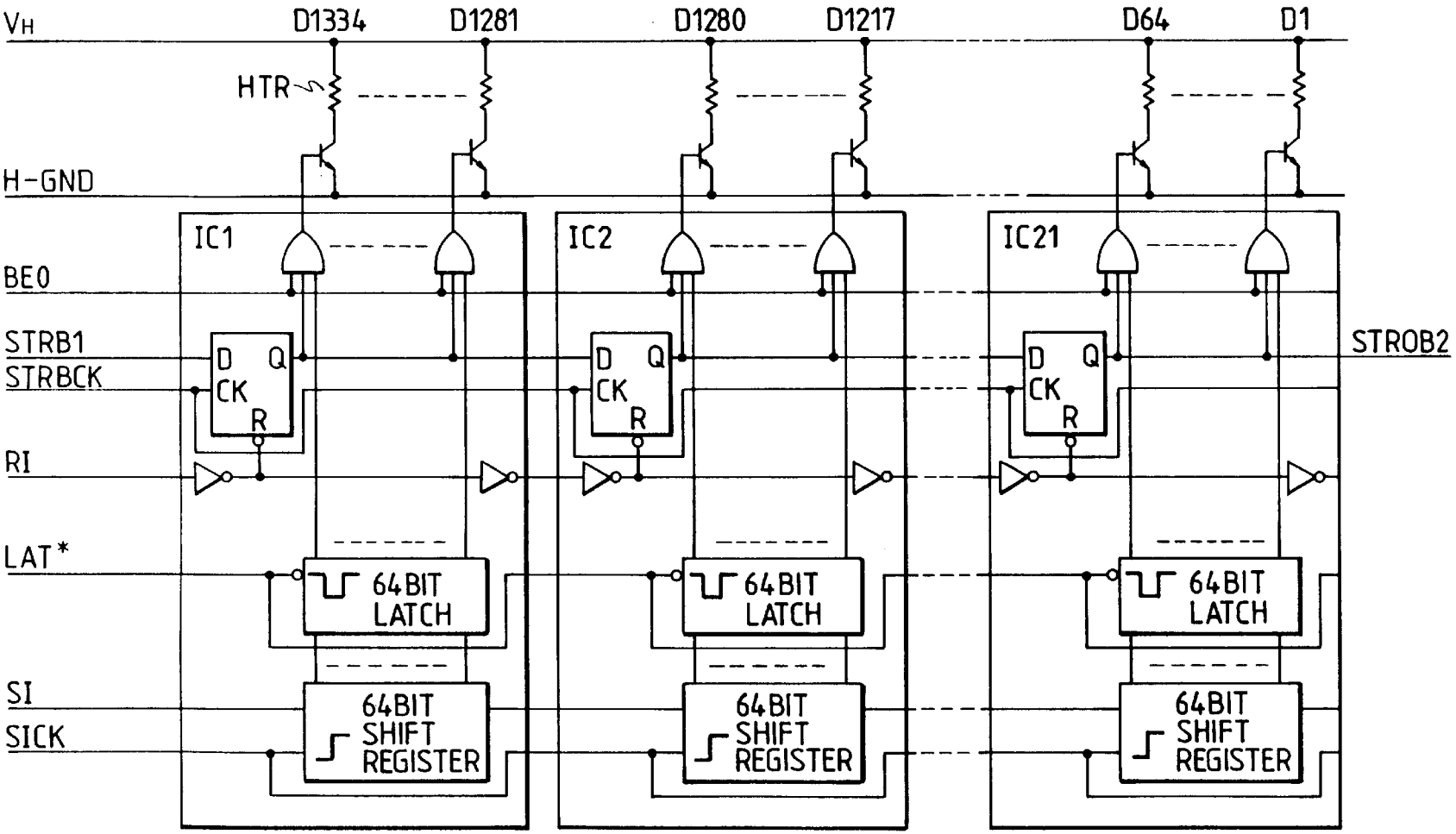
FIG. 33 is an equivalent circuit diagram of a head portion of the apparatus according to the embodiment.

FIG. 33 is an example of an equivalent circuit of the head portion. A heater HTR of the printing head is considered to be electrically a resistor, and indicated by the resistor. Also, there are installed twenty one ICs for controlling sixty four heaters 6, the total number of heaters 6 being 1344.

Print data is transferred in synchronism with an SICK signal by an SI signal. Data is shifted from D1 to D1344 by the shift register. After the completion of transfer, a LAT signal is input, and shifted data is temporarily held. The printing is controlled by units of 64 heaters 6, because an STRB1 signal and an STRBCK signal are made in shift register configuration of IC units. The reason why 1344 heaters 6 are not controlled simultaneously is that there is large current conducting to the heaters 6, and the electric power efficiency is enhanced by time-division driving.

Figure 34:
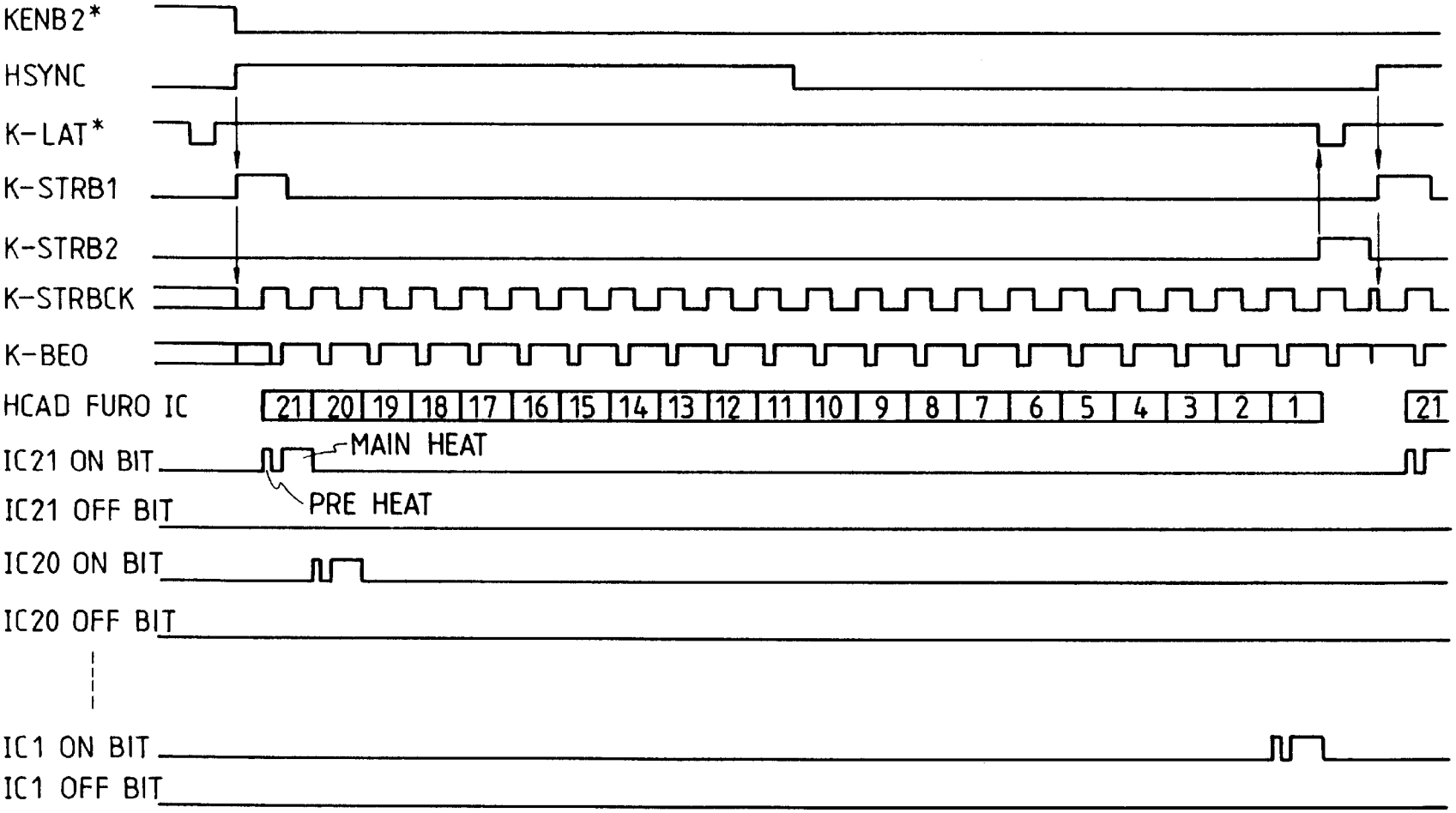
FIG. 34 is a timing chart of a print control signal to be supplied to the head.

FIG. 34 shows the timing of each print control signal to be supplied to the head. Note that the black head is exemplified herein, but other heads may be similarly applied. In the figure, KENB2*: Internal signal of head control circuit enabling the print operation, HSINC*: Internal signal of head control circuit generated for each printing line, K-LAT*: Signal for latching print data for one line simultaneously from the shift register within the head into the latch portion in the driver portion within the head, K-STRB1: Heat start signal of heater, K-STRB2: Confirmation signal informing that the heating of the total block of one line is completed, and output at the final state of the shift register to determine the heat block within the head, K-STRBCK: Signal to enable the heat operation for each one block by stepping each one block the "High" level of K-STRB1 to determine the heat period of heater, K-BE0: Signal to determine the time for heating within the heat period. In this example, the heat pulse divided into the preheat portion and the main heat portion is applied., IC21 on bit to IC1 on bit:

Printing pulse of heater to be heated from the 21-th block to the first block, and IC21 off bit to IC1 off bit:

Shows the state of heater not to be heated from the 21-th block to the first block.

Figures 35, 35A:
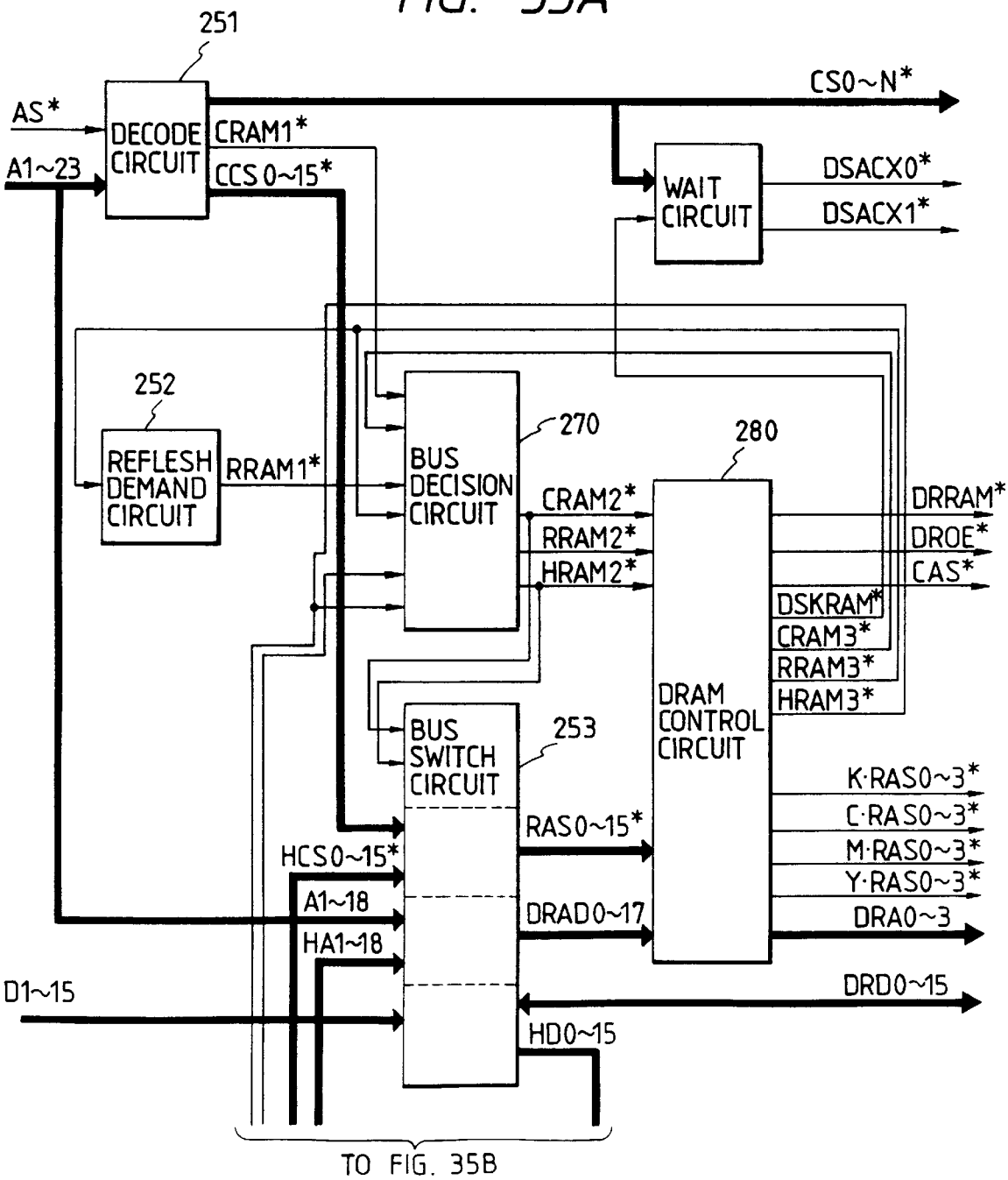
FIG. 35 is comprised of FIG. 35A and FIG. 35B showing block diagrams illustrating an internal constructional example of a head control circuit.
Figure 35B:
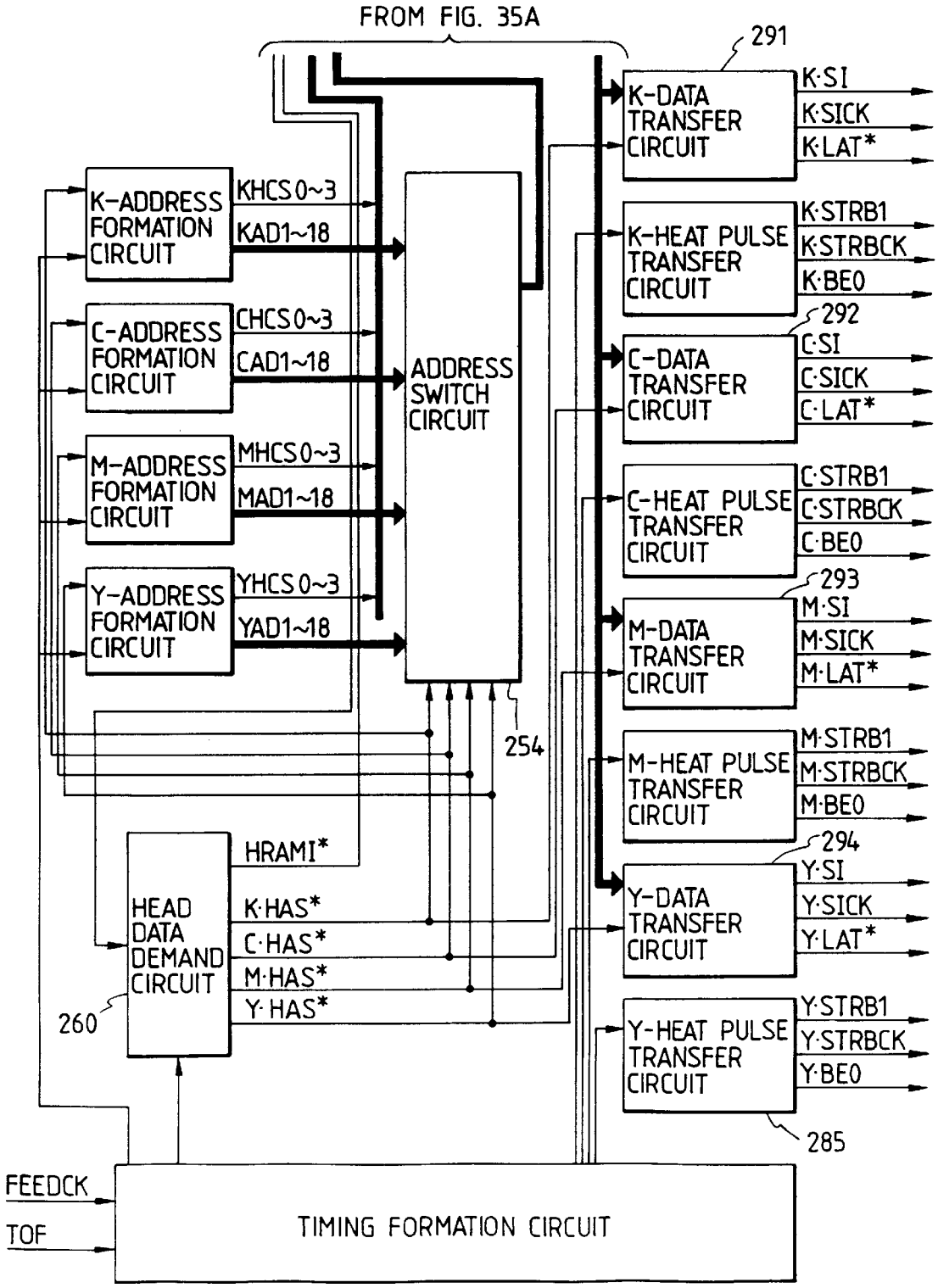

FIG. 35 is a block diagram showing an internal configurational example of a control circuit 157 of head, and in this embodiment, DRAM is used for the print buffer 158.

When the CPU 153 has access to the print buffer 158, an access signal CRAM1* is made active from a decode circuit 251. Also, the refresh operation of the print buffer 158 is performed with an access signal RRAM1* of a refresh request circuit 252 in the active state. Further, when transferring data to the head, an access signal HRAM1* of a head data request circuit 260 is made active. These three signals are input into a bus decision circuit 270.

The bus decision circuit 270 can have access to the print buffer 158 in accordance with a predetermined priority order in these three accesses. Each access method is controlled by a DRAM control circuit 280.

The bus decision circuit 270 controls the bus switching circuit 253, switching the CPU address buses A1 to A18 and the address buses HA1 to HA18 output from the address switch circuit 254 for head data, and outputting the address buses DRA0 to DRA17 for the print buffer 158. The bus decision circuit 270 likewise controls the bus switching circuit 253 to switch the CPU data buses D0 to D15 and the data buses HD0 to HD15 transferred to each color data transfer circuit 291 to 294, for the connection to the data buses DRD0 to DRD156 for the print buffer 158.

A chip select signal likewise switches between CCS0 to CCS15 and outputs RAS0* to RAS15*. During the printing operation, the head data request circuit 260 requires an access right to the printing buffer 158, its timing being permitted by the bus decision circuit 270, the address of each color being output from the bus switching circuit 270 to the printing buffer 158, whereby print data is output to the data buses HD0 to HD15, and transferred from each color data transfer circuit 291 to 294 to the head. With such series of operations, the print data can be accorded with the print context.

In the above operation, the operation timings are determined by a timing generation circuit 290. The timing generation circuit 290 is sent in synchronism with a FEEDCK signal which is sent to the paper feed motor. Herein, the paper feed motor has its feed amount correctly determined by the pulse control of a stepping motor or the like, but this pulse signal, or the FEEDCK signal, is also transferred to the timing generation circuit 290, the internal circuit being synchronized with reference to this FEEDCK signal. If the sheet is fed, a trigger signal for determining the print position, e.g., TOF (Top of Form), is detected, this trigger signal being transferred from CPU 153 to the head control circuit 157. The timing generation circuit 290 can correctly determine the print timings by counting the FEEDCK signal to the paper feed motor for the distance to Bk-head 301Bk upon the trigger signal. And at the timing at which Bk-head 301Bk prints, the timing generation circuit 290 transfers print data of the bit map RAM 158 to Bk-head 301Bk. Thereby, the printing in black is made. The paper feed motor 7 is further rotated to feed the paper. The timing generation circuit 290 determines the print timings by counting the FEEDCK signal of the paper feed motor for the distance from the Bk head 301Bk to the C head 301C. In the similar procedure, the print timings for the M head 301M and the Y head 301Y are determined to effect the printing.

The above sequence is a basic printing operation sequence, but if this sequence is implemented, the bit map RAM 158 will have the timing at which the writing operation and the reading operation from the CPU 153, and the reading operation for data transfer to each color head occur at the same time. Further, since the bit map RAM used is a low-priced DRAM, the refresh operation is required, and this operation may also occur at such a concurrent timing. Therefore, the circuit 270 for deciding these is necessary.

In this way, since the transfer of data to each color head during the printing is controlled by the hardware within the head control circuit 157, the CPU 153 basically does not need to have access to the print buffer 158 during the printing operation, with significantly reduced load, so that the high speed printing is allowed. Also, when the print data is different for each one page, two or more pages of the print buffer 158 are provided. While data in one page buffer is being printed, the CPU 153 makes the bit map development in another page buffer, whereby the continuous printing is allowed by switching the address of the print buffer 158 when transferring data to the head.

Also, the CPU 153 measures the processing time required to develop the print data for one page into the bit map RAM, and if the printing speed is preset so that the development processing time does not exceed the printing process time required to print one page, the efficient development and printing can be made, that is, the efficient development and printing is enabled by changing the printing speed in accordance with the amount of main data such as the bar code.

The setting of the print speed may be made at minute steps, or large steps such as 50, 100, 200 (mm/sec) (length of label printed for one second). Also, the setting of speed may be made such that the user can select it by a switch.

While this example is described with an instance where DRAM is used for the bit map RAM, it is noted that if the refresh request circuit 252 is removed even when using SRAM not requiring the refresh operation, the same effects can be obtained. Also, though the heads with four colors are presented, more heads can be controlled with the same construction.

In either case, in the high speed printer using the line head, the load of the CPU is reduced, and when there is a quantity of print data such as color print, or when different data for each page is printed, the high speed printing is allowed.

(3.4) Control procedure

Figure 36:
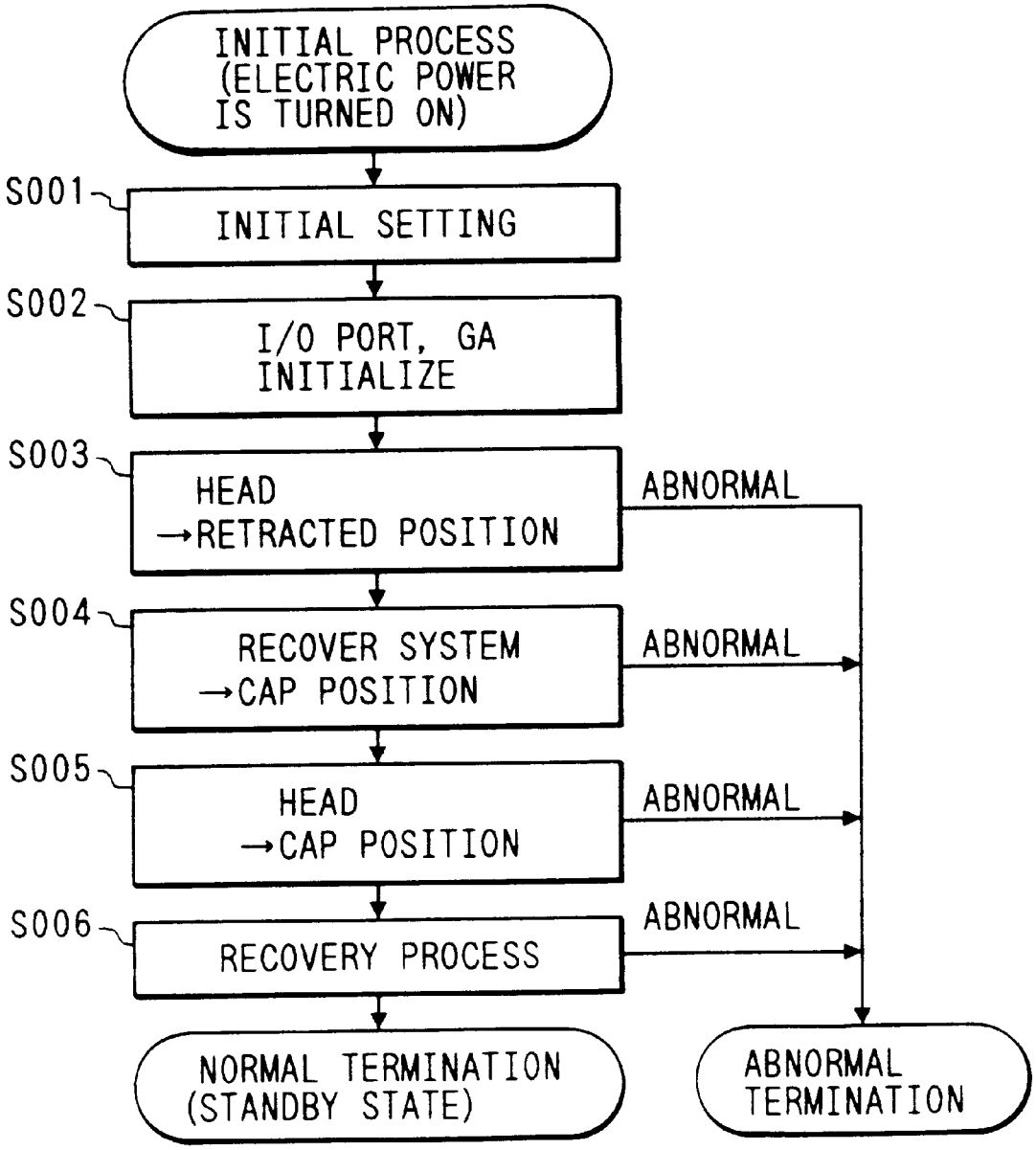
FIG. 36 is a flowchart showing an example of an initial processing procedure after turning on the power in the apparatus according to the embodiment.

FIG. 36 is a flowchart showing an example of initial processing procedure after turning on the power in this apparatus according to the embodiment. At step S001 after turning on the power, the initialization and the initial setting for the RAM 156 and the initialization of the print buffer 158 are effected. At step 8002, the initialization of I/O port 159 and the initialization of the head control circuit (hereinafter referred to as GA) are effected.

Then, at step S003, the print head block 68 is positioned to a retracted position (C) as shown in FIGS. 23A to 23D, after detecting the home position, by driving the head movement motor 79. If an abnormal condition such as a home position detection error occurs, the abnormal termination is made.

Similarly, at step S004, the recovery unit 78 is positioned at a capping position as shown in FIG. 23A, after detecting the home position, by driving the recovery unit movement motor 81. If an abnormal condition such as a home position detection error occurs, the abnormal termination is made.

Further, at step S005, the print head block 68 is positioned at the capping position as shown in FIG. 23A by driving the head driving motor 79.

Figure 39:
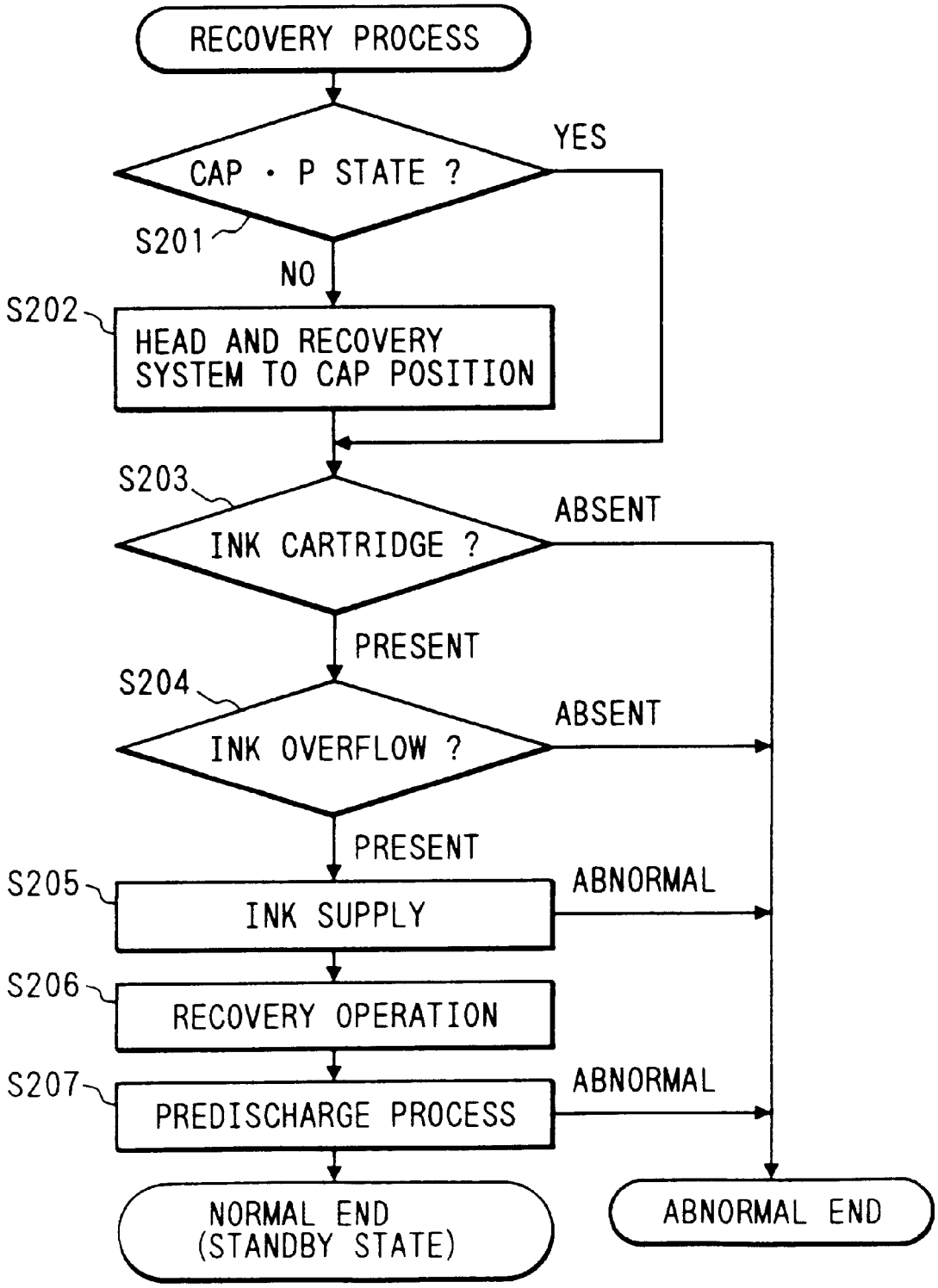
FIG. 39 is a flowchart showing an example of a recovery processing procedure in the apparatus according to the embodiment.

Thereafter, at step S006, the recovery process as described later with FIG. 39 is performed, and the procedure is placed in the stand-by state. If an abnormal condition occurs in the recovery process, the abnormal termination is made.

Figure 37:
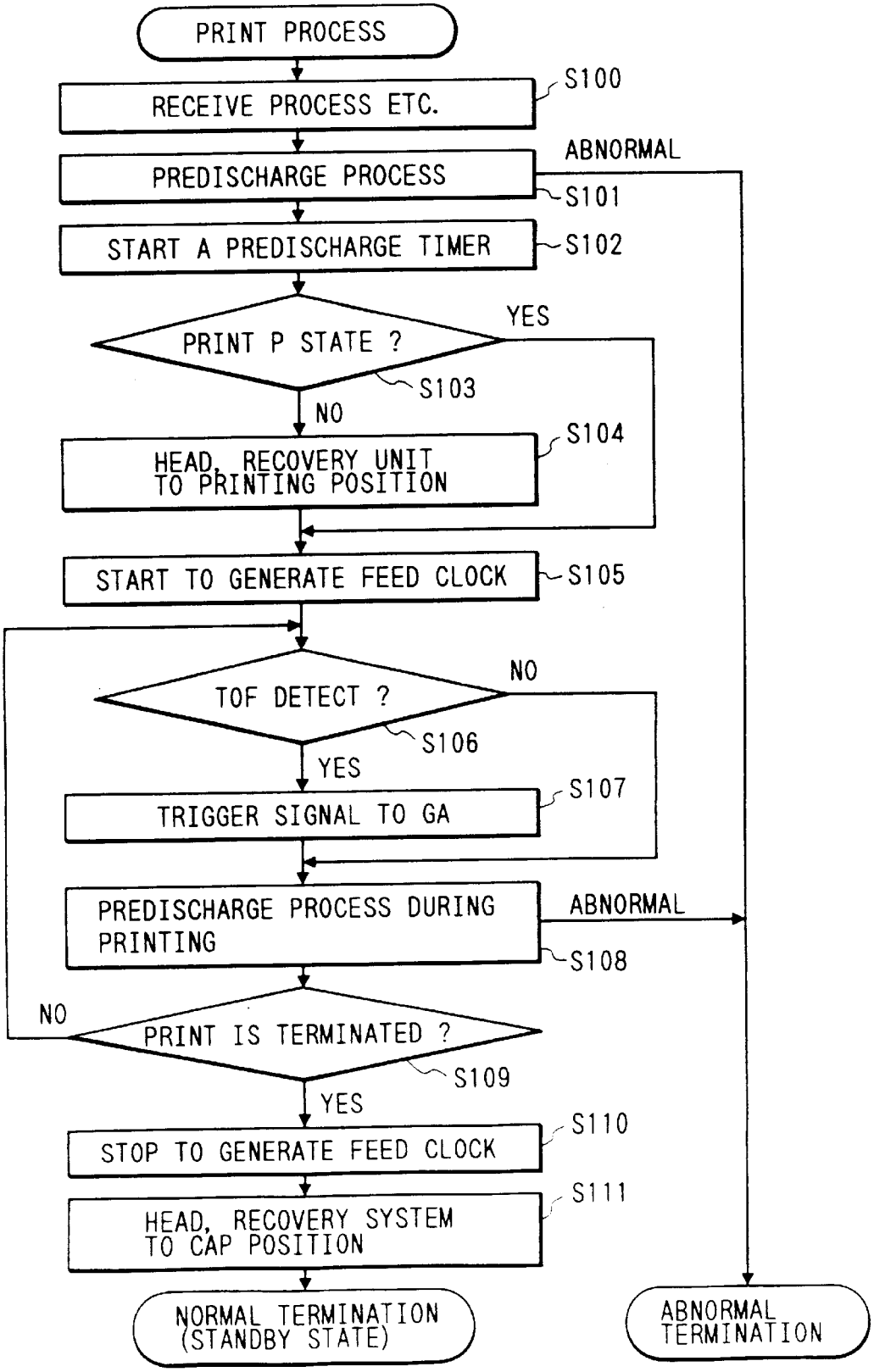
FIG. 37 is a flowchart showing an example of a print processing procedure in the apparatus according to the embodiment.

FIG. 37 is a flowchart showing an example of print processing procedure in the apparatus according to the embodiment.

If the print information is sent from the host computer 151, or a print command for the content stored in the memory card 90 is entered, its content is sent, and its information is stored in the RAM 156, the main CPU 153 performs the required processing such as bit map development into the print buffer 158, using the character code or bar code data within the ROM 155 based on that information.

Figure 40:
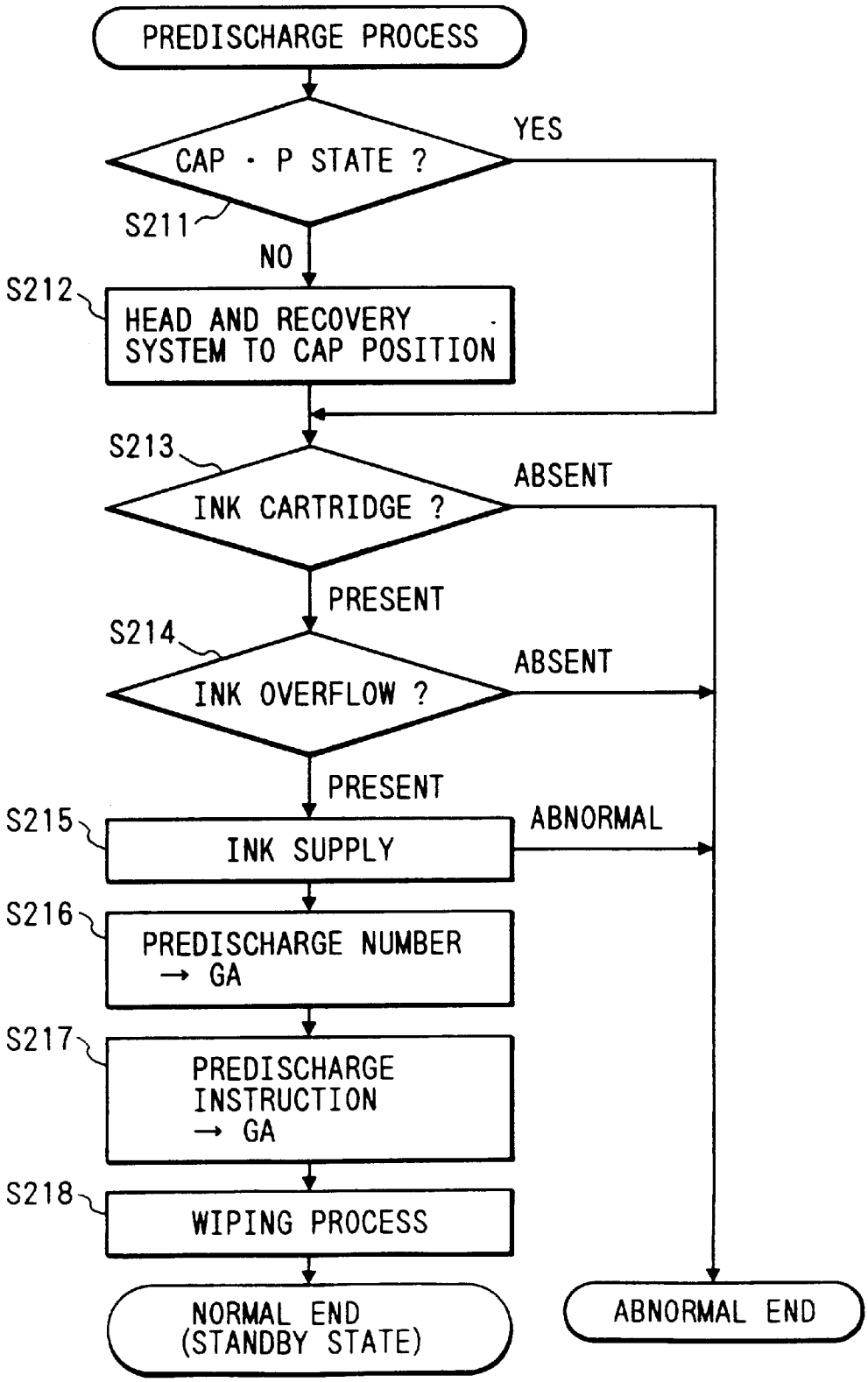
FIG. 40 is a flowchart showing an example of a predischarge processing procedure in the apparatus according to the embodiment.

Next or in parallel therewith, at step S101, the predischarge process as hereinafter described in FIG. 40 is performed. Herein, if an abnormal condition occurs in the predischarge process, the abnormal termination is made. Also, at step S102, a predischarge timer for defining the time interval of the predischarge operation is started.

Figure 23D:
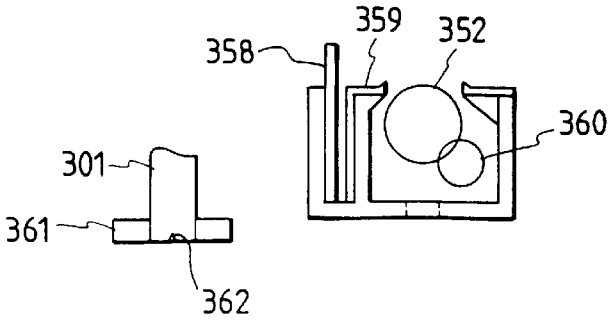

Then, at step S103, the positional states of the print head block 68 and the recovery unit 78 are investigated, and if they are not at the print position as shown in FIG. 23D, they are positioned at the print position by driving the recovery unit movement motor 81 and the head movement motor 79 at step S104.

Thereafter, at step S105, the supply of Feed Clock signal the drive circuit 159 and the head control circuit 157 is started. Herein, the Feed Clock signal is made variable in accordance with the speed table of each of speed-up, low speed, and slowdown for defining the preset conveying speed (e.g., such tables provided in a predetermined area of ROM).

If the Feed Clock signal is supplied, the conveyance of the sheet roll 51 is started. Along with this, at step S106, the TOP mark 103 is detected, and if detected, a-print trigger signal is given to the head control circuit 157 at step S107. Correspondingly, the head control circuit 157 performs the printing operation of the data within the print buffer 158. In doing so, the processing of the CPU 153 is not basically required, but the CPU 153 may intervene as required (hereinafter described).

Figure 38:
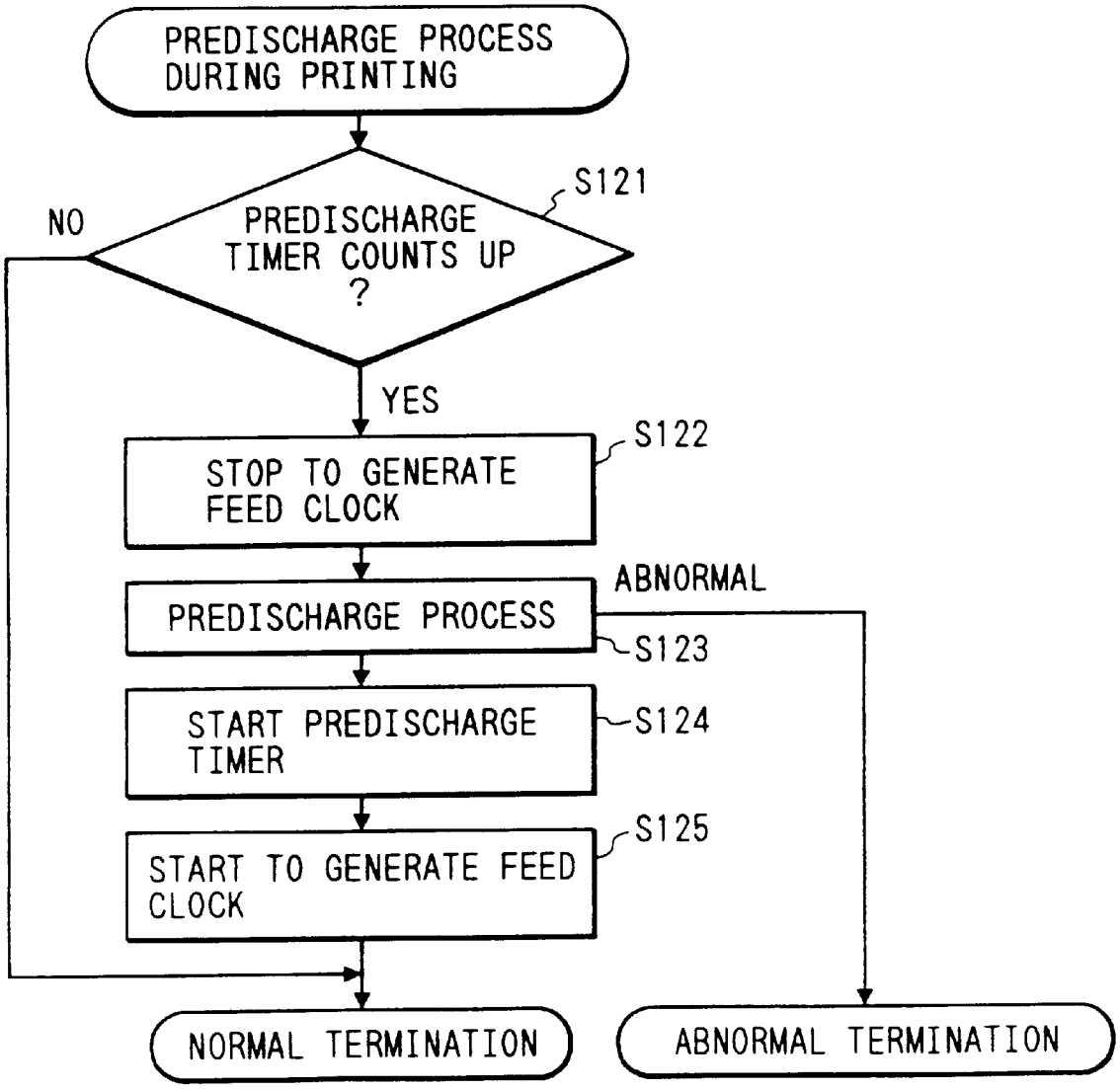
FIG. 38 is a flowchart showing an example of a predischarge processing procedure during printing in the apparatus according to the embodiment.

During the printing operation, a predischarge process during printing as shown in FIG. 38 is performed at step S108. If an abnormal condition occurs in the predischarge process during printing, the abnormal termination is made.

At step S109, a check is made to determine whether or not the printing operation is continued, and if continued, the procedure returns to step Sl06. Unless continued, the Feed Clock signal is stopped at step S110.

Finally, at step S111, the print head block 68 and the recovery unit 78 are positioned at the capping position as shown in FIG. 23A by driving the recovery unit movement motor 81 and the head movement motor 79.

FIG. 38 is a flowchart showing an example of predischarge process procedure during printing in the apparatus according to the embodiment, wherein this procedure can be initiated by the timer, the command, or the switch operation.

Initially, at step S121, if the predischarge timer for defining the time interval of predischarge has elapsed a predetermined time interval, the procedure proceeds to step S122, or otherwise the normal termination is effected.

At step S122, the Feed Clock signal is stopped.

Then, at step S123, the predischarge process as will be described later in FIG. 40 is performed. If an abnormal condition occurs in the predischarge process, the abnormal termination is made.

Thereafter, at step S124, the predischarge timer for defining the time interval of predischarge is restarted.

Finally, at step S125, the supply of the Feed Clock signal to the drive circuit 159 and the head control circuit 157 is restarted.

FIG. 39 is a flowchart showing an example of recovery process procedure in the apparatus according to the embodiment.

Initially, at step S201, the positional states of the print head block 68 and the recovery unit 78 are investigated, and if not at the capping position as shown in FIG. 23A, they are positioned at the capping position by driving the recovery unit movement motor 81 and the head movement motor 79 at step S202.

Then, at step S203, the presence or absence of a cartridge is examined by a cartridge presence/absence sensor 311, and if there is a cartridge that is not detected, the abnormal termination is made. Of course, a cartridge is provided for each color.

Thereafter, at step S204, if the overflow is detected by an overflow sensor 305, the abnormal termination is made.

Further, at step S205, the ink supply is made. An ink level sensor 306 and the overflow sensor 305 are examined every time an ink pump 308 is caused to rotate in a supply direction by the preset number of rotations, and if the overflow sensor 305 is in the undetected state and the ink level sensor 306 is in the detected state within the preset total number of rotations, the procedure proceeds to step S206, or otherwise the abnormal termination is made. Of course, the ink supply is made for each color.

And at step S206, the recovery operation is made. The recovery system motor 357 is initiated, and after the ink pump 308 is caused to rotate in a recovery direction by the number of rotations which can be determined by the time interval for the recovery operation, the recovery system motor 357 is stopped. Naturally, this rotational operation is made for each color.

Finally, at step S207, the predischarge process as shown in FIG. 40 is effected. If an abnormal condition occurs in the predischarge process, the abnormal termination is made.

FIG. 40 is a flowchart showing an example of predischarge process procedure in this apparatus according to the embodiment.

Steps S210 to S215 are identical to steps S200 to S205 of FIG. 39.

Then, at step S216, the number of discharging discharge pattern data for the predischarge recovery which can be determined by the time interval of the predischarge operation is given to the head control circuit 157. And at step S217, an instruction of predischarge operation is given to the head control circuit 157.

Figure 41:
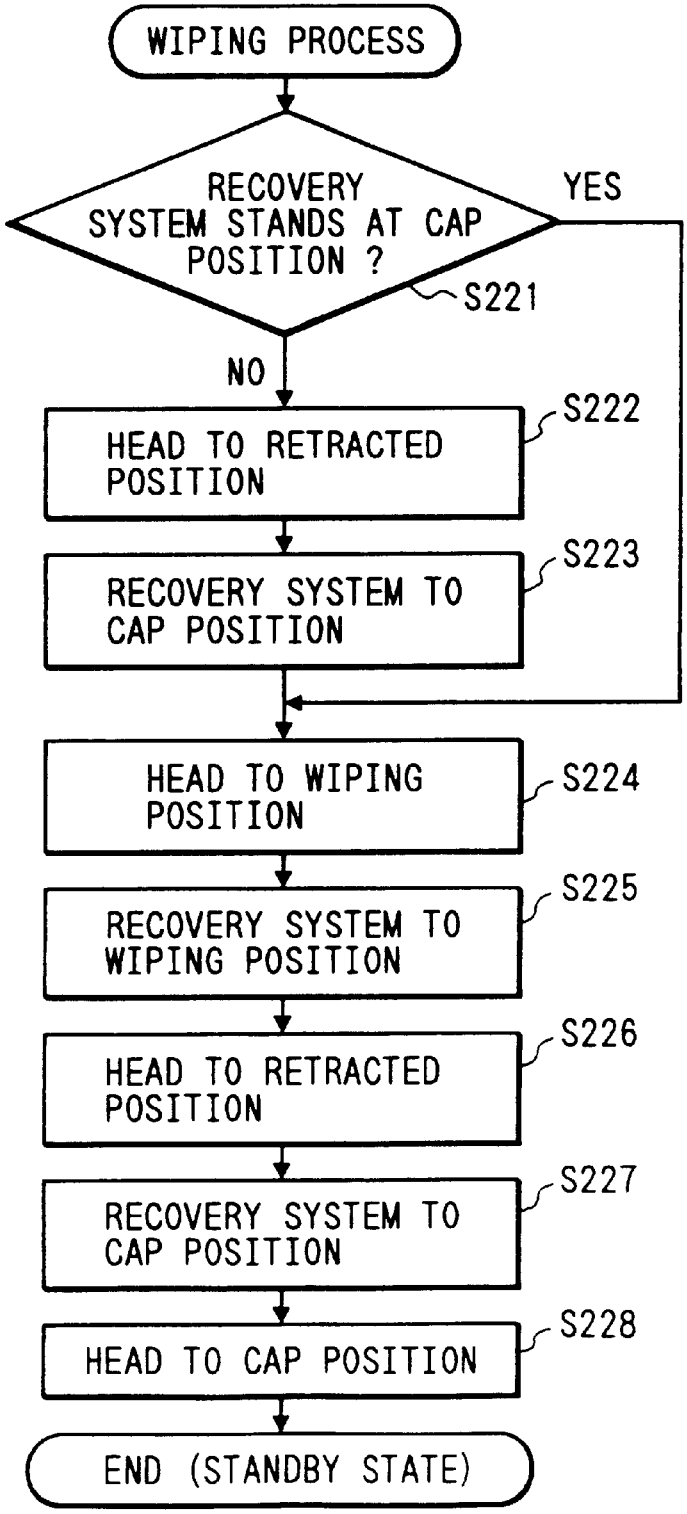
FIG. 41 is a flowchart showing an example of a wiping processing procedure in the apparatus according to the embodiment.

Finally, a t step S218, the wiping process as shown in FIG. 41 is performed.

FIG. 41 is a flowchart of the wiping-process of the present invention.

Initially, at step S221, the positional state of the recovery unit 78 is examined, and if not at the capping position as shown in ° FIG. 23A, the print head block 68 is positioned at the retracted position as shown in FIG. 23C by driving the head movement motor 79 at step S222. Then, at step S223, the recovery unit 78 is positioned at the capping position as shown in FIG. 23A by driving the recovery unit movement motor 81.

Thereafter, at step S224, the print head block 68 is positioned at the wiping position as shown in FIG. 23B by driving the head movement motor 79. Then, at step S225, the recovery unit is positioned at the wiping position as shown in FIG. 23B by driving the recovery unit movement motor 81.

Finally, at step S226, the print head block 68 is positioned at the retracted position as shown in FIG. 23*c* by driving the head drive motor 79. Then, at step S227, the recovery unit 78 is positioned at the capping position as shown in FIG. 23A by driving the recovery unit movement motor 81. Then, at step S228, the print head block 68 is positioned at the capping position as shown in FIG. 23A by driving the head movement motor 79.

(4) Development control based on the data content

When a plurality of pieces of print data are developed on the sheet (label 100) by specifying the relative position, owing to the print data having the redundancy such as character information, the positional deviation of other print data may occur, or when a plurality of pieces of print data are developed thereon by specifying the absolute position, print data areas may be specified in overlap, causing troubles in making the design of label and creating the print data.

Thus, in the apparatus according to the embodiment, the received command is classified into an exclusive command indicating that enlargement or contraction (variable magnification) of data is not permitted and an exclusible or excludable command indicating that a certain extent of variable magnification is permitted, storing individual developed area values for the exclusible command, changing developed area values stored when executing the development for the exclusive command, and developing data in accordance with the developed area values stored when executing the development for the exclusible command, wherein for the data having a certain degree of variability in the magnification or height such as in the printing of bar code data, the magnification or height of the bar code data is changed to cope with the competitive conditions with other print data.

FIGS. 42A to 42C show the areas provided in a predetermined area of RAM 156, wherein FIG. 42B is an exclusive command table for storing the exclusible command as shown in FIG. 42A within a reception buffer (which can be provided in RAM 156 of FIG. 30), and FIG. 42C is a developed area table for storing developed area information within the print buffer 158 for the exclusible command.

Figure 43:
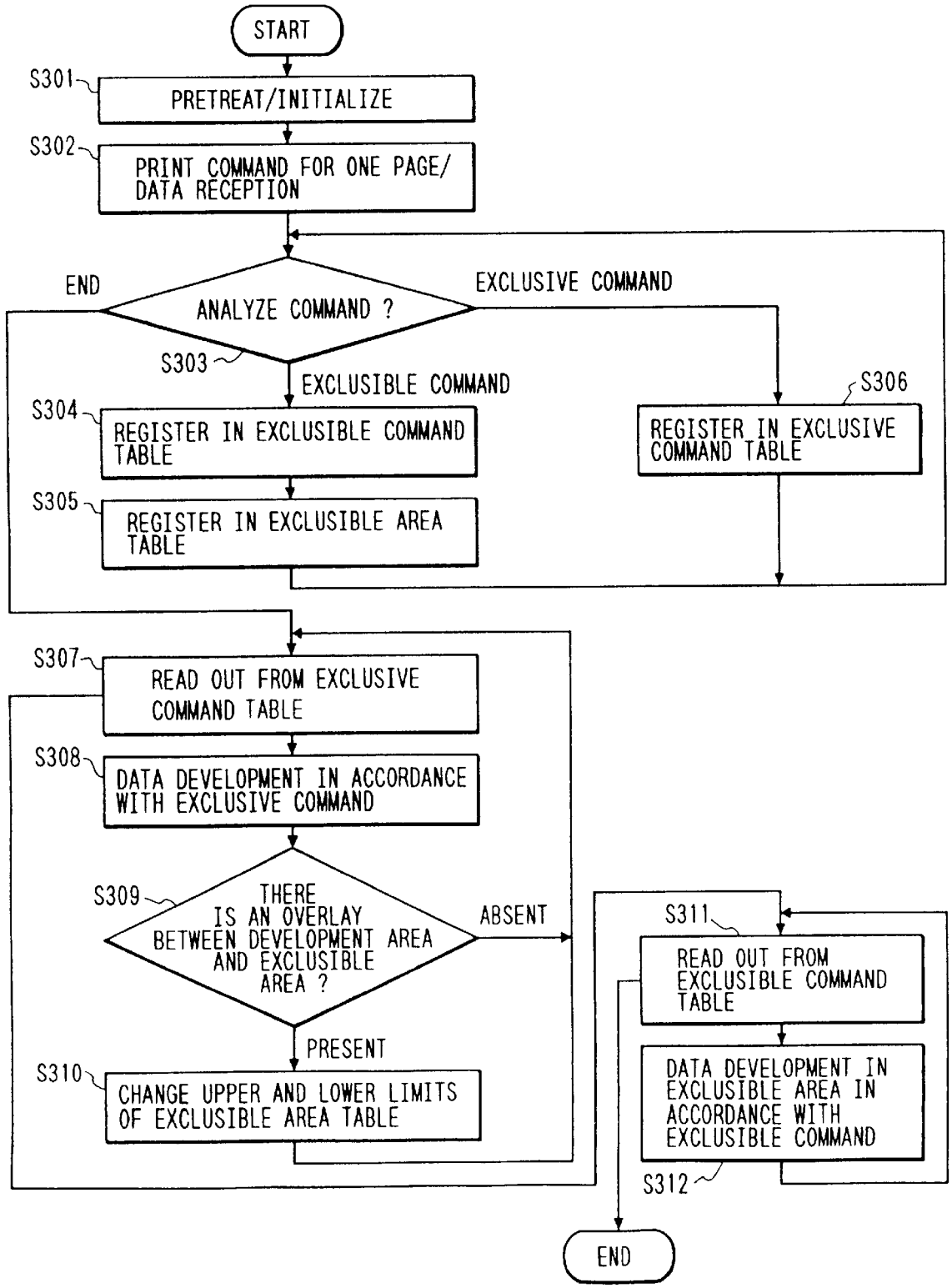
FIG. 43 is a flowchart showing an example of a development control procedure.

FIG. 43 is a flowchart showing an example of development control procedure in this embodiment, which can be positioned as a procedure forming a part of step S100 in FIG. 37.

At step S301, the initialization of reception buffer, exclusible command table, exclusive command table, developed area table and print buffer 158 is performed.

Then, at step S302, the print command/data for one page is entered and stored in the reception buffer.

Thereafter, at step S303, the print command stored in the reception buffer is classified into the exclusive command or the exclusible command. If the print command is an exclusible command, the exclusible command is registered in the exclusible command table at step S304, and the rectangular information of developed area where data corresponding to the exclusible command occupies in the print buffer 158 is registered in the developed area table at step S305. Then the processing returns to step S303. If the print command is an exclusive command, the exclusive command is registered in the exclusive command table at step S306, and the processing returns to step S303. When the classification is terminated, the processing passes to step S307.

At step S307, each of exclusive commands registered in the exclusive command table is called. At step S308, corresponding data is developed in the print buffer 158. At step S309, a check is made to determine whether or not the developed area is overlapped longitudinally with the developed area of the exclusible command registered in the developed area table, and if not overlapped, the processing returns to step S307. If overlapped, the upper and lower limits of the rectangular information stored in the developed area table are changed not to cause any overlap at step S310, and the processing returns to step S307. If the development of all exclusive commands is completed, the processing transfers to step S311.

At step S311, each of the exclusible commands registered in the exclusible command table 7 is called. At step S312, corresponding data is developed in the print buffer 158 in accordance with the rectangular information stored in the developed area table, and the processing returns to step S311.

If the development of all exclusible commands is completed, the data developed in the print buffer 158 is printed. The effects of this embodiment are illustrated in FIG. 45A.

Figure 44:
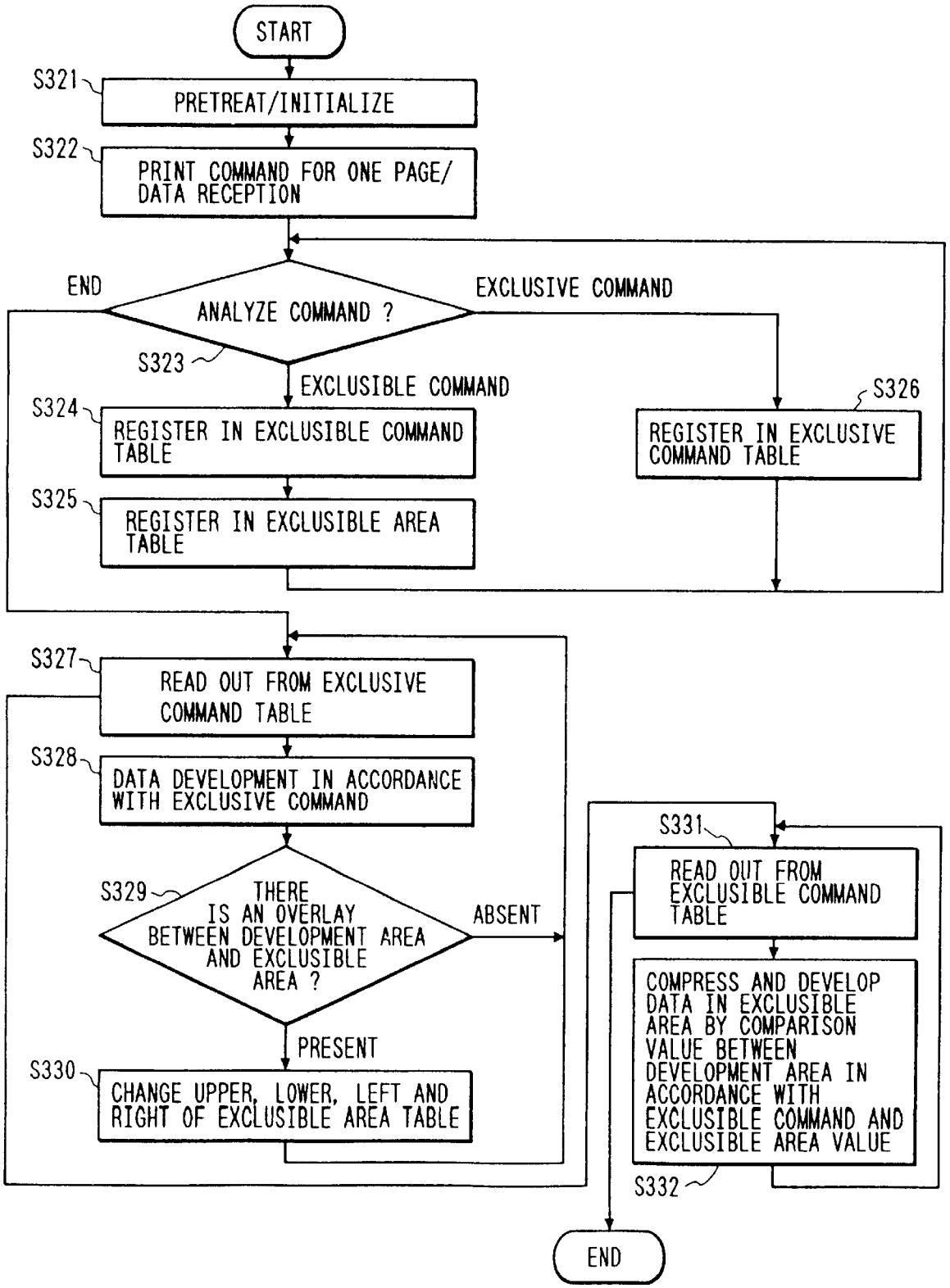
FIG. 44 is a flowchart showing another example of development control procedure.

FIG. 44 is a flowchart showing another example of development control procedure in this embodiment.

In FIG. 44, steps S321 to S328 are identical to steps S301 to S308 of FIG. 43, and will not be described.

In FIG. 44, at step S329, a check is made to determine whether or not the developed area is overlapped with the developed area of the exclusible command registered in the developed area table. If not overlapped, the processing returns to step S327. If overlapped, the upper and lower, left and right limits of the rectangular information stored in the developed area table are changed not to cause an overlap at step S330, and the processing returns to step S327. If the development of all exclusive commands is completed, the processing transfers to step S331.

At step S331, each of the exclusible commands registered in the exclusible command table 7 is called. At step S332, corresponding data is compressed and developed in the print buffer 158 in accordance with the ratios of the developed area instructed by the exclusible command to the rectangular information stored in the developed area table in the upper and lower direction and the left and right direction, and the processing returns to step S331.

If the development of all exclusible commands is completed, the data developed in the print buffer 158 is sent to the printing head, not shown, and stored in the printing medium, like the above example. Note that the effects of this example are illutrated in FIG. 45B.

For two examples as above presented, it will be appreciated that the reception buffer may be read twice, without setting the exclusible command table and the exclusive command table. Also, at step S310 of FIG. 43 and step S330 of FIG. 44, the change of the upper and lower limits, the left and right limits of the rectangular information stored in the developed area table may be restricted.

Also, it is conceived that the information such as character may be magnified variably, but if the reading is difficult, the bar code which is relatively variable is changed.

(5) Addition of special data (5.1) Addition of printer specific data

When using a plurality of label printers, it is often desired to know by which printer the printed label is issued. That is, when there occurs some nonconformity on the label such as a print failure, a quick measure such as making maintenance by designating the print is allowed if it is possible to know at a glance by which printer the label is issued.

Thus, in this embodiment, when the input data is stored in the print buffer 158, the specific information corresponding to each printer is stored at the same time, and the printer which has printed the label can be determined by printing its specific information in quiet color (drop-out color). Also, the reduction in quality is avoided by printing in drop-out color.

For this purpose, for example, the format of the registration number of apparatus may be stored in the ROM 153 of FIG. 30, or EEPROM is provided separately, or the RAM backed up by a battery is provided to store the format, and when developing data, the format is also developed at the same time.

FIG. 46 is a format example of the registration number of apparatus, in which the registration number SD (herein "7-24-JD018") of the apparatus is set in a certain pattern on the label 100. The buffer for yellow may be set such that the registration number of apparatus with such a pattern is always printed in yellow, and other data is printed in a color as set by the user. Thereby, when a failure such as undischarge is detected on the label issued by multiple label printers, it is possible to determine at a glance which apparatus has failed.

While the registration number is overprinted in yellow in this method, it is to be noted that the same effects can be attained by the number of dots simply printed in yellow. In this case, the printer can be discriminated by referring to the number of yellow dots on a fixed site (e.g., right lower corner) of the label to be printed, such that the first label printer prints one yellow dot and the second label printer prints two yellow dots on that site, for example.

It is also possible to change partially the color of data to be printed on the label as far as there is no inconvenience, rather than adding such special data itself.

In either way, in the case where the same kind of labels are printed by multiple printers due to the printer productivity, if a trouble that the label is not readable by scanner occurs, the printer that has printed that label can be designated, so that the disposition such as repair can be smoothly made. Also, in the case where the same kind of labels or the products having such labels pasted are delivered from a plurality of traders concerned, it is easy to judge from which trader the defective label is delivered, if any.

(5.2) Data change for designation of label group

In the label printer, a series of printed labels may be wound around another roll, each label used by peeling as necessary.

The printer of this embodiment can print successively data on the labels 100 bonded on the release sheet 101, but print data change may happen half way through. Thus, in achieving the desired object by peeling the label, it is desired to distinguish that change in a simple manner. For this purpose, it is conceived that the information concerning the data content that has been previously printed or will be printed later is printed on one label between labels subjected to data change or between label groups, but that label is not employed for its essential uses, and consumed wastefully.

Thus, in this embodiment, by changing partially or totally the print color data, among data to be printed (hereinafter referred to as the regular print data), to create discrimination print data, the discriminating label having only the color information changed can be output in a simple operation between regular print labels of different contexts by performing the printing of discriminating label based on discrimination print data before or after the printing operation based on the regular print data. Further, this discriminating label is changed in only the color information, as compared with the label by regular printing (hereinafter referred to as the positive label), giving rise to the effect that it can be similarly used as the positive label.

FIG. 47 is an example of the printable context in the apparatus according to the embodiment. This example shows as a model a typical label which the manufacturer attaches to the goods for foodstuffs.

A frame 520, a ruled line 521, titles of items 522 to 528, a bar code 529 in which product information is coded are printed in black, other pieces of print information 530 to 539 are printed in red.

Generally stating the print control, the print data stored in the RAM 156 is developed into the print buffer 158 as the drawing data. The print buffer 158 is comprised of a memory for storing data for each color, the CPU 153 controls the head control circuit 157 and the driving circuit 164 to perform the printing in accordance with the print data, so that a predetermined number of labels as shown in FIG. 47 are output.

By the way, in this embodiment, the discriminating labels are output successively before or after printing the above-mentioned label. Herein, an instance where the discriminating print label is output before printing the regular print label is described. For the clarity of explanation, the context of discriminating label is output to be exactly the same context as the regular print context in a single color or black, but a certain specific portion, e.g., the frame only, can be output in a special color to have the discriminating print label, which is of course contained within the technical scope of this embodiment.

FIG. 48 is a flowchart showing an example of processing procedure for making such control.

First, at a time at which print data input is completed (step S100 of FIG. 37), the number A of sheets to print the data is set to a counter. This counter may be constructed by hardware or provided in a predetermined area of the RAM 156. Then, a check is made to determine whether or not the discriminating label is output at step S401. Since the discriminating label may be unnecessary depending on the use mode, this step is necessary. Note that the discriminating label is output firstly among the number A of print labels in this embodiment. When printing the discriminating label, "1" is set to a flag SF provided in the predetermined area of the RAM 156, and further, the total number of prints "m" which is the set number of the counter is changed to "m+1" (step S403). When not printing the discriminating label, SF=0 is set (S405). If the printing is started, "0" is set to a predetermined print flag n, while at the same time the memories within the print buffer 158 corresponding to the color for use in this embodiment are refreshed (the memories are provided for black and red in this embodiment, and referred to as frame memories 505*a*, 505*b*).

At step S409, a check is made to determine whether or not the SF flag is on, in which if SF=1, all the print data is developed in a print buffer memory for black, irrespective of the print color data set in the print data (step S411). If SF=0, the black print data is developed in a frame memory for black 505*a* within the print buffer 158, based on the data stored in the RAM 156, and the red print data is likewise developed in a frame memory 505*b* (S413).

Then, the print control and the drive control are performed based on the data developed in the frame memories 505*a*, 505*b* (S415) to print the first print label. Every time one label is printed (S417), n is incremented by 1 (S419).

At this time, when the output of the discriminating label is specified, the discriminating label which is printed totally in black is output, or when it is not specified, the print label according to print data can be obtained.

At step S421, a check is made to determine whether or not the whole number of print labels has been completed, and if the number of print labels is less than the set number, the procedure proceeds to step S423. If not, the printing is ended.

At step S423, a check is made to determine whether or not there is the output of the discriminating label, and if there is no output, the data currently stored in the frame memories 505*a*, 505*b* is directly used and printed by making the print control again. In the case where discriminating label is not output (SF=0), this flow is repeated, and at a time when the number of print labels n is equal to m, the printing operation is stopped. In practice, the driving motor is still operating in the printing apparatus, until the print label is output to the outside of the apparatus.

At step S423, when the output of the discriminating label is set, the procedure proceeds to step S425, where a check is made to determine whether the discriminating label is only output, or the regular print data is developed in the frame memory, that is one regular label is output.

That is, this is a step of eliminating the developing time by directly entering the print control operation, since there is print data developed on the frame memory if the regular label has been already output.

In this way, the separation between labels having different print contexts is facilitated by printing the discriminating label before the regular label, and the discriminating label is fit for the actual uses, because the context of discriminating label is changed from the regular print context with only the color information, so that the very effective discrimination between labels can be attained.

For example, in most cases, a number of labels to be pasted on the products are printed beforehand, and their pasting on the products is conducted separately. Therefore, when there are ten kinds of products, for example, the usage of printing ten kinds of labels, fifty sheets for each kind, is adopted.

In such a case, as most labels have the similar contexts, it is not easy to distinguish between the labels of different kinds. Accordingly, if there is the label with the noticeable separation, the separation is easily found, offering the advantage that the handling after printing is favorable.

Note that in view of the reduction in detection accuracy, only the bar code is not changed in color in this embodiment. Also, the discriminating label is provided with the discriminating nature in the practical range to attain the saving of the labels.

Note that the color may be partially changed for each kind of labels in units of certain sheet number. Further, the partially changed color is usable for not only the discrimination of the label but also the confirmation of lot, or the product having is pasted.

Note that when multiple kinds of labels are printed in units of certain sheet number, and wound for use, the later printed labels are used more early. Therefore, it is preferable to print finally the discriminating label for some labels in using them by winding.

(6) Label discrimination

In the printer having the labels bonded in succession on the release sheet as the printing medium, it is preferable to select various shapes of labels in accordance with the print format or the information quantity to be printed and mount them on the printer. On the other hand, if the shape of label mounted does not accord with the print format, the printing occurs in the area outside the label, thereby causing the problem of contaminating the platen, degrading the print quality, or shortening the life of printer. Therefore, it is required to judge the shape of label inside the printer.

As shown in FIGS. 24A to 26B, an optical sensor for scanning across the entire surface of the release sheet is provided in the conveying passageway of label in this embodiment. Also, a label shape detecting circuit for detecting the shape of label with the voltage detected by the optical sensor is provided. Further, a label shape judgment circuit for judging whether data of the label shape detecting circuit is fitted with the print data is provided, and a control circuit for controlling the printing operation by the label shape judgment circuit is provided.

In the example of FIGS. 24A and 24B, an optical sensor is disposed between the printing portion and the label exhausting portion in the label conveying passageway. Correspondingly, a print detection circuit for detecting the printed matter on the label, a print judgment circuit for judging whether to coincide with the print data, and a control circuit for controlling the printing operation by the print judgment circuit are provided.

Herein, the optical sensors include the reflection type and the transmission type. For example, the optical sensor of reflection type reflects the light entering from one side at the detection surface, and the intensity of reflected light is detected and converted into the voltage which is output. Since the reflectance of the release sheet and that of the label are different, the detected voltages are different. By detecting this difference, the shape of label can be judged.

The optical sensor of transmission type transmits the light entering from one side through the detection surface, and makes judgment in accordance with the intensity of the light received by the optical sensor provided on the opposite side. Since the transmittance of the release sheet and that of the label are different, the shape of label can be judged by detecting such a difference.

In the confirmation method of the print data such as the bar code, the print data includes the printing position of the bar code, because predetermined print formats are prerecorded inside the printer. The correctness of the printing can be judged-by measuring the detected voltage of a label detector at this position. Since the detected voltage is different with the print color, it is necessary to be preset, and may be set when manufacturing the printer.

Figure 49:
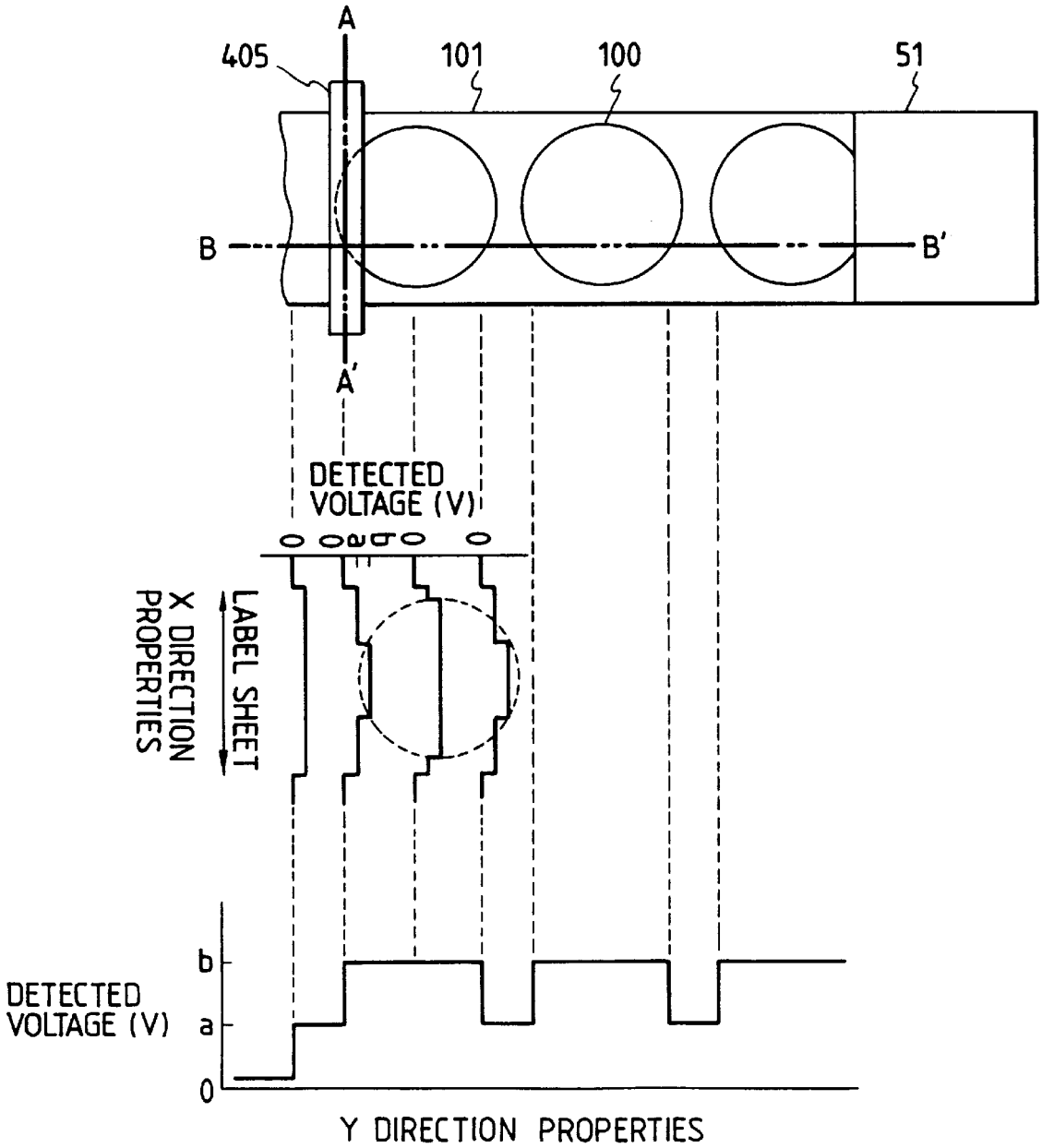
FIG. 49 is a conceptual view of the operation of the optical sensor as-shown in FIGS. 24A and 24B.

FIG. 49 is a conceptual view of the operation of the optical sensor as shown in FIGS. 24A and 24B. The release sheet 101 passes under the optical sensor 405. Then the detected voltage of the optical sensor 405 is determined by the reflectance of the roll sheet 51. The detected voltage properties in the X direction when the optical sensor 405 is at a position of A–A' will be described below. Since the light is not reflected outside the release sheet 101, the detected voltage is 0V. The release sheet 101 is composed of the coat sheet of yellow or blue color, against which the light is reflected. Accordingly, the detected voltage is not 0V, but aV. Further, the label 100 is composed of the white paper, at which a detected voltage of bV can be obtained. Also, by detecting the Y direction properties when the optical sensor 405 passes through a position of B–B', there is obtained a similar difference in detected voltage between the release sheet 101 and the label 100. The shape of label can be detected by a combination of detected voltages in the X direction and the Y direction.

Next, the circuit configuration and its operation for, checking the adaptability to the print format will be described below.

Figure 50:
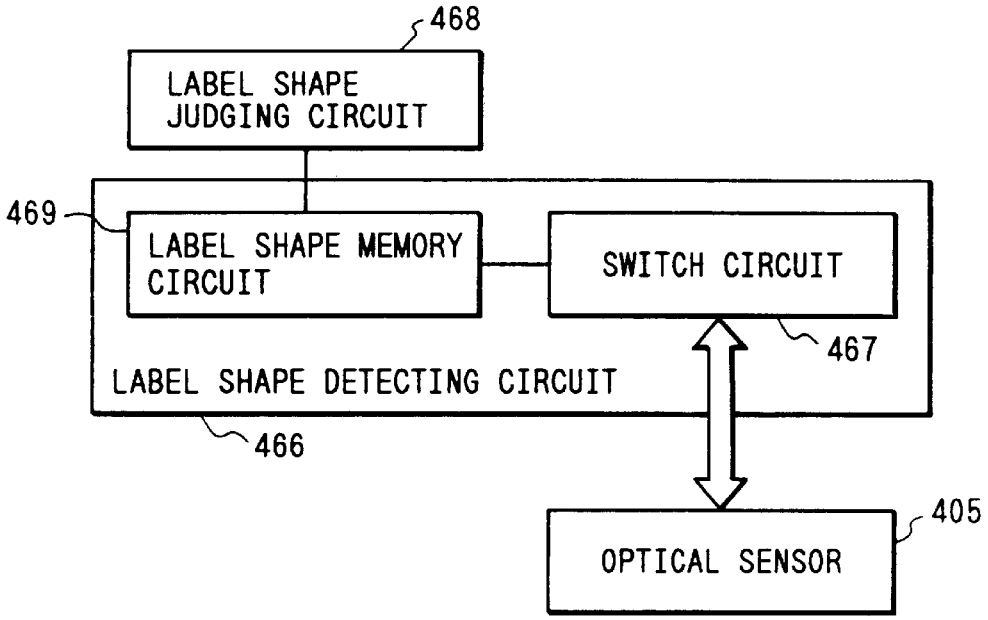
FIG. 50 is a block diagram showing a circuit configuration for judging the adaptability of a label sheet to the print format.

FIG. 50 shows an example of the circuit configuration, which is made in connection with the sensor circuit 167 of FIG. 30.

The roll sheet 51 is mounted on the printer, and if the print start is selected on the operation panel, the CPU 153 causes the paper feed motor to be rotated via the I/O port 159 and the driving circuit 164 to feed the roll sheet 51, wherein the voltage corresponding to the shape of label is generated in the optical sensor 405. This voltage is processed by a label shape detection circuit 466. The label shape detection circuit 466 is comprised of a switch circuit 467 and a label shape storage circuit 469. When the roll sheet 51 comes to the position of the optical sensor 405, the switch circuit 467 selects one of the optical sensors 405 installed linearly to measure the X direction properties of the optical sensor 405 and connects a selected optical sensor 405 to the label shape storage circuit 469. The label shape storage circuit 469 makes a comparison between the voltage level aV and bV, as shown in FIG. 49, and if at the bV level, it is stored as the label 100 exists. After termination of storage, the label shape storage circuit 469 requests the switch circuit 467 for the next data. The switch circuit 467 selects one of the optical sensors 405 installed linearly and make the same operation. When the detection of data for one line of the optical sensor 405 is terminated by repeating the above operation, the CPU 153 causes the paper feed motor to be rotated to feed the roll sheet 51 by a predetermined length. By repeating the detection method as above described, the X direction and Y direction properties are stored in the label shape storage circuit 469. The feed amount of the roll sheet 51 is determined by the resolution of the optical sensor 405 and the required accuracy. That is, when the labels 100 of complex shape are mounted, the feed amount is reduced, and in simpler cases, the feed amount is increased. The termination of the label 100 can be judged by the detected voltage of the optical sensor 405. That is, when the portion of the voltage level bV disappears, the roll sheet is at the end position.

When the detection of one label 100 is terminated, the CPU 153 makes a collation between the data in the RAM 156 and the data in the label shape storage circuit 469 in the label shape judgment circuit 18, and if they are identical, the procedure transfers to the printing operation. If not identical, the content of error can be displayed on the operation panel, or transferred via the data transmission/reception unit 152 to the host computer 151 or the control panel 154.

With the above operation, the printer judges whether or not the shape of label 100 is fitted with the print format, and only if it is fitted, the printing can be performed.

A confirmation method of the print data e.g., the bar code will be described below.

Figure 51:
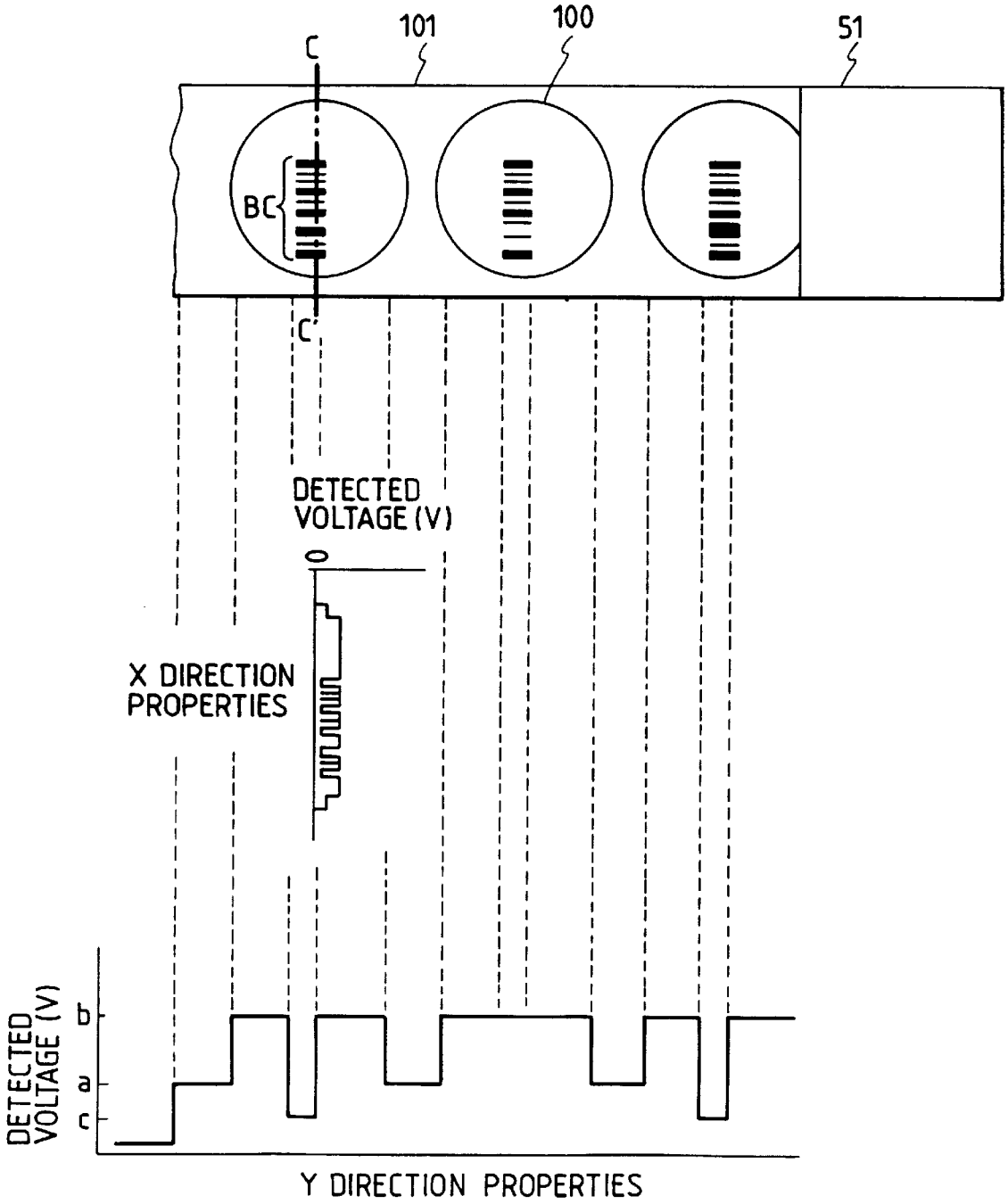
FIG. 51 is a conceptual view of the operation of the optical sensor as shown in FIGS. 24A and 24B wherein the bar code is printed on the label.

FIG. 51 is a conceptual view of the operation of the optical sensor 405 when the bar code BC is printed on the label 100. Since the bar code BC of the printed character is present across the C–C' line, the detected voltage of the label 100 in the X direction is not constant. That is, the detected voltage in the black print part of the bar code BC is cV. The correct printing can be confirmed by detecting this voltage using the optical sensor 405.

Figure 52:
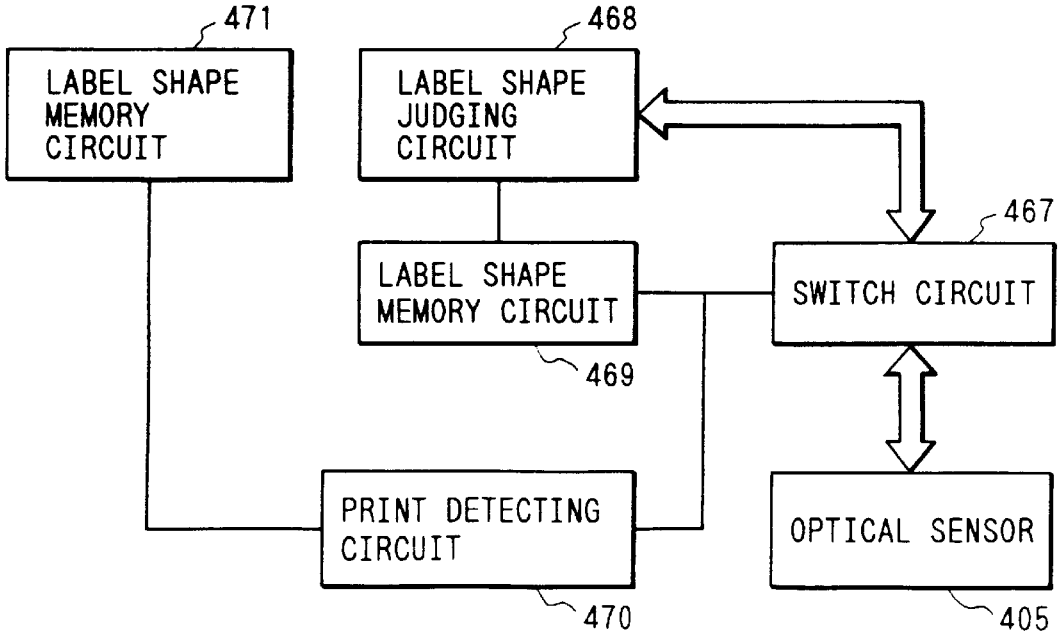
FIG. 52 is a block diagram showing an example of circuit configuration for the print judgment.

FIG. 52 shows a circuit configurational example for making the print judgment. The judgment of the shape of label 100 is the same as in FIG. 50. The roll sheet 51 is mounted, and if the label 100 is detected by the optical sensor 405, the detected voltage of the optical sensor 405 is entered in a print detection circuit 470. The print detection circuit 470 judges whether or not the printing has been achieved by the preset print reference voltage. This print reference voltage is set to a voltage cV as shown in FIG. 51. The print reference voltage of cV is predetermined according to the print color, and can be set by the CPU 153. If the detected voltage is cV, it is temporarily recorded in a print judgment circuit 471, supposing the printing. The data of the print judgment circuit 471 is collated with the data of the RAM 156 by the CPU 153, and if the data is correct, the printing is continued, or if incorrect, the printing is interrupted by making an error indication, or transferring the error to the external. With the above operation, the correct printing can be confirmed, and the highly reliable printing can be secured.

Note that a part of the circuit configuration of FIGS. 50 and 52 can be substituted by software.

In any way, it will be understood that in the printer for printing various kinds of labels, when the shape of label is changed, for example, when the label of circular, elliptic, or lozenged shape is mounted on the printer, the shape is judged inside the printer, and only if it is fitted with the print format, the printing is made.

Also, it is possible to judge whether or not the print context which has been printed on the label accords with the information to be printed, thereby providing a highly reliable printer. Particularly when the bar code is desired to print, it is possible to make a confirmation if the bar code is not printed for some cause, or the print density is lower, to be effective.

It will be appreciated that if no problem occurs in accordance with the shape of label, the print format may be changed.

(7) Printing over multiple labels of data

Conventionally, in the printer for printing on the continuous sheet like a roll such as the label sheet, the printing process is comprised of a developing process of data for one page (label) and a printing process of data for one page (label) which is started after developing, whereas the apparatus of this embodiment can print the data beyond the used label length over multiple labels by appropriately performing the data development into the print buffer and the printing. For this purpose, it is strongly desired to prevent the printing on the mount between labels, to retain the normality of data by pasting a combination of labels, to have the less complicated page designation when printing data due to jamming in printing the printed matter formed of a group of pages on the continuous sheet, and to need no disposition or reprinting for each page to secure the correctness of the printed matter.

Thus, this embodiment is made to detect the presence or absence of the label 100 bonded on the release sheet 101, to store the print data for one page, to transfer the print data stored in units of line to the print head, and to effect the printing in units of predetermined amount and the line feed if detecting the label, or effect the line feed if not detecting the label, in accordance with the detected result of whether or not the label is present for a print instruction.

Or in restating from the abnormal interruption during the printing of the printed matter to be printed in units of multiple pages, the pages from the top page of one unit of a page at which the abnormal interruption occurs, or only a page at which the abnormal interruption occurs, or other pages except that page, are printed additionally with the specific character, the symbol, the line or the netting, or in a single print color to restart the printing.

Note that to detect the presence or absence of the label, a construction as shown in FIGS. 25A and 25B, for example, can be adopted.

Figure 53:
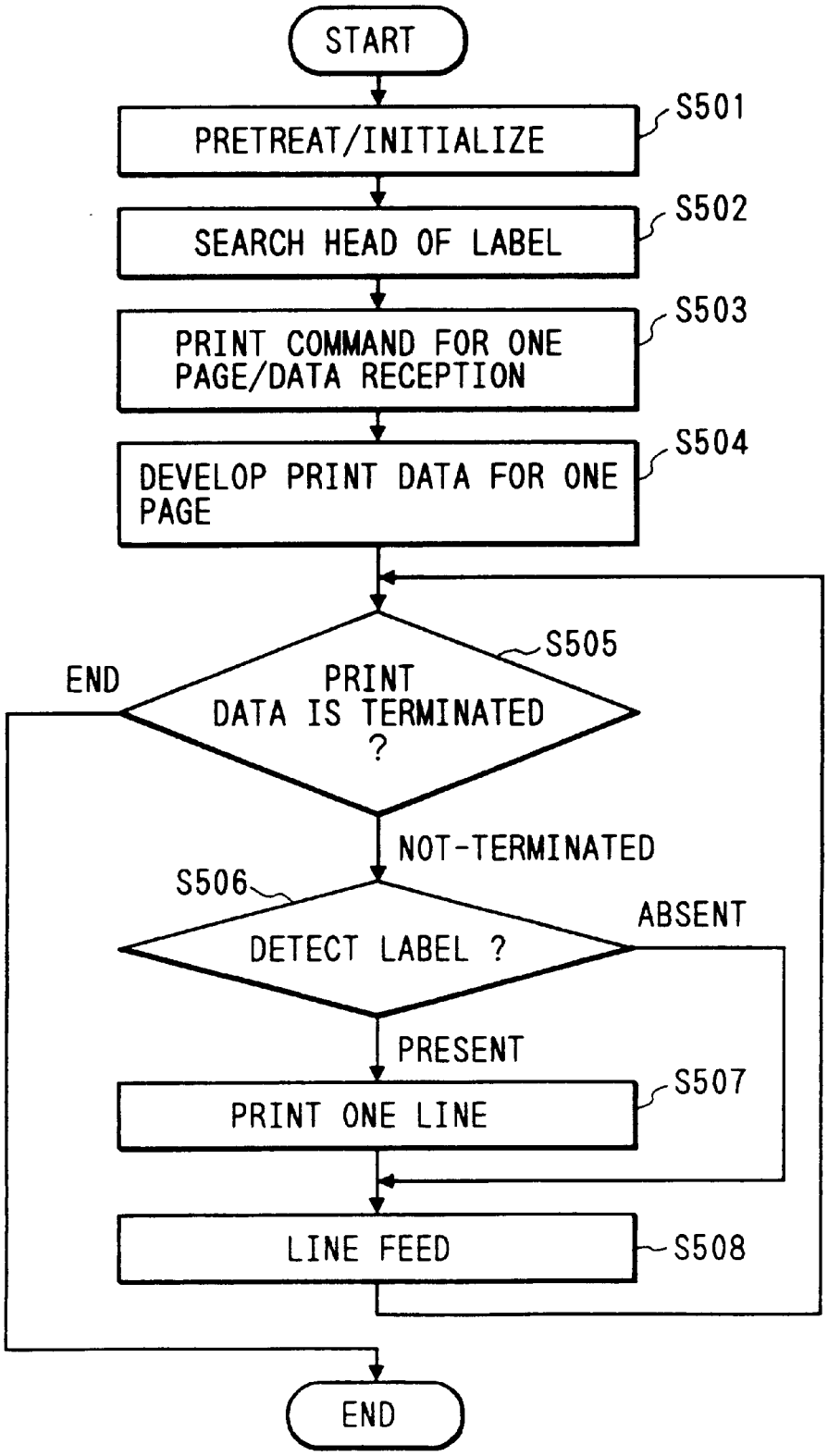
FIG. 53 is a flowchart showing an example of a control procedure for printing data over a plurality of labels.

FIG. 53 is a flowchart for making the control in a first example.

In FIG. 53, if the printing is instructed at step S501, the initialization of a predetermined area of the RAM, the reception buffer, and the print buffer is performed. At step S502, the head of the print position is searched by making the line feed, until label detecting means detects the top of label. Then, at step S503, the print command/data for one page is input from the outside and stored in the reception buffer.

Further, at step S504, image data for one page is developed in the print buffer 158 by the print command/data stored in the reception buffer, and the page length or the number of print lines is stored in the work area of the RAM 156.

Thereafter, at step S505 and following steps, the actual printing operation is performed. First, at step S505, a check is made to determine whether the actual print line number is equal to the print line number stored in the work area, that is, whether all the printing of image data to be developed in the print buffer is completed, and if completed, the printing process for one page is ended.

If not completed, a check is made to determine whether label detecting means is in the label detected state at step S506, and if in the non-detected state, the procedure transfers to step S508 to make the line feed, and then returns to step S505.

If in the detected state at step S506, one line data from the print buffer is transferred to the print head and printed at step S507, and then as in the non-detected state, the procedure transfers to step S508 to make the line feed, and returns to step S505.

Figure 57A:
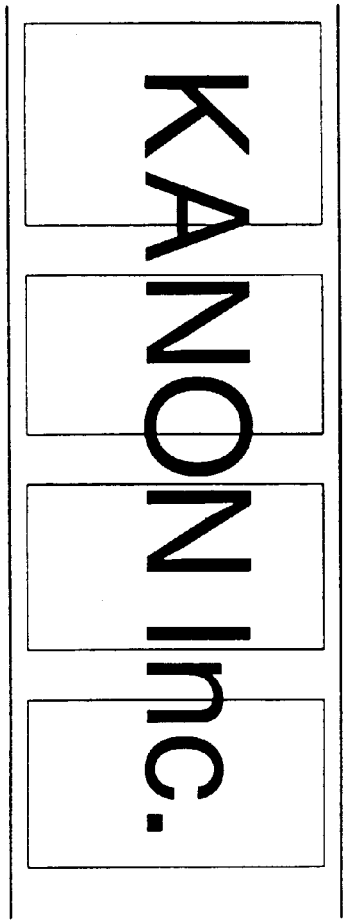
FIGS. 57A and 57B are explanatory views for explaining the effects of the processing of FIG. 53 respectively.
Figure 57B:
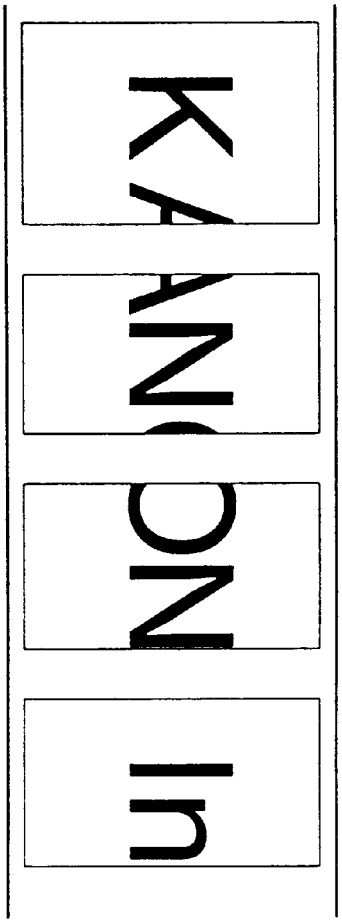

The effects of this embodiment is illustrated in FIGS. 57A and 57B. In printing data beyond the use label length over a plurality of labels, the normality of the printed matter may not be preserved in the prior art of the present invention, because after printing, if the label is peeled off a mount and bonded on another mount, the printing also takes place on the mount portion, as shown in FIG. 57A. On the other hand, according to this embodiment, as shown in FIG. 57B, the normality of the printed matter can be preserved in the above case.

Figure 54:
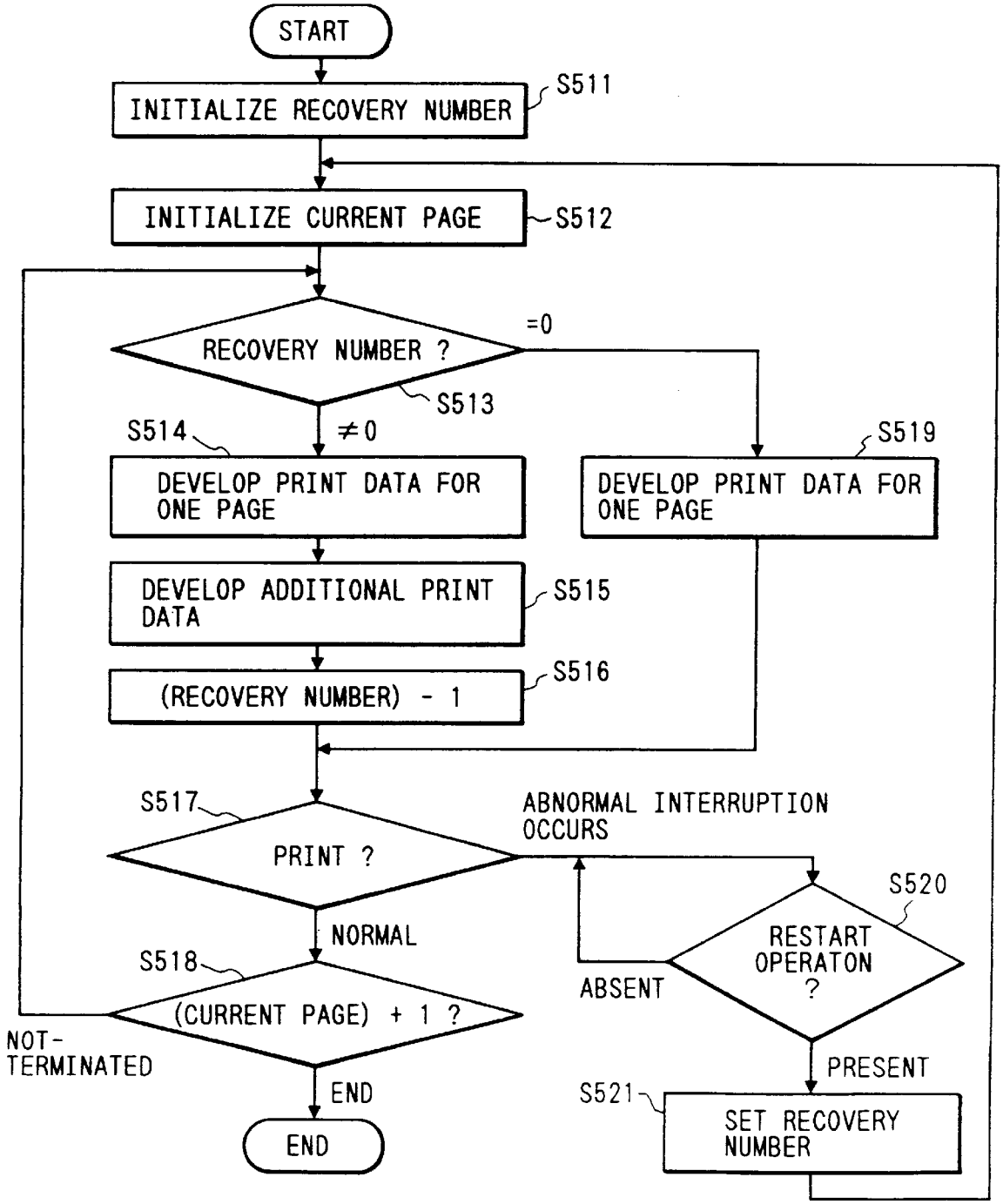
FIG. 54 is a flowchart showing another example of control procedure.

FIG. 54 is a flowchart showing a second example of the control according to this embodiment.

In FIG. 54, the process of storing the received data from the outside in the reception buffer is performed asynchronously with the printing process, and is not described. Also, it is supposed that the number of pages for a unit of print is fixed.

First, at step S511, the recovery number for storing at what page in a unit of print the abnormal interruption has occurred within the work area of the RAM is initialized (0 page). Then, at step S512, the current page for storing what page in a unit of print within the work area is being printed currently is initialized (1 page).

Thereafter, at step S513 and downwards, the actual printing operation is performed. First, at step S513, the value of the recovery number is examined, and if the value other than 0 is set (recovery state), the print data from the reception data stored in the reception buffer is developed in the print buffer at step S514. Further, at step S515, the net pattern indicating the recovery page is overlaid and developed in the print buffer.

Then, at step S516, the recovery number is decremented.

And at step S517, the print data developed in the print buffer is printed by the print head.

At step S518, the current page is added, and if it exceeds the page number in one unit of print, the printing in one unit of print is terminated. If it does not exceed the page number in one unit of print, the procedure returns to step S513 to print the next page.

At step S513, the value of the recovery number is 0 (normal state), the print data from the received data stored in the reception buffer is developed in the print buffer at step S519, and the procedure transfers to step S517 to effect the printing operation.

If the abnormal interruption such as jamming is detected during the printing operation at step S517, the procedure waits for the restart operation at step S520. And if instructed, the current page is decremented by 1 at step S521 and moved to the recovery number, and the procedure returns to step S512 to start the recovery process.

Figure 58C:
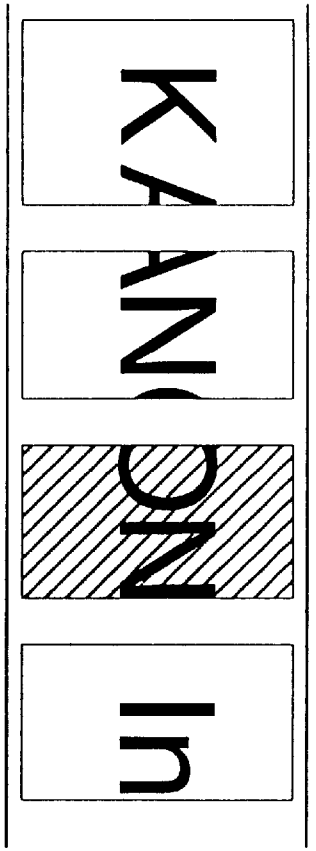
FIGS. 58A to 58C are explanatory views for explaining the effects of the processing of FIG. 54, respectively.
Figure 58B:
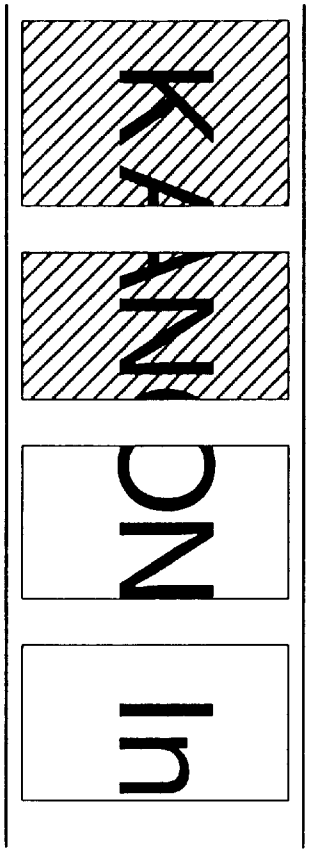
Figure 58A:
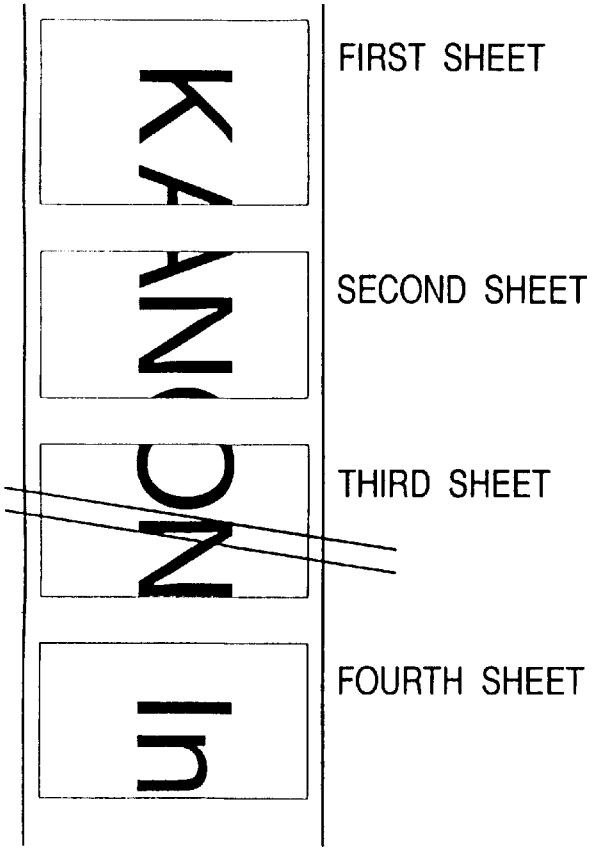

The effects of this embodiment are illustrated in FIGS. 58A and 58B. In FIG. 58A, the abnormal interruption such as jam is detected at the third sheet during the printing process of the printed matter with a set of four sheets, while in FIG. 58B, the restart operation is performed, and the additional printing of netting pattern (or addition of special character, symbol or line is also permitted) is performed on the recovery pages before the page (third sheet) of the printed matter with a set of four sheets at which the abnormal interruption such as jam is detected.

Figure 55:
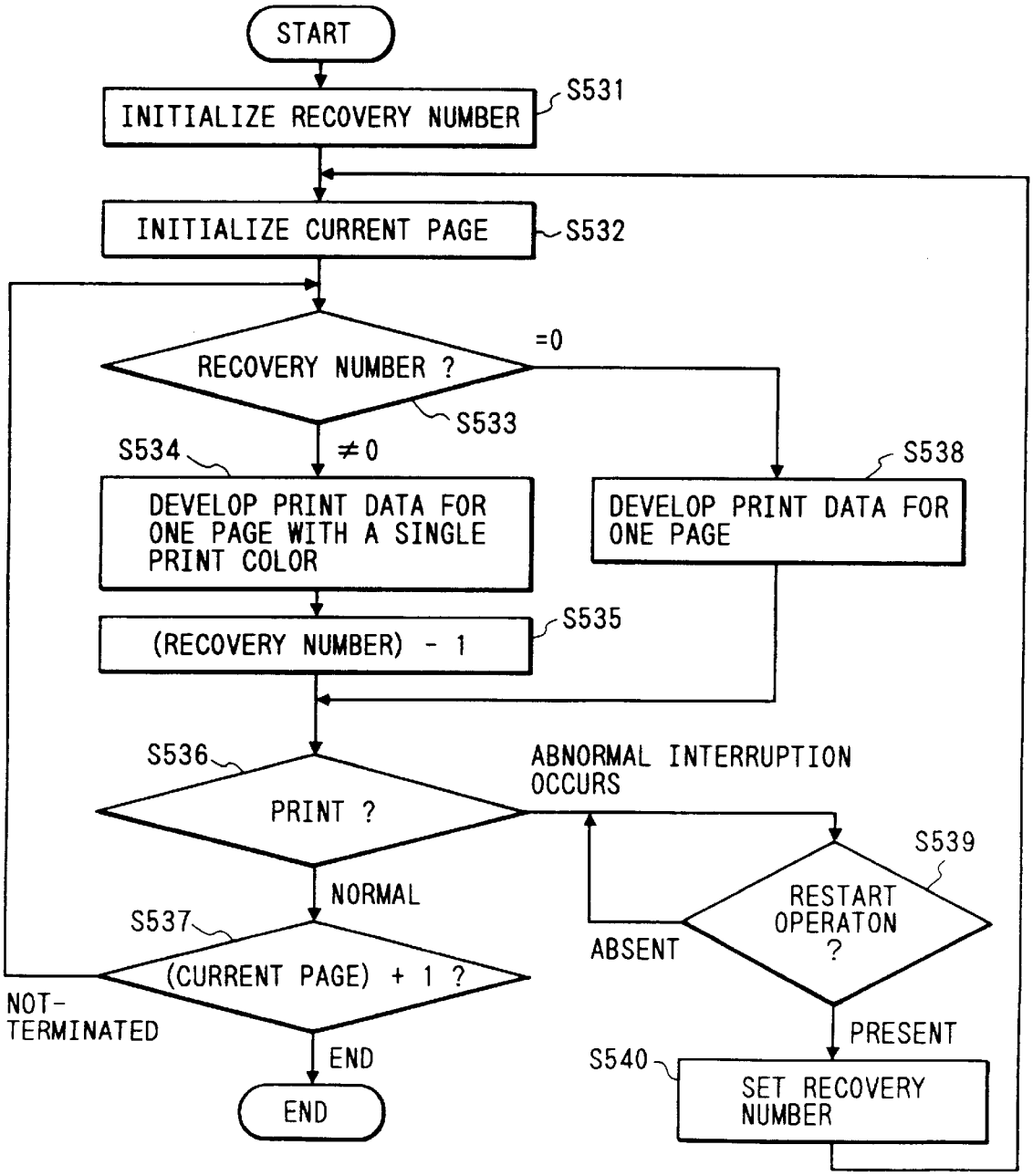
FIG. 55 is a flowchart showing still another example of control procedure.

FIG. 55 is a flowchart of the third example of the control according to this embodiment. This procedure is one in which steps S514 and S515 of FIG. 54 are only replaced with step S534, and the other operation is the same. That is, at step S534, the print data from the received data stored in the reception buffer is developed in the print buffer correspondingly to a print color fixed.

Figure 56:
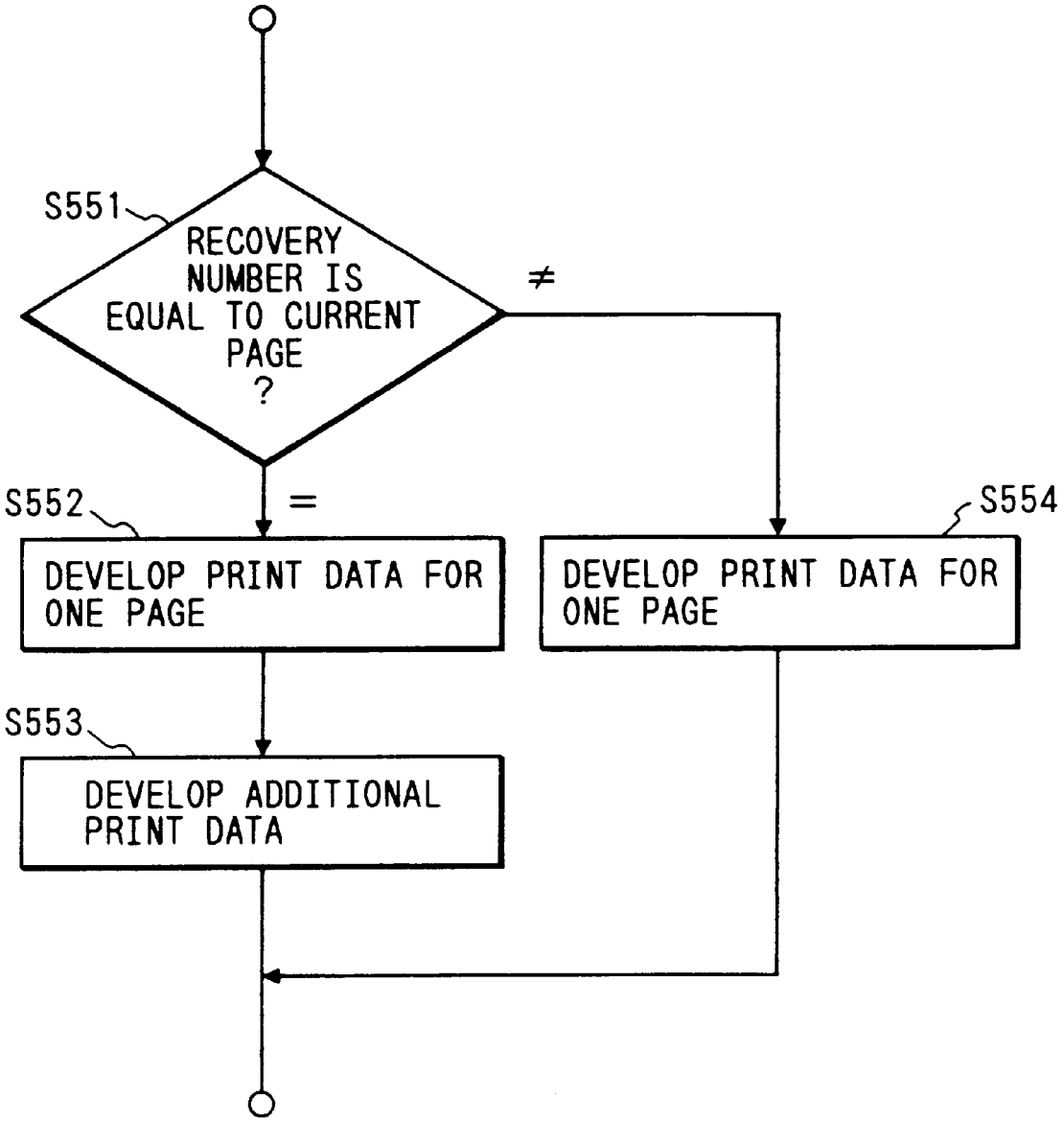
FIG. 56 is a flowchart showing a further example of control procedure.

FIG. 56 is a part of flowchart of the fourth example of the control according to this embodiment, corresponding to steps S513 and S514, and S519 of FIG. 54. However, the current page is directly transferred to the recovery number at step S521.

At step S551 and downwards, the additional data is developed to only the page at which the abnormal interruption has occurred during the recovery process. The fixing of the print color can be also made in a similar manner.

The effects with this procedure are illustrated in FIGS. 58A and 58C. In FIG. 58A, the abnormal interruption such as jamming is detected at the third sheet during the printing process of the printed matter with a set of four sheets, while in FIG. 58C, the restart operation is performed, and the additional printing of netting pattern is performed on the page (third sheet) of the printed matter with a set of four sheets at which the abnormal interruption such as jamming is detected.

Also, if step S553 is performed after S554, the restart operation is performed, the additional printing of netting pattern can be also made on the pages except for the page (third sheet) of the printed matter with a set of four sheets at which the abnormal interruption such as jamming is detected, and the fixing of the print color can be also made.

(8) Print control corresponding to the attitude of label

When the sheet (label) is conveyed obliquely with respect to the reference position as shown in FIG. 59, the printing is obliquely made onto the label 100, as shown in FIG. 60A, and if the sheet is conveyed through the position moved in parallel to the conveying direction from the reference position, the printing is biased with respect to the label 100, as shown in FIG. 60B. In any way, in the case of the label pasted on the product, there is a risk that the image of product itself may be impaired.

On the contrary, paper edge position detection sensors 418, 419 are provided to detect the position, as shown in FIG. 27, whereby if the label location of the print head portion is calculated to select the positions of nozzles used in each head to effect the printing, the printing is always performed at the fixed location with respect to the label without being affected due to the skewed sheet.

Particularly, since the resolution of the paper edge position sensors is equal or greater than the resolution of the print head in this embodiment, only ½ dot at maximum may be deviated relative to the resolution of the print head, and the color aberration can be minimized when a plurality of inks are superposed to effect the color.

That is, in making the printing process as shown in FIG. 37, the edge position of the paper being conveyed is detected, and the printing is performed by selecting the nozzles to be used based on its edge position, whereby the printing can be performed always at stable positions without influence of the serpentine or skewed sheet, with the color aberration suppressed, so that the high quality printing can be produced.

This is specifically described below. Supposing the skewed state of the label sheet as shown in FIG. 61, an instance in which the frame line with C (cyan) and Y (yellow) superposed as green will be described. It is assumed herein that the spacing between sensors 418, 419 and each head is L [mm], the skewed amount is x [mm], and the conveying speed is v [mm/sec].

The point printed by the m-th nozzle of C (cyan) must be printed by the (m+a)-th nozzle of Y (yellow), which is shifted a skewed amount not to make the image skew with respect to the label as shown in FIG. 60A, or the dots will not be superposed to produce green.

Thus, the edge detection of the sheet is performed by the sensors 418 and 419.

Because the skewed amount between the sensors 418 and 419 is x/5L, if using the m-th nozzle of C (cyan) from this value, the Y (yellow) head uses a nozzle which is shifted an amount of (x/5L)·2L (spacing between C and Y), that is, (⅖)x. Supposing the nozzle interval of the head to be N [mm], the nozzle may be shifted by an amount of [(⅖)×÷N]. However, because one unit nozzle can be only manipulated, supposing the value obtained by rounding off the value of [(⅖)÷N] to be an [integer], the (m+a)-th nozzle is used (the deviation as large as ½ dot or greater can be suppressed to the minimum by rounding off).

Also, in the C (cyan) head, if the printing is made by heating the m-th to n-th nozzles simultaneously, the inclined line with respect to the sheet is produced, the timing from the heating of the m-th nozzle to the heating of the n-th nozzle is delayed by an amount of (n-m)×N (length of line)×(X/5L) (inclination of line)÷(speed) [sec]. In the Y (yellow) head, likewise, the timing from the heating of the (m+a)-th nozzle to the heating of the (n+a)-th nozzle is delayed after 2L÷v [sec], to effect the printing by superposing Y (yellow) on C (cyan). Of course, the m-th to n-th nozzles are successively heated in accordance with the above formula.

More specifically, since the head resolution is 300 dpi, the speed v=200 [mm/sec], and the head spacing L=25.4 [mm] in this embodiment, when m=twentieth nozzle at x=1 mm, and n=1400th nozzle, $$(x/5L)\times 2L=[1/(5\times 25.4)]\times 2\times 25.4=\tfrac{2}{5}\ [\mathrm{mm}]$$

$$(\tfrac{2}{5})\div N=(\tfrac{2}{5})\div(25.4/360)=5.669\ \therefore a=6$$

namely, if C (cyan) is printed with the twentieth nozzle, Y (yellow) is printed with the twenty-sixth nozzle.

Also, $$(n-m)\times N\times(x/5\mathrm{L})\div v=$$
$$(1400-20)\times(25.4/360)\times[1/(5\times 25.4)]\div 200=3.83\ [\mathrm{msec}]$$

Namely, the 1400th nozzle is heated 3.83 [msec] after the twentieth nozzle of C (cyan) is heated, and the printing is performed by delaying the heat timing of the nozzle in succession.

Such control may be made by the bit map development into the print buffer 158 in accordance with the disposition or constitution of sensor systems 418, 419, or by adding means for shifting the used nozzle to the head control circuit 157.

(9) Shift printing

The printing methods of utilizing the heat generating elements include a thermal method of applying heat to the thermosensible paper to effect coloration by heating, a thermal transfer recording method of transferring the ink to the sheet by heating, an ink jet method of vaporizing the liquid ink instantaneously by heating elements and jetting ink droplets onto the sheet owing to the pressure of bubbles produced, as in this embodiment, in which these methods are applied as the printing or recording method to various printing apparatuses in many applications.

The durability of the print head using the above heat generating elements may be governed by disconnection of resistor useful as the heat generator, the failure of switching element such as transistor controlling the conduction to each heat generating element, and so on. Further, it is also governed by the damage of the head due to the contact friction with the paper or ink ribbon, in the case of the print head of contact type, particularly the thermal recording or thermal transfer recording, or the clogging with the ink or contamination in the ink flow passage near the heat generating circuit, in the case of the ink jet recording.

When part of the heat generating elements of the printing head, in other words, the printing segment, is broken, due to these factors, the partial lacking of the information to be printed or the incorrect recognition of the printed information may be caused, whereby the replacement of the print head is required. However, the print head is an expensive element, while the labor for the replacement and the inoperative loss time required for the replacement may occur, so that the increase in the print cost may be caused.

To cover the above drawback, a proposal as disclosed in Japanese Laid-Open Patent Application No. 61-104872 has been proposed in which the electric current not enough to effect printing is passed through the heat generating circuit of the print head to detect the disconnected portion, determining whether or not print data is present at the print position corresponding to its disconnected portion, wherein if not present, the printing is directly made, or if present, searching for the location having no print data is performed in its neighborhood thereof, and if such a location is present, printing is made at the location. Or a way of representing the term of replacement with an indication "THE DURABILITY OF THIS THERMAL HEAD IS ROUGHLY 50KM" has been taken.

However, the ruled line or frame is contained in the printed context, when printing a number of sheets, the number of conductions to a specific heat generating circuit within the printing head is increased, so that the life of the heat generating circuit may determine the life of the whole print head, or if printing is performed by shifting the disconnected portion, the number of conductions to the specific heat generating circuit is also increased, possibly resulting in a risk of causing a disconnection of the line.

Particularly in this embodiment, this must be appropriately avoided because the bar code is contained in the printed context.

Thus, in this embodiment, in performing the printing by moving the sheet relatively in the vertical direction to the direction of the array of elements for the printing head having a plurality of heat generating elements, the number of heat generating elements unused from both ends of the heat generating elements arraged is detected, and data entered in the data register is shifted in accordance with the detected number of elements, its shift amount being changed for every predetermined sheet number. In printing the print data of the same context, the increased number of conductions to the specific heat generating elements is prevented, whereby the decreased durability due to the disconnection of the heat generating circuit of the print heat is suppressed.

By the way the print data as shown in FIG. 47 is entered via the data transmission/reception unit 152 into the apparatus of this embodiment, and simultaneously the print number N is also entered therein. Then, the CPU 153 controls the development of print data into the print buffer 158 by the program stored in the ROM 155, wherein the number of dots having no print data existing at both end portions of one line of print data is checked (one dot indicates the dot printed by one heat generating circuit of the print head 301). Herein, it is supposed that there are 20 dots on either of the left and right sides.

Figure 62:
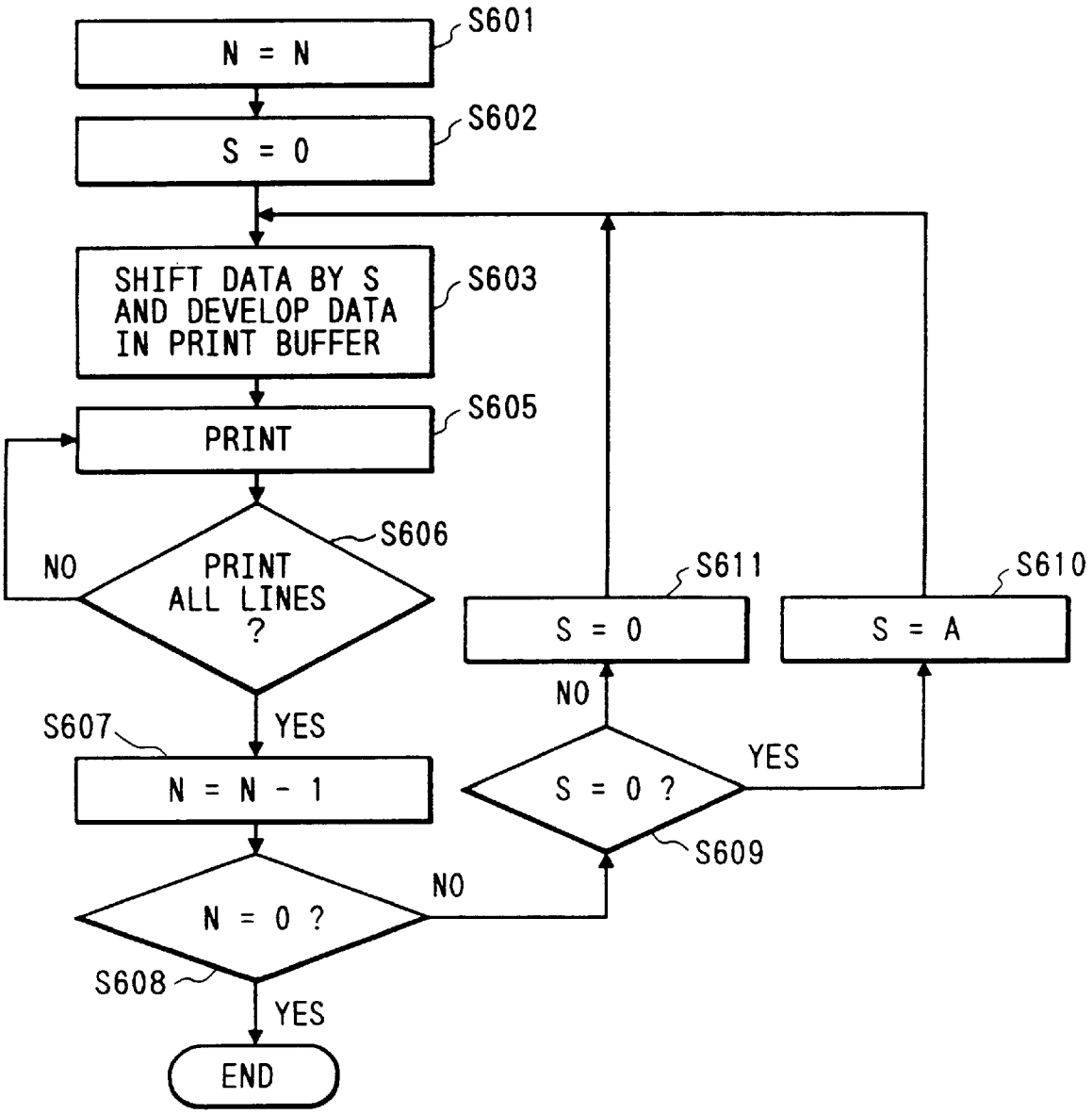
FIG. 62 is a flowchart showing an example of a shift print control procedure for making even the use frequency of a recording element.

FIG. 62 is a flowchart showing an example of print time control procedure in this embodiment. The shift amount can be made variable in the range corresponding to the number of unused dots on the left and right ends x, y, but for the simplicity of explanation, two types of shift amount "0" and "A" are provided. "0" indicates the shift amount zero, that is, the print data is directly printed. "A" indicates that data is shifted for the printing. For example, the value of "A" is "10" if x=y=20. If it is "20", the print data is extremely deviated to the end portion, and half the value is adopted.

The print control is as follows. First, at step S601, the number of sheets to be printed N is set. Then, at step S602, 0 is set to the print shift amount S. If the print start is instructed, data is shifted by S and developed in the print buffer 158 at step S603. As the first sheet is S=0, the shift amount is 0, in which data is not shifted. Then, each heat generating element of the print head is turned on in accordance with data in the data register to effect the printing of one line on the sheet. At step S606, a check is made to determine whether or not the line data to be printed remains, and if present, the printing is continued. In printing, the motor is driven to convey the sheet one line after the other. This is repeated until all the lines are printed on the label, and if all the lines are printed, the procedure transfers to step S607. At step S607, N is decremented by 1 as the printing of one sheet is completed. At step S608, a check is made to determine whether N is equal to 0, that is, the printing for the number of sheets to be printed has been completed, and if not completed, the procedure transfers to step S609. At step S609, a check is made to determine whether or not the shift amount is 0. And if S=0, A is set to S at step S610, the procedure transfers to step S603, while if S=A, 0 is set to A, and the procedure transfers to step S603. Since S=0 at a time when the printing of one sheet has been completed, A is set to S, and the procedure transfers to step S603.

Accordingly, in this embodiment, the printed matter is output with 10 dots shifted in the line direction of the print head for every other sheet.

By printing in this way, print dots are formed. The number of conductions to heat generating elements having greater print frequency corresponding to the frame or bar code in the heat generating circuit corresponding to print dots can be suppressed.

Figure 63:
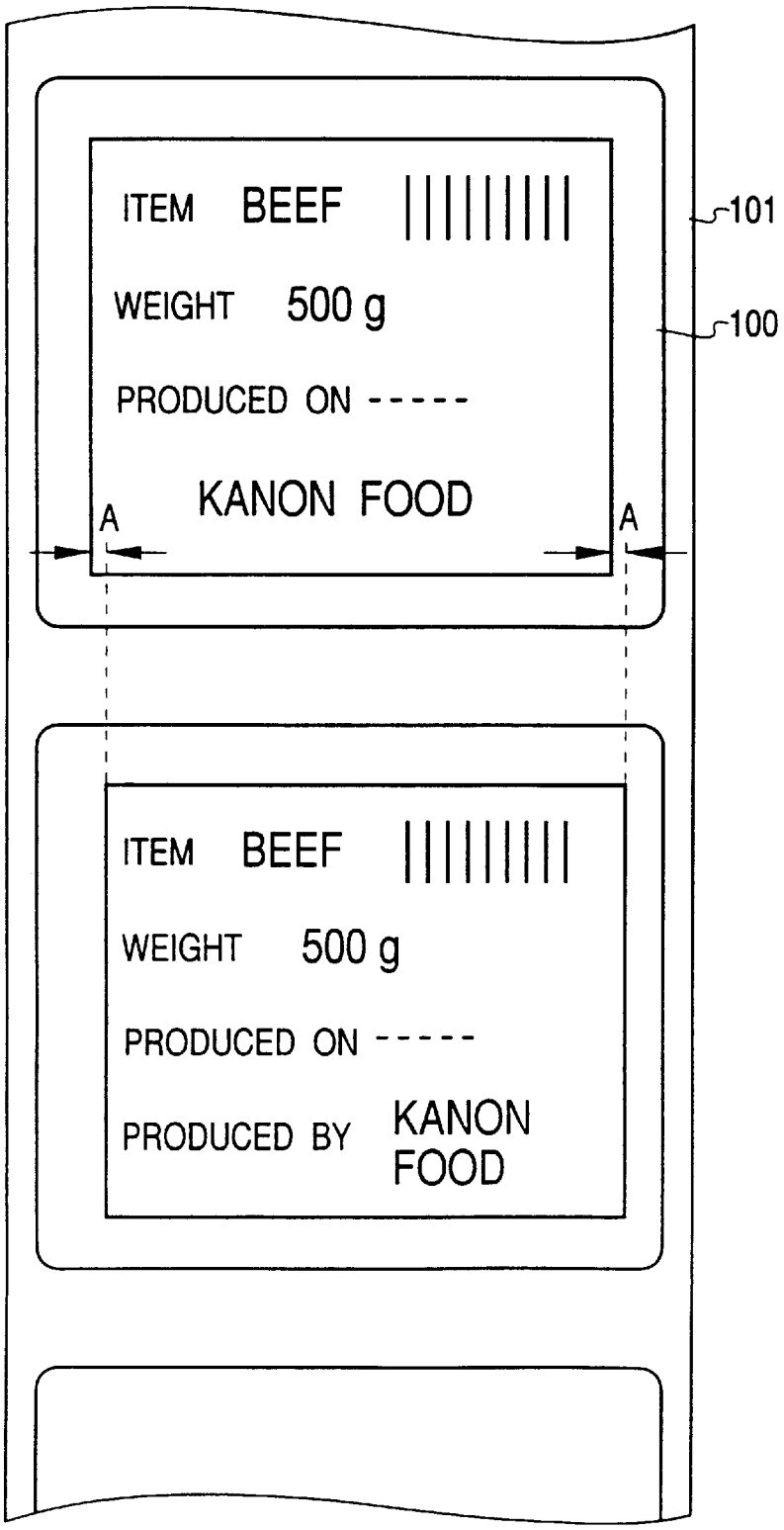
FIG. 63 is an explanatory view showing an example of printing when conducting its procedure.

In this embodiment, as two kinds of shift amount, i.e., 0 and A (=10), can be set, the number of conductions to the heat generating elements corresponding to dots having concentrated print frequency is reduced substantially half. Note that a print example is shown in FIG. 63.

While this embodiment was described by presupposing the ink jet recording of the ink jet system, it is needless to say that this embodiment is applicable to any of the printing apparatuses employing the print head comprised of multiple heat generating elements, with the thermal transfer recording using the thermal transfer ribbon or the thermal recording using the thermosensible paper.

Figure 64:
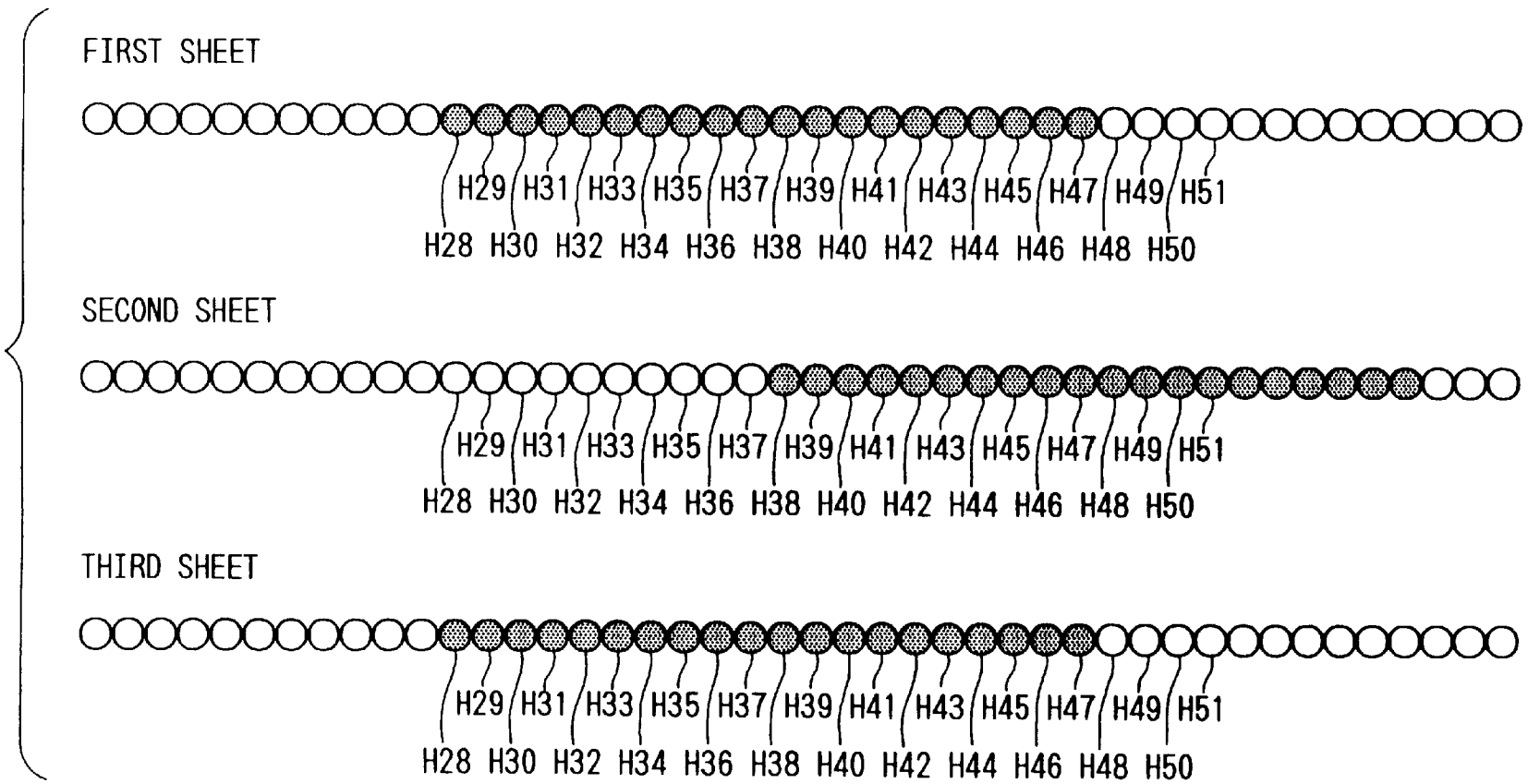
FIG. 64, is an explanatory view for explaining another example of shift printing.
Figure 65:
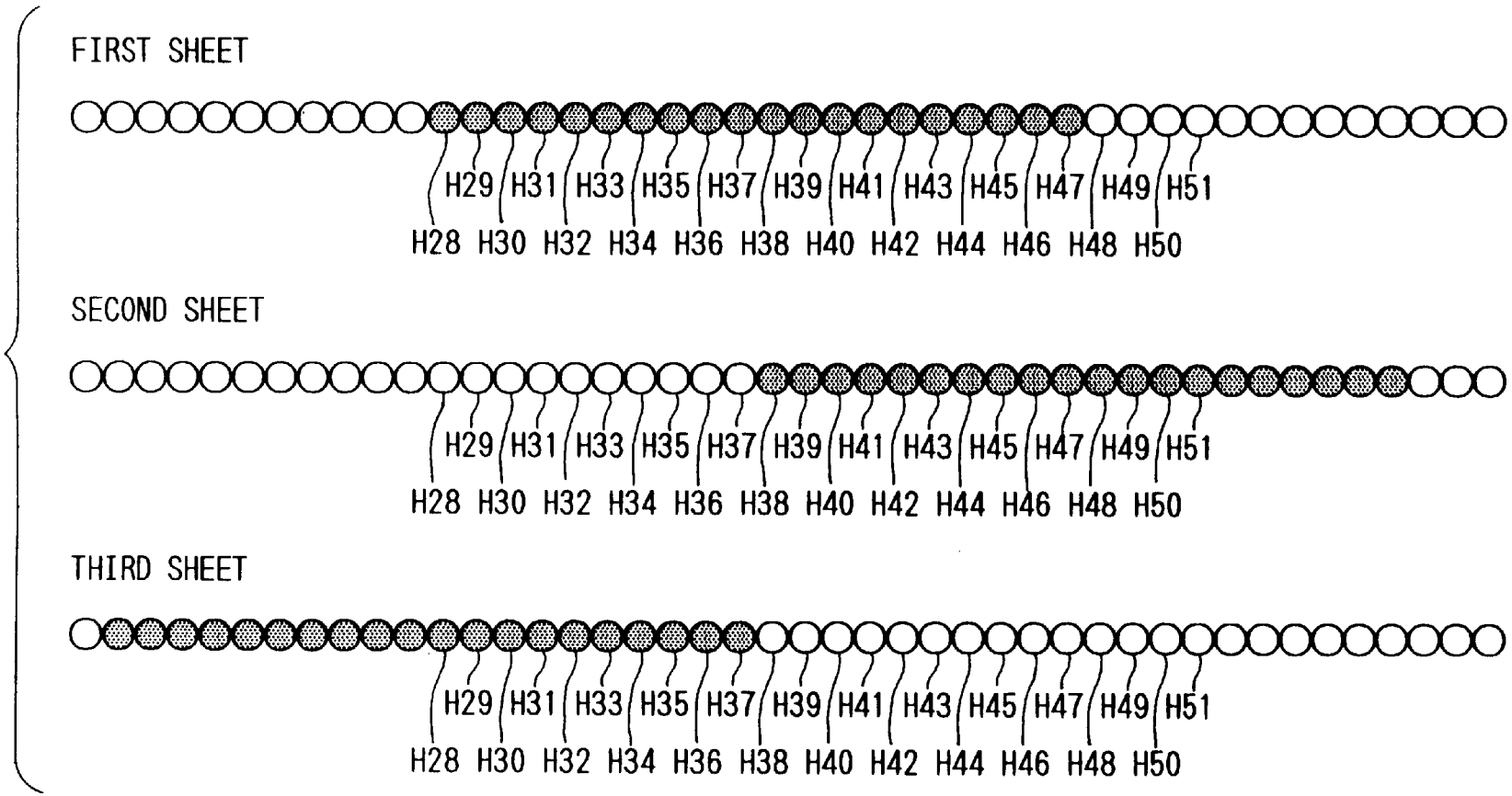
FIG. 65 is an explanatory view for explaining a further example of shift printing.

In the above example, two kinds of shift amount, i.e., "0" and "10" are provided. Accordingly, when the number of conductions to the heat generating elements in one portion is greater than other heat generating elements due to the existence of the thick frame, for example, when the width of the frame is 20 dots, the heat generating elements H33 to H47, in the heat generating circuits H28 to H53, are conducted substantially at any time, as shown in FIG. 64, often weakening the effects with the shift. Thus, by having the shift amounts S of three values "−10", "0" and "10", the frequency of conductions to the specific heat generating elements H33 to H48 can be suppressed, as shown in FIG. 65.

While the example was described with an instance where the width of the printing sheet is substantially equal to that of the printable area of the print head, it will be understood that in the case where the width of the printing sheet is smaller than that of the printable area of the print head, the heat generating circuit having no signal applied at both end portions can be detected in the area corresponding to the width of the printing sheet to achieve the objective.

While in this example the print buffer for the bit map development of data for one page (label) is provided to redevelop the data for every printing for one page, it will be appreciated that if the head control circuit 157 has means for developing data to send each one line to the printing head, the shift of data may be made when developing the data.

Further, since the ink jet head used in this example allows the discharge ports to be arranged at high density, the used discharge ports are thinned appropriately, for example, every other dot is driven in succession to prevent the use frequency of only the specific discharge ports from increasing.

In addition, with the ink jet head, there is no problem of so-called "tailing" occurring when printing the bar code using the thermal head, because the sheet and the head are not in contact. Thus, the bar code may be inclinedly printed, for example, a bar code as shown in FIG. 60A, so that no problem is caused.

Further in addition, if the ruled line or bar code, at which the use frequency of the specific heat generating elements is particularly higher, is detected to be contained in the print context, the shift may be effected only in that case or portion.

(10) Bar accuracy holding (10.1) Bar accuracy holding with head lifting

Figure 66:
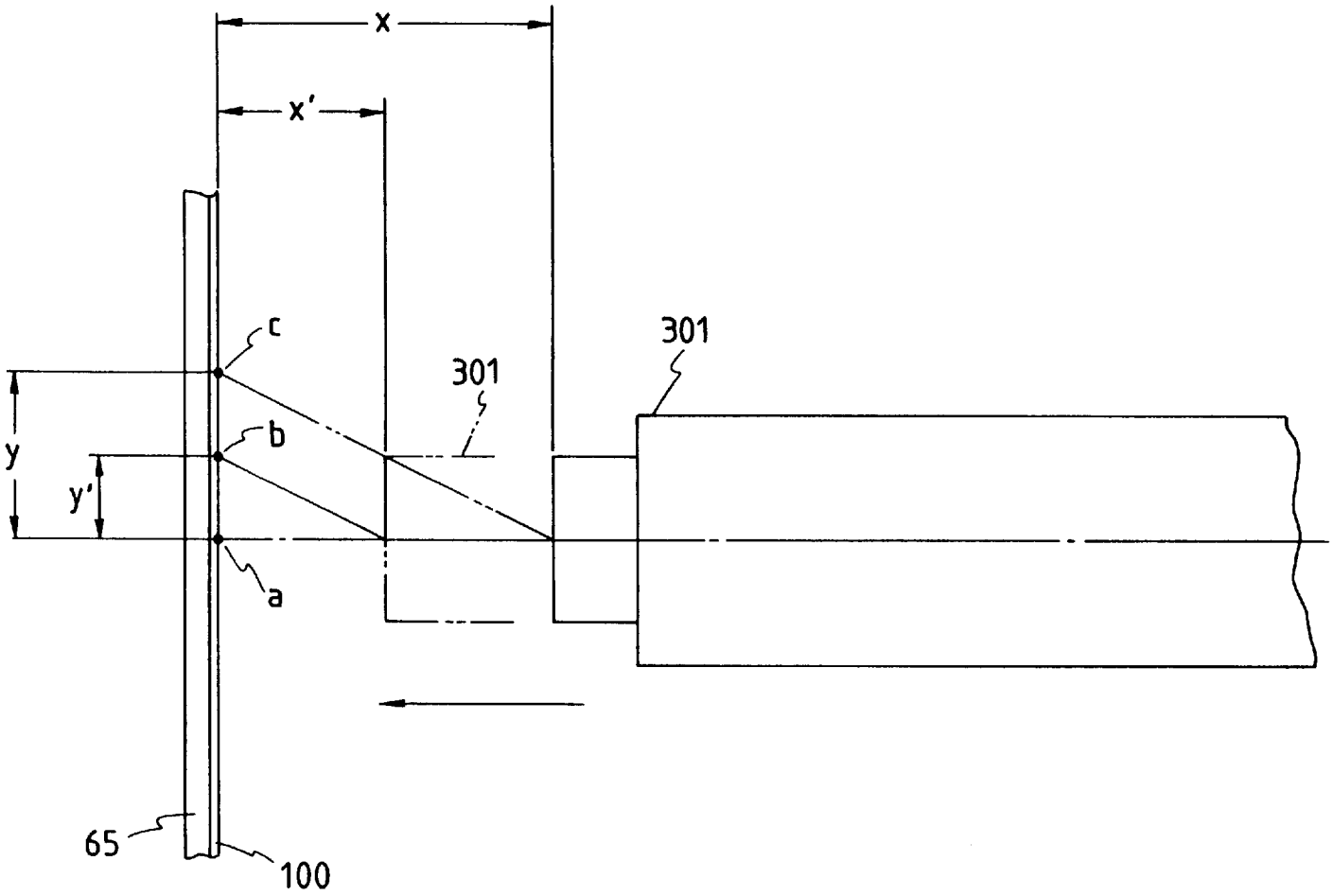
FIG. 66 is an explanatory view for explaining the processing for holding the accuracy of bar code with the head lifting.

For example, the JAN code is considered. For example, with a print head having an offset amount of 35 μm at maximum at a dot density of 11.5 lines/mm, the minimum bar of 330 μm is constructed with four dots to print the bar code having a magnification of 1 (bar width of 330 μm, tolerance of ±101 μm). With this head, the width of four dots is 348 μm in the non-offset state, or 278 to 418 μpm at the maximum offset, which falls within the JAN standard (229 to 431 μm), so that there is no problem upon impinging at a point c at the maximum offset from the ideal impinging point a (y=35 μm), with the spacing between the sheet and the head being x, as shown in FIG. 66. However, if the printing is performed at a minimum magnification of 0.8 (bar width of 264 μm, tolerance of ±35 μm), the minimum bar 264 μm is constructed with three dots, in which the bar width is 260 μm in the non-offset state, or 190 to 330 μpm at the maximum offset, which is out of the JAN standard (229 to 299 μpm), and can not be used as the bar code. To satisfy the standard at this magnification of 0.8, the maximum offset amount must be 15.5 μm or less.

Thus, if the head position is moved to x'=0.4x in FIG. 66, the discrepancy y' between the maximum offset impinging point b and the ideal impinging point a is equal to y'=0.4y=0.4×35 μm=14 μm, which is within the allowable range or 15.5 μm at the magnification of 0.8 to satisfy the JAN standard.

Figure 67C:
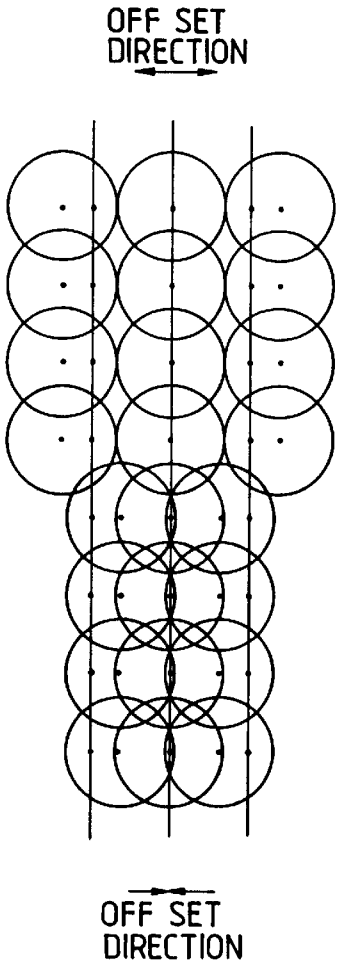
FIGS. 67A to 67C are explanatory views for explaining the reduced bar accuracy due to the offset.
Figure 67B:
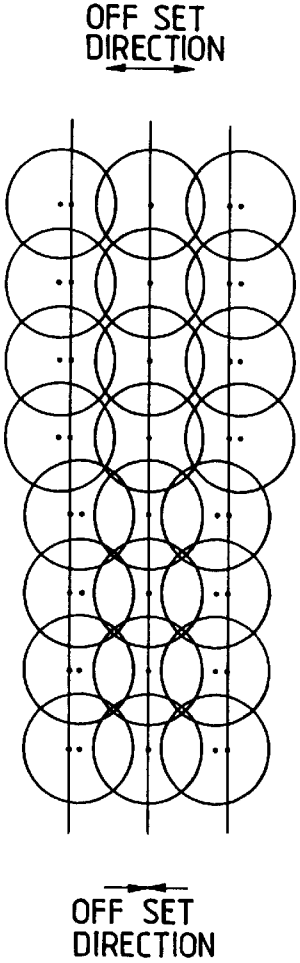
Figure 67A:
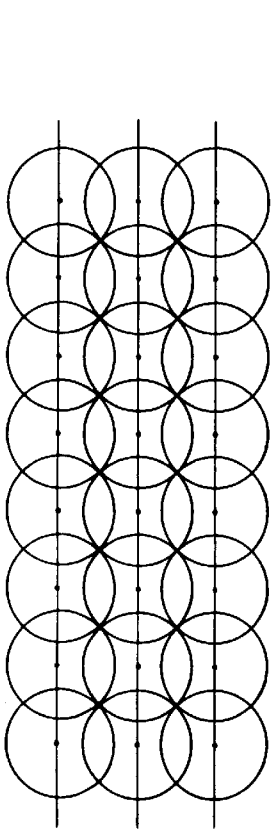

In this embodiment, when a print instruction is created by the external apparatus, e.g., the host computer 151, the bar code portion, the character or numeral portion, and the illustration portion are each input. At step S100 in FIG. 37, in developing the input information into image data for one sheet, the minimum bar is detected from the bar code data, and the head is driven to the position of x' in FIG. 66 if it is constructed with three dots, or moved to the position of x in FIG. 66 if it is constructed with four dots, then printing is effected. After termination of printing, the head is retracted to a predetermined position to avoid jamming due to the curl of the sheet. FIG. 67A is a typical view of dots when there is no offset, FIG. 67B is a typical view when the spacing between the paper and the head is x', and FIG. 67C is a typical view at the maximum offset when the spacing between the paper and the head is x.

While in this example as described, the movement of the print head is controlled by the number of dots constituting the fine line, it is of course possible that a mechanism for detecting the thickness of the sheet can be provided to make the control by changing the position of the print head depending on the thickness of the sheet, and to secure the position of x' at any time, as shown in FIG. 66, with the same results.

In any way, by constructing the head position to be movable, it is possible to print the stable line by reducing the offset amount for the width of the fine line. As the fine line can be stably printed, the magnification of the bar code can be reduced, and the size of the printing sheet itself reduced, wherein there is the effect in the aspect of saving the sheets.

(10.2) Bar accuracy holding with discharge amount control

Figure 68:
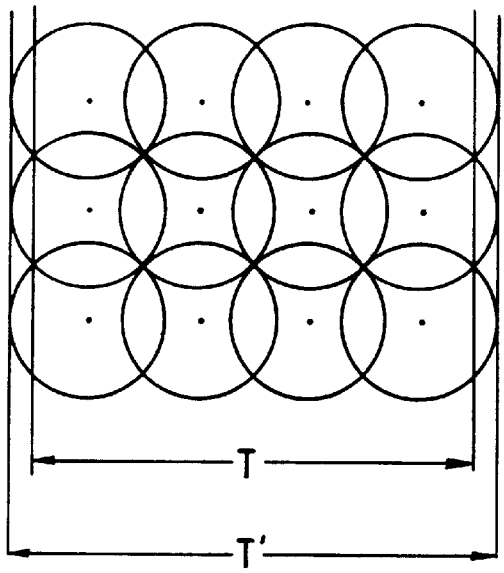
FIG. 68 is an explanatory view for explaining the increased width of black bar for the bar code due to formation of dot.

By the way, the size of the bar code to be printed, or the ratio of thick to thin bar, may depend on the density of the print head. On the other hand, there are various kinds of the bar code, such as "JAN", "UPC", "CODE39" and "CODE93", for each of which the ratio of thick to thin bar is standardized. Therefore, the bar width needs to be printed correctly. In the conventional bar code printing apparatus, the paper feeding mechanism is designed in accordance with the dot density of the print head used, and controlled to print one line of the same thickness by a paper feed of one pitch at all times, but as the printing operation is effected by setting the size of one dot and the dot pitch to satisfy the density in accordance with the standard of the bar code, both end portions of the black bar are printed by the same dot diameter, which caused a problem that the black bar width T' is thicker as compared with the regular width T, and accordingly, the width of white bar (having higher reflectance in the parallel bar constituting the bar code) is thinner, as shown in FIG. 68.

Thus, in this embodiment, when storing the data of input bar code in the print buffer, the end portions of the black bar in the bar code data are detected, and one dot at either end portion of the black bar is printed, wherein means for reducing the diameter of printing dot by controlling the applied voltage and/or the width of applied pulse for only the head for printing one dot at either end portion to reduce the amount of ink discharge is provided to effect correct printing in the respects of not only the density of the bar code but also the bar width. Since the density at either end portion of the black bar may not satisfy the standard, it is more effective to print with the greater dot diameter, except for either end portion of the black bar. Besides, when printing wholly with the smaller dot diameter, the detected black bar is printed with the greater dot diameter except for one dot at either end portion.

Figure 69:
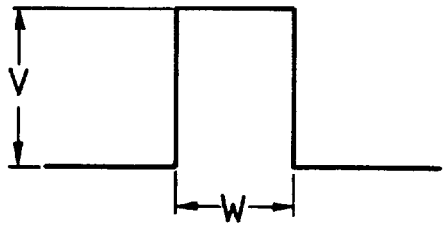
FIG. 69 is an explanatory view of an applied pulse for driving the recording element.

Specifically, in the process of step S100 of FIG. 37, if the print data is input via the transmission/reception unit 152, the print data is temporarily stored in the reception buffer of the RAM 156. Since the received print data contains the character code corresponding to character to be printed in one label or the numeric code corresponding to the bar code, this received print data is analyzed, developed into the image data for one label, using the character generator or numerical code/bar code conversion table, and stored into the print buffer 158, whereupon a black bar having the thickness of three dots or more is detected in the bar code data, and when printing one dot at either end portion of the black bar, the applied voltage V of the head is slightly reduced or the pulse width W is narrowed, as shown in FIG. 69, for example, to store the data in the RAM 156 and then develop it into the print buffer 158. And image data for one line is read from the print buffer 158, and the data holding the strength of the applied voltage is read from the RAM 156 and entered into the head control circuit 157, whereupon the bar code can be correctly printed with the reduced amount of ink as shown in FIG. 70, by reducing the applied voltage of the head element for printing one dot at either end portion of the black bar having the thickness of three dots or more has been predetected in driving the head.

More particularly, to describe the effects of this present example, for example, in an ink jet printer having a resolution of 360 dpi, the bar code (as described with the JAN code defined in JIS X0501) is printed.

As the resolution is 360 dpi, the pitch between ink jet nozzles is 70.5 μm, but as the shape of print dot is substantially circular in the ink jet recording, some clearance occurs between dots in printing the solid image (e.g., the inner portion of the bar) with the print dots having a diameter of 70.5 μm. Accordingly, in the printer using the normal ink jet recording method, the print dot diameter is designed to be equal to or greater than $\sqrt{2}\times$ the pitch between nozzles. In this example, the print dot diameter is $\sqrt{2}\times 70.5\mu m\times 1.2\cong 120$ μm (as the greater dot diameter produces the higher print density and less voids, the size is 20% increased).

According to JIS X0501, the minimum bar width (one module dimension) is defined from 264 μm to 660 μm, but in an apparatus which prints the bar with the print head as in the present apparatus, one line bar, is constituted of some dots, allowing several types of lines in the permissible width from 264 μm to 660 μm to be represented.

That is, where the print dot diameter is 120 μm, and the pitch between print nozzles is 70.5 μm, the minimum bar width of the representable JAN code needs to satisfy the condition:

$$264\leqq 70.5(a-1)+120\leqq 660$$

a indicates the number of dots constituting the bar so that $3\leqq a\leqq 8$. That is, in this printer, the number of print dots in the width direction of the bar is from 3 to 8. Herein, calculating the minimum black bar (one module side) actually printed when a=4, namely, when the minimum black bar (one module) is constituted of four dots, $$70.5\times(4-1)+120=331.5\ \mu m$$

As the whole of JAN codes is constituted of 95 modules (in the standard version), the size of the whole is $$70.5\times(95\times 4-1)+120=26839.5\ \mu m$$

Accordingly, calculating the size of one module from the size of the whole, $$268395\div 95=282.5$$

Hence, as the dot diameter is 120 μm, the bar width which should be essentially 282.5 μm is equal to 331.5 μm. That is, the bar width is about 49 μm too thick. Further, the above value is a numerical value when the print position is not deviated, and supposing the print position accuracy in the normal ink jet printing apparatus to be δ=15 μm, the deviation from the size may possibly exceed 60 μm. According to X0501, this deviation is described as the bar width tolerance, but ±51 μm when the size of one module is 281 μm, ±69 μm when it is 297 μm, and by the comparative calculation, about 53 μm when it is 282.5 μm, which clearly does not satisfy the standard.

Thus, by applying the present example in the following way, the bar code which can satisfy the standard, with high bar density and less voids, can be provided. By reducing the size of print dots constituting the outside of the bar to, e.g., 90 μm, the width of the minimum black bar is equal to $$70.5\times(4-1)+\mathbf{90}=301.5\ \mu m$$

and taking the print accuracy of δ=15 μm into calculation, the width of the black bar can be sufficiently made within the range of 282.5±53 μm For example, when the bleeding ratio of the recording sheet is 2.5, the present example is designed to discharge liquid droplets of about 58 pl (picoliter) to obtain the dot diameter of 120 μm, but the effects of the present example can be implemented by controlling the width of print pulse so that liquid droplets from the print nozzles may be about 24 pl, using means for detecting the position of print dot corresponding to either end of the black bar, as described previously.

(10.3) Bar accuracy holding with the addition of data

In addition to holding the bar accuracy by controlling the discharge amount in this manner, the following method may be taken. In the present example, the processing before the detection of the bar is the same as in the above example.

In the present example, the white bar of bar code data is detected, the white bar consisting of one or more dots is added in accordance with the thickness of the white bar, and data is stored in the RAM 156 to print data by shifting the additional data, and developed in the print buffer 158. Data is read from the print buffer 158 and entered into the head control circuit 157, and the head is driven to print the bar code, so that a proper width T of the white bar can be obtained with respect to the width T' in the case of not performing the processing of the present example as shown in FIG. 71.

To detail the effects of the present example, in an ink jet printer having resolution of e.g., 360 dpi, when printing the JAN 13-digit code as described in JIS X0501, and 1) Printing the minimum black bar (one module size) with four dots
2) Making the diameter of one print dot above 120 μm (on the recording sheet)

the bar sizes in the conventional example and the present example are listed in the following table.

TABLE 1

| | Minimum black bar width (one module) | Minimum white bar width (one module) | One module width calculated from the total length |
|---|---|---|---|
| Conventional example | 331.5μ | 232.5μ | 282.5μ |
| Present example | 331.5μ | 303μ | 304μ |

In this way, the difference between the minimum width of the black bar and that of the white bar is reduced, and it will be found that the white bar width is closer to the value of one module width as calculated from the total length of the bar code.

The same thing can be said about the black bar and the white bar of two or more module widths.

In this way, when printing the bar code, the width of the white bar can be correctly printed by adding the white bar of one dot or more to a portion of the white bar, to the effects that the correct bar code can be printed.

(11) Others

The present example has the specific effects as described above everywhere, owing to the use of an ink jet head, but has other remarkable effects as described below.

That is, when printing the bar code extending in a direction (sheet conveying direction) orthogonal to the line head, using the thermal head, the heat reserve to the specific heat generating elements is problematical, because the specific heat generating elements in succession are driven. In particular, the upper portion of the bar in a height direction of the bar which is printed later may be printed thicker due to the heat reserve to the heat generating elements than the lower portion, thereby causing a necessity that the energy to be applied to the heat generating elements is controlled.

On the other hand, when printing in the direction other than the conveying direction, such as the direction of the line head, a number of heat generating elements in a series in an array direction of heat generating elements in the full-multi head are driven at a time, so that the unprinted portion is heated due to its heat reserve to produce the tailed streak, thereby affecting the image quality. Particularly, in the bar code with higher print accuracy, the bar interval for which the printing is not made may be disordered, significantly effecting adversely the detection accuracy of the bar code.

Also, if the recording is performed at lower temperature of the heat generating element (after unprinted lines occur consecutively), there is a risk that the recording may not be fully colored, or be made at lower density so that the fine line can not be detected correctly by the bar code scanner.

Therefore, the control is needed to effect coloration fully at the next recording in the elements which are not involved in recording, or not to cause too high temperature elevation of the heat generating elements in the elements which are involved in continuous recording.

From this regard, the use of the ink jet head is effective.

The present invention brings about excellent effects particularly in a recording head or a recording device of the system having means for generating the heat energy as the energy useful to discharge the ink (e.g., electricity-heat converters or laser beam) and causing state changes of the ink by the heat energy among the various ink jet recording systems. With such a method, the recording with higher density and resolution can be attained.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal-which gives rapid temperature elevation exceeding nucleate boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging port liquid channel, and electricity-heat converter (linear liquid channel or right-angled liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention. In addition, the present invention can be also effectively incorporate the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure waves of heat energy correspondent to the discharging portion. That is, the present invention allows for secure and efficient recording, whatever form the recording head may take.

Further, while in the above example a recording head of the full line type having a length corresponding to the maximum width of a recording medium which can be recorded by the recording device was used, such recording head may be either the constitution which satisfies its length by a combination of a plurality of recording heads or the constitution as one recording head integrally formed.

In addition, among the serial-type recording heads, the present invention is effective for a recording head fixed to the main device, a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and predischarge means which performs discharging separate from recording.

As for the type or number of recording heads to be mounted, the present invention is effective to a single recording head provided corresponding to the monocolor ink or a plurality of recording heads corresponding to a plurality of inks having different recording colors or densities, for example. That is, as the recording mode of the recording device, the present invention is extremely effective for not only the recording mode only of a primary color such as black, etc., but also a device equipped with at least one of plural different colors or full color by color mixing, whether the recording head may be either integrally constituted or combined in plural number, because the bar code is insufficient and the color recording is examined.

In addition, though the ink is considered as liquid in the embodiment of the present invention as above described, other inks may be also usable which are solid below room temperature and will soften or liquefy at or above room temperature, or liquefy when a recording signal used is issued as it is common with the ink jet device to control the viscosity of ink to be maintained within a certain range of the stable discharge by adjusting the temperature of ink in a range from 30° to 70° C. In addition, in order to avoid the temperature elevation due to heat energy by positively utilizing the heat energy as the energy for the change of state from solid to liquid, or to prevent the evaporation of ink, the ink which will stiffen in the shelf state and liquefy by heating may be used. In either case, the use of the inks having a property of liquefying only with the application of heat energy, such as those liquefying with the application of heat energy in accordance with a recording signal so that liquid ink is discharged, or solidifying prior to arriving at the recording medium is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The most effective method for the inks as above described in the present invention is based on the film boiling.

Furthermore, a recording apparatus according to the present invention may be used as an image output terminal in an information processing equipment such as a computer, a copying machine in combination with a reader, or a facsimile terminal equipment having the transmission and reception feature.

As above described, according to the present invention, the label printer adopting the ink jet system and making use of its advantages can be realized, and constructed in smaller size.

Also, as above described, according to the present invention, since the printing elements involving printing are selected appropriately in accordance with the print context or the attitude in conveying the printing medium, it is possible to prevent the shorter life of head by suppressing the bias in the use frequency of elements and to retain the print quality irrespective of the attitude of the printing medium.

As above described, according to the present invention, in the printer for printing a variety of labels, when the shape of label is changed, for example, when the label of circular, elliptic or lozenged shape is mounted on the printer, the label is judged inside the printer, and only if it is fitted with the print format, the printing can be effected.

Also, the judgement can be whether or not the printed context on the label accords with the information to be printed, whereby the highly reliable printer can be provided. In particular, in printing the bar code, it is possible to make a confirmation if the bar code is not printed for some reason, or the density is lower, to be effective.

According to the present invention, in the instances where data exceeding the use label length is printed over a plurality of labels, the regularity of data can be retained by a combination of labels bonded without printing on the mount between labels.

Similarly, in printing the printed matter formed by a group of pages on the continuous sheet, the page designation is simpler and very useful in the operation upon reprinting due to the occurrence of jam. Also, to secure the rightness of the printed matter, the disposal or reprint of page units is simpler, and results in more efficient operation on the management.

In addition, according to the present invention, the received command is classified into an exclusive command indicating that the variable magnification is not permitted and an exclusible command indicating that it is permitted to some extent, and there are provided storage means for storing individual developed area values for the exclusible command, altering means for altering developed area values stored in the storage means when executing the development for the exclusive command, and developing means for developing data in accordance with the developed area values stored in the storage means when executing the development for the exclusible command, whereby for data such as bar code data which has some tolerance in the variable magnification such as magnification or height, the magnification or height of the bar code data is changed in the competitive condition with other print data, to resolve troubles in the design of the document and creating the print data, with enhanced operation efficiency.

Also, as above described, according to the present invention, since the specific information which does not interfere with the discrimination of the information (intrinsic information) and is subjected to the essential uses such as the display of product information is automatically added in printing, the designation of the printer or the recognition of the changed position of the intrinsic information can be readily made without imposing burden on the operator.

Also, with the present invention, in printing the information requiring the strict printing accuracy such as the bar code, the correct printing can be effected.

What is claimed is:

1. A printer effecting printing by discharging ink onto a recording medium by use of an ink jet provided with a plurality of discharge means for discharging ink, said printer comprising:

head mounting means for mounting said ink jet head, said head mounting means mounting said ink jet head at a predetermined height above the recording medium, such that ink is discharged from said ink jet head in a downward direction onto the recording medium to perform printing;

conveying means for conveying the recording medium with respect to said ink jet head, said conveying means conveying the recording medium in a substantially horizontal direction in a print area where printing is performed in such a manner that ink is discharged from said ink jet head;

head recovery means for stabilizing a print performance of said ink jet head;

moving means for relatively moving said head recovery means and said head mounting means, said head recovery means executing an operation for stabilizing the print performance of said inkjet head in a state where said ink jet head to be mounted to said head mounting means is relatively positioned with respect to said head recovery means by said moving means;

ink tank mounting means for mounting an ink tank for storing ink for supply to said ink jet head, said ink tank mounting means mounting the ink tank below a conveying surface of the recording medium in the print area by said ink jet head; and a sub ink tank, provided in an ink supply route from the ink tank mounted on said ink tank mounting means to said ink jet head, for temporarily storing ink, an upper portion of said sub ink tank being above the conveying surface of the recording medium in the print area and a lower portion of the sub ink tank being below the conveying surface of the recording medium in the print area, wherein said sub ink tank is arranged separate from the ink jet head, wherein said head mounting means mounts said ink jet head above the conveying surface of the recording medium and said head recovery means is provided above the conveying surface of the recording medium.

2. A printer according to claim 1, wherein said conveying means comprises means for effecting conveyance of the recording medium at the print area by said ink jet head via a conveyance belt utilizing electrostatic attraction, and upstream of the print position in the conveyance direction, means for correcting the curl of the recording medium formed as a roll, and means for providing adequate flexure in conveying the recording medium.

3. A printer according to claim 2, wherein said conveyance belt comprises an NBR layer as an inside layer and a silicone type insulating layer as an outside layer and facing the recording medium, and prior to attraction of the recording medium, said conveying means applies minus electric charges to said silicone type insulating layer by a first electrification means, and applies plus electric charges to the neighborhood of a contact point between the recording medium and said conveyance belt by a second electrification means, said second electrification means carrying the recording medium while pinching the recording medium against said conveyance belt.

4. A printer according to claim 1, further comprising communication means for communicating with external equipment connected with said printer to communicate data concerning printing.

5. A printer according to claim 1, wherein a plurality of ink jet heads are provided corresponding to inks of different color tones, said printer further comprising time division processing means for time-dividing so that the timing of print driving pulse signals to be applied to said plurality of ink jet heads do not overlap each other.

6. A printer according to claim 1, further comprising three memory access means having access to storage means for storing print data, and control means for determining one of said three memory access means on the basis of a predetermined priority level by a first bus decision means for deciding the priority level of memory access, one of said three memory access means further including a plurality of data transfer means, and second bus decision means for transferring memory data sequentially to said plurality of data transfer means within a period permitted by the one of said three memory access means.

7. A printer according to claim 1, further comprising means for effecting interruption and restart of printing during a printing operation with head control means.

8. A printer according to claim 7, wherein the interruption and restart of printing is effected at every predetermined period, or by a command instruction, or through a key or switch operation.

9. A printer according to claim 7, wherein the stabilizing of print performance of said ink jet head is effected during the interruption of the printing operation.

10. A printer according to claim 1, wherein said recovery means discharges the ink through said ink jet head in accordance with predetermined pattern data.

11. A printer according to claim 1, wherein the stabilizing of print performance with said recovery means is effected by circulation of the ink in said ink jet head and said ink tank.

12. A printer according to claim 1, wherein said discharge means of said ink jet head comprises heat energy generating elements for generating heat energy to discharge the ink.

13. A printer according to claim 12, wherein said ink jet head causes state changes in the ink due to the heat energy generated by said heat energy generating elements to discharge the ink by the use of pressure produced by the state changes.

14. A printer according to claim 1, further comprising a temperature sensor attached to said ink jet head, wherein an interruption of a printing operation, reduction of a printing speed, or circulation of the ink within said ink jet head is effected upon detecting a rise in temperature of said ink jet head by said sensor.

15. A printer according to claim 1, wherein the recording medium comprises a type of recording medium in which a label is adhered to a peeling sheet.

16. A printer according to claim 1, wherein the recording medium comprises a rolled sheet which is stored in a roll and supplied along a conveyance direction by said conveying means effecting a rotating operation.

17. A printer according to claim 1, further comprising ink supply driving means for supplying ink from a mounted ink tank through the ink supply route and said sub ink tank to said ink jet head, said ink supply driving means being capable of supplying ink from said recording head to said sub ink tank.

18. A printing method of effecting printing by discharging ink onto a recording medium by use of an ink jet head provided with a plurality of discharge means for discharging ink, said method comprising the steps of:

mounting the ink jet head at a predetermined height above the recording medium, such that ink is discharged from the ink jet head in a downward direction onto the recording medium to perform printing;

conveying the recording medium with respect to the ink jet head in a substantially horizontal direction in a print area where printing is performed in such a manner that ink is discharged from the ink jet head;

providing head recovery means for stabilizing a print performance of the ink jet head;

relatively moving the head recovery means and the mounted ink jet head, the recovery means executing an operation for stabilizing the print performance of the ink jet head in a state where the mounted ink jet is relatively positioned with respect to the head recovery means;

mounting an ink tank for storing ink for supply to the ink jet head, the ink tank being mounted below a conveying surface of the recording medium in the print area of the ink jet head; and providing a sub ink tank arranged separate from the ink jet head in an ink supply route from the mounted ink tank to the ink jet head, for temporarily storing ink, an upper portion of the sub ink tank being above a conveying surface of the recording medium in the print area and a lower portion of the sub ink tank being below the conveying surface of the recording medium in the print area, wherein the ink jet head is mounted above the conveying surface of the recording medium and the head recovery means is provided above the conveying surface of the recording medium.

19. A full-line printer for printing one line at a time with a downwardly-facing, stand-alone ink jet head separated from an above-and-below-the-recording-medium ink supply, said printer comprising:

a downwardly-facing, stand-alone ink jet head comprising a plurality of discharge means for discharging ink respectively through a plurality of discharge ports onto a recording medium to record an image, wherein the plurality of discharge ports are provided along a widthwise direction of the recording medium to permit printing of one line at a time without scanning the line in a main-scanning direction with the ink jet head, the widthwise direction being different from the conveyance direction of the recording medium;

head mounting means for mounting said ink jet head, said head mounting means mounting said ink jet head at a predetermined height above the recording medium, such that ink is discharged from said inkjet head in a vertical downward direction onto the recording medium to perform printing;

conveying means for conveying the recording medium with respect to said ink jet head in the conveying direction, said conveying means conveying the recording medium in a substantially horizontal direction in a print area where printing is performed in such a manner that ink is discharged from said ink jet head;

head recovery means for stabilizing a print performance of said ink jet head;

moving means for relatively moving said head recovery means and said head mounting means, said head recovery means executing an operation for stabilizing the print performance of said ink jet head in a state where said ink jet head to be mounted to said head mounting means is relatively positioned with respect to said head recovery means by said moving means;

ink tank mounting means for mounting an ink tank for storing ink for supply to said ink jet head, said ink tank mounting means mounting the ink tank below a conveying surface of the recording medium in the print area by said ink jet head; and a sub ink tank, provided in an ink supply route from the ink tank mounted on said ink tank mounting means to said ink jet head, for temporarily storing ink, an upper portion of said sub ink tank being above the conveying surface of the recording medium in the print area and a lower portion of the sub ink tank being below the conveying surface of the recording medium in the print area, wherein said sub ink tank is arranged separate from and is spaced from said ink jet head, and wherein said head mounting means mounts said ink jet head above the conveying surface of the recording medium and said head recovery means is provided above the conveying surface of the recording medium.

20. A full-line printer for printing one line at a time with a downwardly-facing, stand-alone ink jet head separated from an above-and-below-the-recording-medium ink supply, said printer comprising:

a downwardly-facing, stand-alone ink jet head comprising a plurality of discharge means for discharging ink respectively through a plurality of discharge ports onto a recording medium to record an image, wherein the plurality of discharge ports are provided along a widthwise direction of the recording medium to permit printing of one line at a time without scanning the line in a main-scanning direction with the ink jet head, the widthwise direction being different from the conveyance direction of the recording medium;

head mounting means for mounting said ink jet head, said head mounting means mounting said ink jet head at a predetermined height above the recording medium, such that ink is discharged from said ink jet head in a vertical downward direction onto the recording medium to perform printing;

conveying means for conveying the recording medium with respect to said ink jet head in the conveying direction, said conveying means conveying the recording medium in a substantially horizontal direction in a print area where printing is performed in such a manner that ink is discharged from said ink jet head;

head recovery means for stabilizing a print performance of said ink jet head;

moving means for relatively moving said head recovery means and said head mounting means, said head recovery means executing an operation for stabilizing the print performance of said ink jet head in a state where said ink jet head to be mounted to said head mounting means is relatively positioned with respect to said head recovery means by said moving means;

ink tank mounting means for mounting an ink tank for storing ink for supply to said ink jet head, said ink tank mounting means mounting the ink tank below a conveying surface of the recording medium in the print area by said ink jet head; and separated means, separated and spaced from said ink jet head, for storing ink both above and below the recording-medium conveyance surface, closer to said ink jet head than said ink tank, said separated means comprising a sub ink tank, provided in an ink supply route from the ink tank mounted on said ink tank mounting means to said ink jet head, for temporarily storing ink, an upper portion of said sub ink tank being above the conveying surface of the recording medium in the print area and a lower portion of the sub ink tank being below the conveying surface of the recording medium in the print area, wherein said sub ink tank is arranged separate from and is spaced from said ink jet head, and wherein said head mounting means mounts said ink jet head above the conveying surface of the recording medium and said head recovery means is provided above the conveying surface of the recording medium.

* * * * *

UNITED STATES PATENT AND TRADEMARK OFFICE

CERTIFICATE OF CORRECTION

PATENT NO. : 6,172,688 B1
DATED : January 9, 2001
INVENTOR(S) : Iwasaki et al.

It is certified that error appears in the above-identified patent and that said Letters Patent is hereby corrected as shown below:

Drawings:
Sheet 26, Figure 35A, "REFLESH" should read -- REFRESH --.
Sheet 56, Figure 67B, "OFF SET" should read -- OFFSET -- (both occurrences).
Sheet 56, Figure 67C, "OFF SET" should read -- OFFSET -- (both occurrences).

Column 1,
Line 29, "an the" should read -- an increase of the --.

Column 2,
Line 11, "above" should read -- the above --.

Column 5,
Line 34, "effecting" should read -- affecting --.
Line 35, "great" should read -- a great --.

Column 8,
Line 23, "over." should read -- over --.

Column 10,
Line 13, "burden" should read -- a burden --.
Line 45, "interfering" should read -- interfering with --.
Line 50, "burden" should read -- a burden --.

Column 13,
Line 22, "as-shown" should read -- as shown --.
Line 58, "FIG. 64," should read -- FIG. 64 --.

Column 16,
Line 24, "this." should read -- this --.

Column 17,
Line 38, "as" should be deleted.

Column 18,
Line 51, "rack 9" should read -- rack 79-10 --.

Column 19,
Line 43, "Indicated" should read -- indicated --.

Column 20,
Line 49, "an" should read -- a --.

UNITED STATES PATENT AND TRADEMARK OFFICE

CERTIFICATE OF CORRECTION

PATENT NO. : 6,172,688 B1
DATED : January 9, 2001
INVENTOR(S) : Iwasaki et al.

It is certified that error appears in the above-identified patent and that said Letters Patent is hereby corrected as shown below:

Column 21,
Line 5, "backward-directions." should read -- backward directions. --.

Column 22,
Line 9, "iand" should read -- and --.
Line 22, "Ts" should read -- TS --.
Line 64, "352" should read -- 351 --.

Column 23,
Line 49, "FIGS. 242" should read -- FIGS. 24A --.

Column 24,
Line 56, "length-is" should read -- length is --.

Column 25,
Line 26, "ill Pig. 24A," should read -- in Fig. 24A, --.

Column 26,
Line 19, "buffer 15a" should read -- buffer 158 --.
Line 22, "ap" should read -- map --.
Line 25, "operation-into" should read -- operation into --.

Column 27,
Line 11, "twenty one" should read -- twenty-one --, and "sixty four" should read -- sixty-four --.
Line 47, "IC21" should begin a new paragaph.

Column 28,
Line 38, "7" should be deleted.

Column 29,
Line 28, "step 8002," should read -- step S002, --.

Column 30,
Line 14, "a-print" should read -- a print --.

Column 31,
Line 29, "a t" should read -- at --.
Line 31, "wiping-process" should read -- wiping process --.
Line 35, "in °" should read -- in --.
Line 48, "FIG. 23c" should read -- FIG. 23C --.

UNITED STATES PATENT AND TRADEMARK OFFICE

CERTIFICATE OF CORRECTION

PATENT NO. : 6,172,688 B1
DATED : January 9, 2001
INVENTOR(S) : Iwasaki et al.

It is certified that error appears in the above-identified patent and that said Letters Patent is hereby corrected as shown below:

Column 32,
Line 55, "7" should be deleted.

Column 33,
Line 12, "7" should be deleted.
Line 23, "illutrated" should read -- illustrated --.

Column 36,
Line 25, "having" should read -- being --.
Line 28, "more early." should read -- earlier. --.

Column 37,
Line 12, "judged-by" should read -- judged by --.
Line 35, "for," should read -- for --.
Line 60, "make" should read -- makes --.

Column 38,
Line 46, "With" should begin a new paragraph.

Column 39,
Line 25, "restating" should read -- restarting --.

Column 40,
Line 1, "is" should read -- are --.
Line 40, "S513," should read -- S513, if --.

Column 41,
Line 1, "flowchart" should read -- a flowchart --.

Column 42,
Line 43, "nozzle" should read -- nozzles --.

Column 43,
Line 45, "arraged" should read -- arranged --.
Line 52, "print heat" should read -- print head --.

Column 45,
Line 35, "418 μpm" should read -- 418 μm --.
Line 44, "330 μpm" should read -- 330 μm --.

UNITED STATES PATENT AND TRADEMARK OFFICE

CERTIFICATE OF CORRECTION

PATENT NO. : 6,172,688 B1
DATED : January 9, 2001
INVENTOR(S) : Iwasaki et al.

It is certified that error appears in the above-identified patent and that said Letters Patent is hereby corrected as shown below:

Column 47,
Line 30, "bar," should read -- bar --.
Line 54, "268395÷95=282.5" should read -- 26839.5÷95=282.5 --.

Column 48,
Line 66, "effects" should read -- effect --.

Column 49,
Line 24, "effecting" should read -- affecting --.
Line 50, "signal-which" should read -- signal which --.

Column 50,
Line 6, "port" should read -- port, --.
Line 13, "be" should be deleted.

Column 52,
Line 21, "burden" should read -- a burden --.
Line 27, "ink jet" should read -- ink jet head --.
Line 48, "inkjet" should read -- ink jet --.

Column 54,
Line 45, "tank" should read -- tank, --.
Line 46, "head" should read -- head, --.

Column 55,
Line 7, "inkjet" should read -- ink jet --.

Signed and Sealed this

Eighteenth Day of December, 2001

*Attest:*

*Attesting Officer*

JAMES E. ROGAN
*Director of the United States Patent and Trademark Office*